US006266897B1

(12) United States Patent
Seydel et al.

(10) Patent No.: US 6,266,897 B1
(45) **Date of Patent: *Jul. 31, 2001**

(54) GROUND-CONTACTING SYSTEMS HAVING 3D DEFORMATION ELEMENTS FOR USE IN FOOTWEAR

(75) Inventors: Roland Seydel; Simon Luthi, both of Lake Oswego, OR (US); Richard Fumi, Hoehstadt (DE); Kevin A. Beard, Herzogenaurach (DE); Ottmar Kaiser, Pegnitz (DE)

(73) Assignee: Adidas International B.V., Amsterdam (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/701,827

(22) Filed: Aug. 23, 1996

(Under 37 CFR 1.47)

Related U.S. Application Data

(63) Continuation-in-part of application No. PCT/PE95/01128, filed on Aug. 21, 1995, and a continuation-in-part of application No. 08/327,461, filed on Oct. 21, 1994, now abandoned.

(51) Int. Cl.[7] ..... A43B 13/20
(52) U.S. Cl. ..... 36/29; 36/25 R
(58) Field of Search ..... 36/29, 25 R, 30 R, 36/32 R, 71

(56) References Cited

U.S. PATENT DOCUMENTS 1,639,381 * 8/1927 Manelas ..... 36/29
2,627,676 * 2/1953 Hack ..... 36/29
4,263,728 * 4/1981 Frecentese ..... 36/29 X
4,319,412 * 3/1982 Muller et al. ..... 36/29
4,397,104 * 8/1983 Doak ..... 36/29
4,547,978 * 10/1985 Radford ..... 36/29 X
4,856,208 * 8/1989 Zaccaro ..... 36/29
5,117,566 * 6/1992 Lloyd et al. ..... 36/29
5,158,767 * 10/1992 Cohen et al. ..... 36/29 X
5,598,645 * 2/1997 Kaiser ..... 36/29
5,794,359 * 8/1998 Jenkins et al. ..... 36/28

* cited by examiner

*Primary Examiner*—Ted Kavanaugh
(74) *Attorney, Agent, or Firm*—Testa, Hurwitz & Thibeault LLP

(57) ABSTRACT

The present invention discloses a ground-contacting system including 3D deformation elements having interiors filled with either a compressible fluid, such as a gas, or filled with other materials such as liquids, foams, viscous materials and/or viscoelastic materials. The 3D elements are designed to deform distort,l or deflect in three mutually orthogonal directions simultaneously and are associated directly with the surfaces that routinely come in direct contact with a ground surface such as the underside of the sole and side portions of the shoe upper near the sole. The 3D elements are also designed to decrease the amount of force transferred to the wearers feet, legs, back, and joints due to their ability to distort three dimensionally and to dissipate the energy of foot fall into thermal energy. The 3D elements are also designed to allow the shoe or foot to move a measurable amount relative to the ground-contacting surface in response to an applied force such as the forces encountered in walking, running, or any in other activity.

18 Claims, 22 Drawing Sheets

GROUND-CONTACTING SYSTEMS HAVING 3D DEFORMATION ELEMENTS FOR USE IN FOOTWEAR

RELATED APPLICATIONS

This application is a continuation-in-part of (1) U.S. patent application Ser. No. 08/327,461 filed Oct. 21, 1994, now abandoned, and (2) PCT Patent Application designating the U.S. Ser. No. PCT/PE 95/01128 filed Aug. 21, 1995.

BACKGROUND OF THE INVENTION

1. Field of the Invention

The present invention relates to a ground contacting system for use in shoes which provide a damping action to cushion foot impact, a 3D force reduction action to reduce force transference and a deflecting action to allow a slight, but detectable displacement of user's foot relative to the ground contacting system.

More particularly, the present invention relates to a ground contacting system including a first plurality of 3D deformable, deflectable, damping elements projecting downward from an undersurface of an outsole and/or a second plurality of 3D deformable, deflectable, damping elements having a portion projecting downward from the outsole undersurface and having a second portion wrapping up above the undersurface of the outsole onto an upper where the elements cushion foot impact, reduce force transference three dimensionally and allow for a slight, but measurable displacement of the user's foot relative to a ground contacting surface of the elements in the direction of the forces associated with foot fall.

2. Description of Related Art

Footwear intended for physical activity includes an upper and a securely attached sole. The upper wraps around some or all of a wearer's foot, and is typically held in place by shoelaces. Soles typically include an inner sole, a midsole, and an outsole. Midsoles are generally formed of a cushioning material while outsoles are wear-resistant layers. Overall, soles are designed to provide stability and absorb impact loading caused by the foot of a wearer coming down upon the ground.

Significant engineering goes into providing and balancing design parameters for stability and cushioning. Special EVA foam materials have been formulated for use in midsoles. Various manufacturers have incorporated devices in the midsole to provide stability, cushioning, or, hopefully, both. For example, one major footwear manufacturer incorporates an air bag that is filled with a high molecular weight gas in order to provide substantial cushioning underneath the heal of the wearer. That manufacturer also provides midsole structure to enhance sole stability that is lost due to the presence of the air bag. Another manufacturer has used a gel-filled bag in the midsole to absorb impact. Another manufacturer provides "cantilever" technology to provide cushioning with a goal toward a minimum loss of stability.

Examples of devices designed to provide stability include heel counters, variable density EVA foams in the midsole, and inelastic straps going from the fore foot to the heel section of the shoe.

It is common knowledge in the footwear industry that a runner will experience less leg fatigue and muscle and joint stress by running on a dirt road than on a paved road over equal distances. Folklore has always attributed the difference to the theory that the dirt road provides a softer or more cushioned surface upon which to run. However, empirical tests have suggested that many dirt roads are just as hard as paved roads when measured under vertical impact loading. The applicants of the present invention have therefore theorized that dirt roads may provide the advantage of a small amount of sliding each time a runner's foot contacts the ground.

When running on a dirt road, the runner's foot will go through a forward motion until it makes initial contact with the ground whereupon it slides forward slightly until coming to a rest. This action is repeated for each step. Because impact is measured as force divided by the amount of time the force is applied, the impact on a leg is lessened by the foot's sliding because the force of each step is applied over a greater amount of time. This is contrasted with running on pavement wherein the foot moves forward between steps and upon initial ground contact the foot comes to an immediate halt without any substantial forward sliding. Thus, the impact load on the foot, and hence the leg, is substantially greater.

Additionally, runners run with their knees bent. Thus, the lower leg forms a pivot point at the knee. During the time that the foot transitions from forward motion to a dead stop there is a rearward force (friction) on the bottom of the shoe by the ground which acts to pivot the lower leg about the knee, thus creating a moment at the knee joint. This moment must be resisted, in part, by the quadriceps and knee ligaments. It is the applicant's theory that when a runner runs on a dirt or gravel road the small amount of forward sliding that occurs upon each footfall reduces the moment at the knee due to impact loads because the amount of time that the load is applied is increased while the magnitude of the load does not change.

Similar kinematics apply to sports other than running. When tennis is played on a clay court the players experience some sliding each time a foot plant is performed. Conversely, when tennis is played on an asphalt court players may experience greater muscle fatigue because the foot cannot slide during sudden stops thus creating greater impact.

Numerous foreign patent and applications and numerous United States patents have disclosed, taught and claimed various techniques for imparting cushioning and stability to a shoe. However, none of these techniques have simultaneously optimized the bio-mechanical characteristics of the shoe. Thus, it would represent an advancement in the art to produce soles that can be continuously woven into the upper so that there is a smooth transition from the sole element to the upper element so that the foot can be better supported and better accommodated by a shoe so constructed.

SUMMARY OF THE INVENTION

Generally, the present invention provides a ground contacting system having a damping action to cushion foot impact, a 3D deflecting action to allow a slight, but detectable displacement of a sole relative to a ground contacting surface(s) of the ground contacting system, a 3D force reduction action, and an energy dissipating action in response to an applied force. The ground contacting system of the present invention is designed to optimize various parts of the shoe so that bio-mechanical stresses and strains on a wearer can be minimized without adversely affecting shoe performance and the overall feel of the shoe to the wearer. Additionally, the ground contacting system of the present invention when applied to a sports shoe or running shoes, affords damping support and guide actions which can be tailored to be individual needs of the wearer.

In particular, the present invention provides a ground contacting system including at least one 3D deflectable/distortable/deformable element attachably engaged to an underside of a sole where the element cushions foot impact, dissipates the energy associated with foot impact, reduces the force associated with foot impact three dimensionally, and allows for a slight, but measurable displacement of the sole relative to a ground contacting zone of the element when the element is in direct contact with a ground surface in the direction of an applied force associated with foot impact.

The present invention also provides a ground contacting system including at least one 3D deflectable/distortable/deformable element attachably engaged to an underside sole having a portion parallel to the underside of the sole and having a second portion wrapping up and extending above the sole an amount sufficient to cushion lateral and/or side foot impact, to enhance stability, to inhibit rollover, to dissipate the energy associated with foot impact, to reduce force transference three dimensionally, and to allow a slight, but measurable displacement of the sole and/or shoe relative to a ground contacting zone of the element in the direction of an applied force associated with foot impact.

The present invention also provides a ground contacting system including at least one of a first 3D deformable element attachably engaged to an underside of a sole where the first element cushions foot impact, dissipates energy, reduces three dimensional force transference, and allows for a slight, but measurable displacement of the sole relative to a ground contacting zone of the element in a plane parallel to a ground contacting zone when the element is in direct contact with a ground surface and at least one of a second 3D deformation element attachably engaged to the sole having a first portion parallel to the underside of the sole and having a second portion wrapping up and extending above the sole, an amount sufficient to cushion lateral and/or side foot impact to enhance stability, to inhibit rollover, to dissipate energy, reduces three dimensionally force transference and to allow a slight, but measurable displacement of the shoe relative to the ground contacting zone of the elements.

The present invention also provides ground contacting system elements that have greater vertical deformation than horizontal deformation and, alternatively, elements that have greater horizontal deformation than vertical deformation.

The present invention also provides soles having the ground contacting system of this invention incorporated therewith.

The present invention also provides shoes including a sole having the ground contacting system of this invention incorporated therewith.

The present invention also provides methods for three dimensional reduction of force transference and dissipating energy associated with foot impact at contact surfaces between a shoe and a ground surface. The energy dissipation involves the conversion of some of the foot fall impact to heat through distortion of a ground contacting system associated with the shoe at positions on the shoe that engage the ground surface. The ground contacting system is designed to distort three dimensionally so that the force transference associated with foot impact is reduced and some of the energy associated with ground contact is dissipated primarily in the ground contacting system.

The present invention also provides a method for reducing stress and strain on a wearer's feet, ankles, legs and back, where the wearer's foot can move a slight amount in the direction of foot impact relative to surfaces of ground contact and to reduce force transference of foot impact in three dimensions and dissipate the energy of foot impact which reduces joint moments such as moments in the ankle, knee, and the like. The three dimension of deformation include a vertical dimension (perpendicular to the ground contact surface) and two horizontal dimensions (in a plane substantially parallel to the ground contact surface) that form a right-handed (or left handed) orthogonal coordinate system.

BRIEF DESCRIPTION OF THE DRAWINGS

Further advantages and features of the invention will be apparent from the following description of embodiments with reference to the accompanying drawings, and from further appendant claims. In the drawings:

Ground Contacting Systems Including 3D Deformation Elements

Anisotropic Deformation Pad for Footwear

FIGS. 16–23 are from co-pending application Ser. No. 08/327,461.

Figure 16:
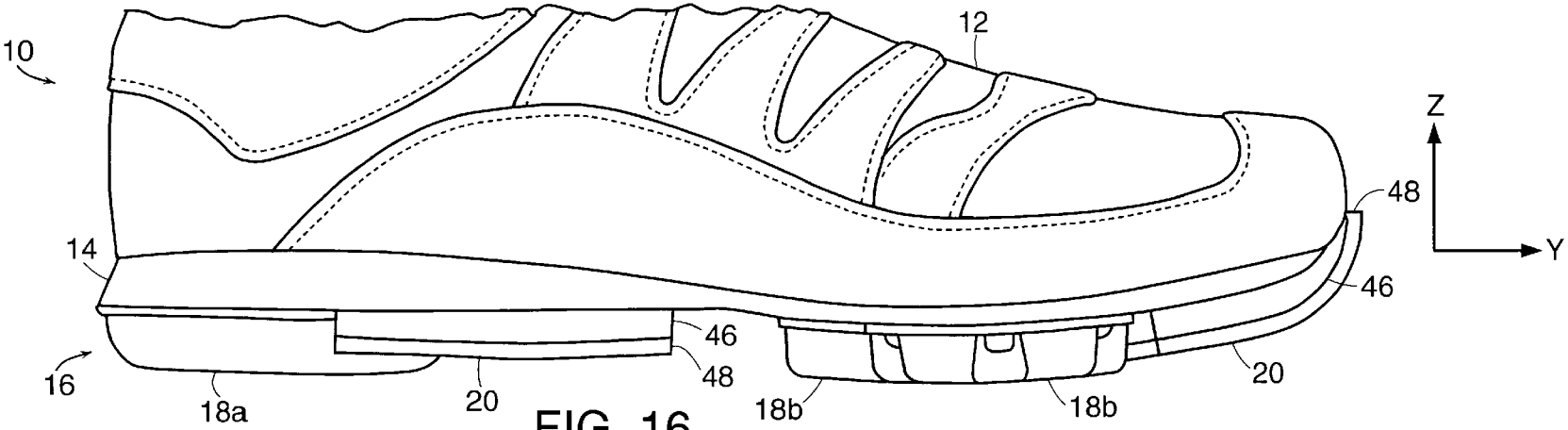
Figure 17:
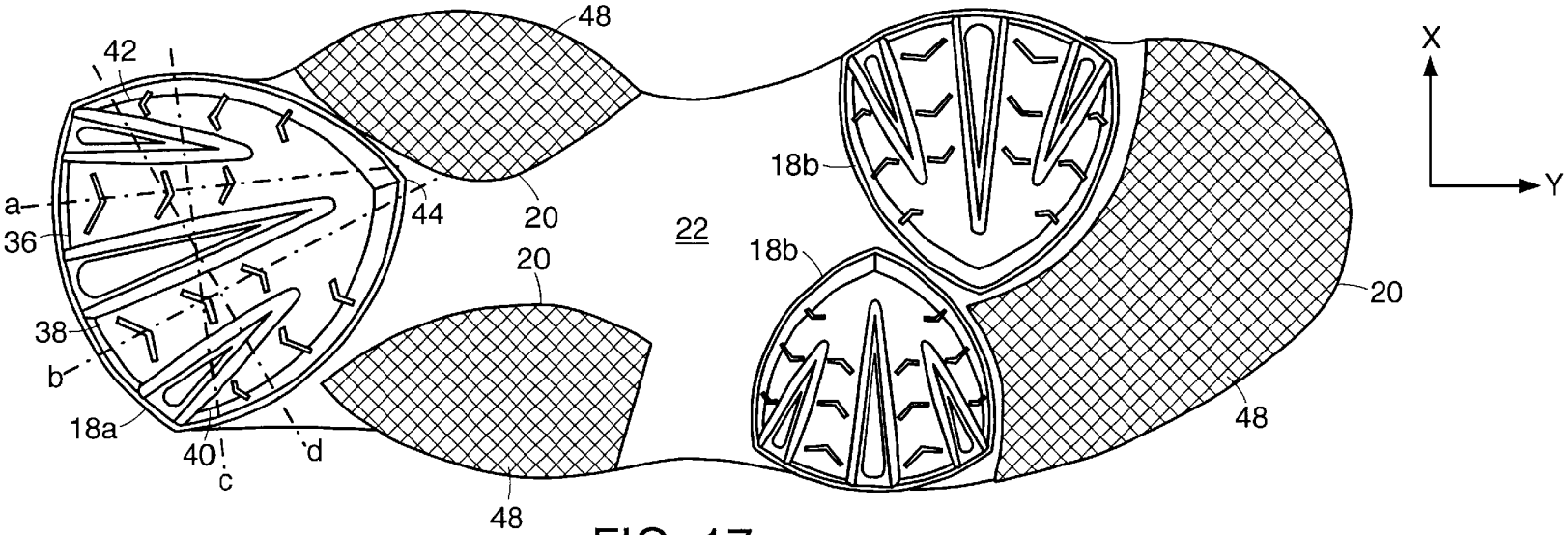
Figure 18:
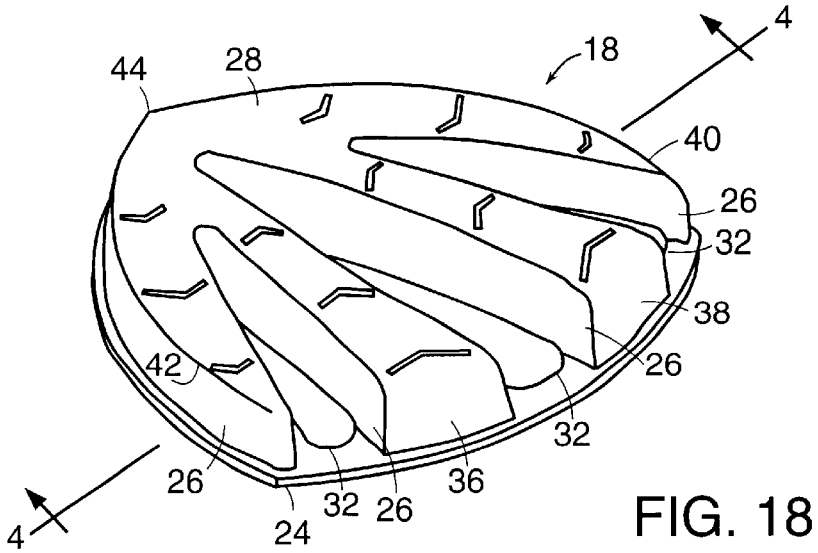
Figure 19:
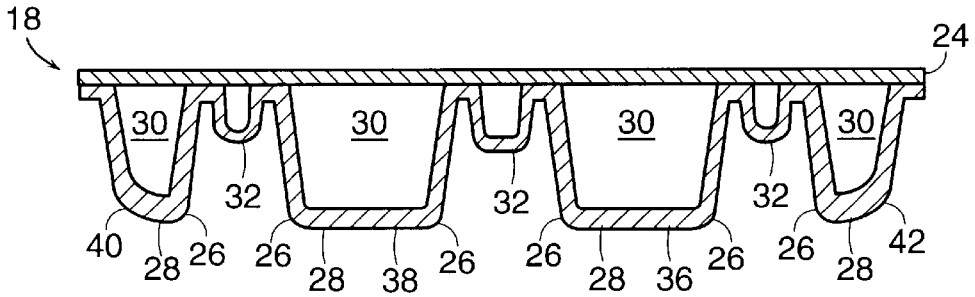
Figure 20:
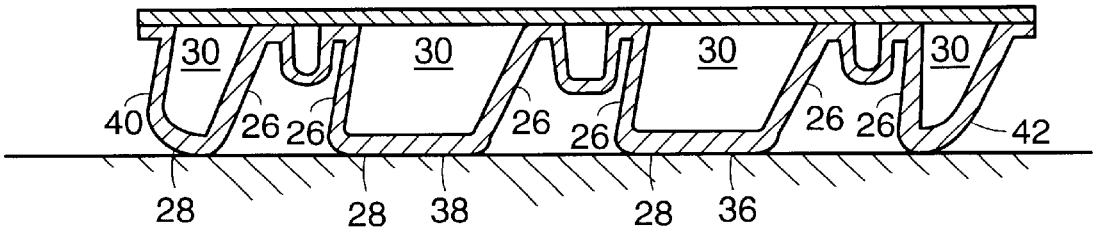
Figure 21:
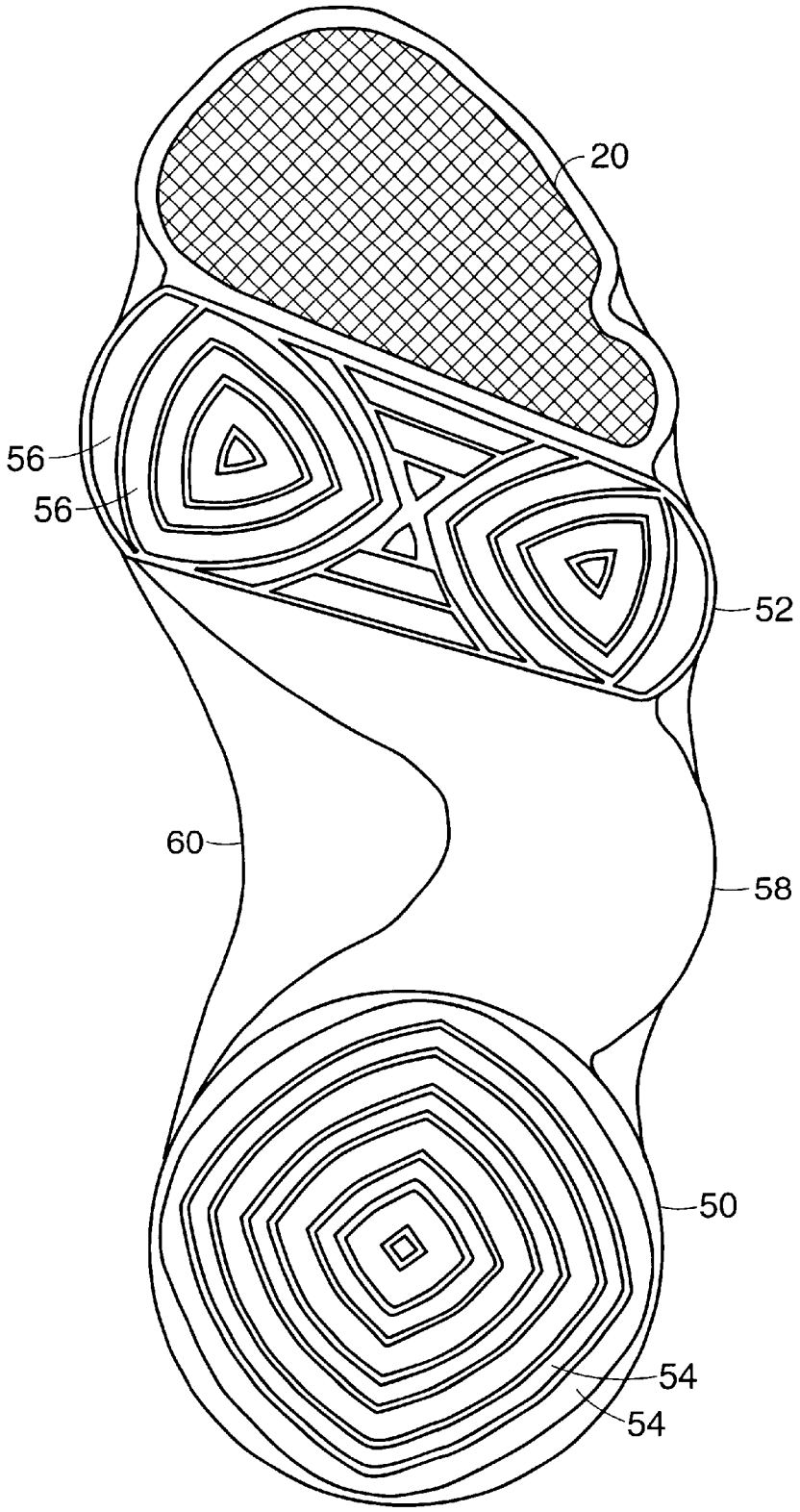
Figure 22:
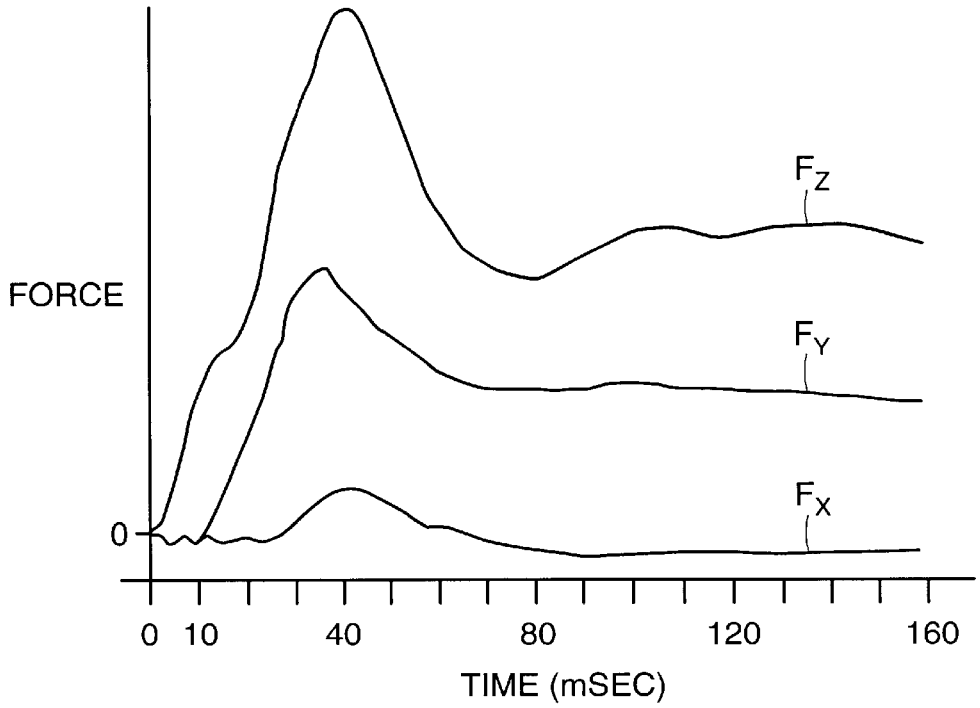
Figure 23:
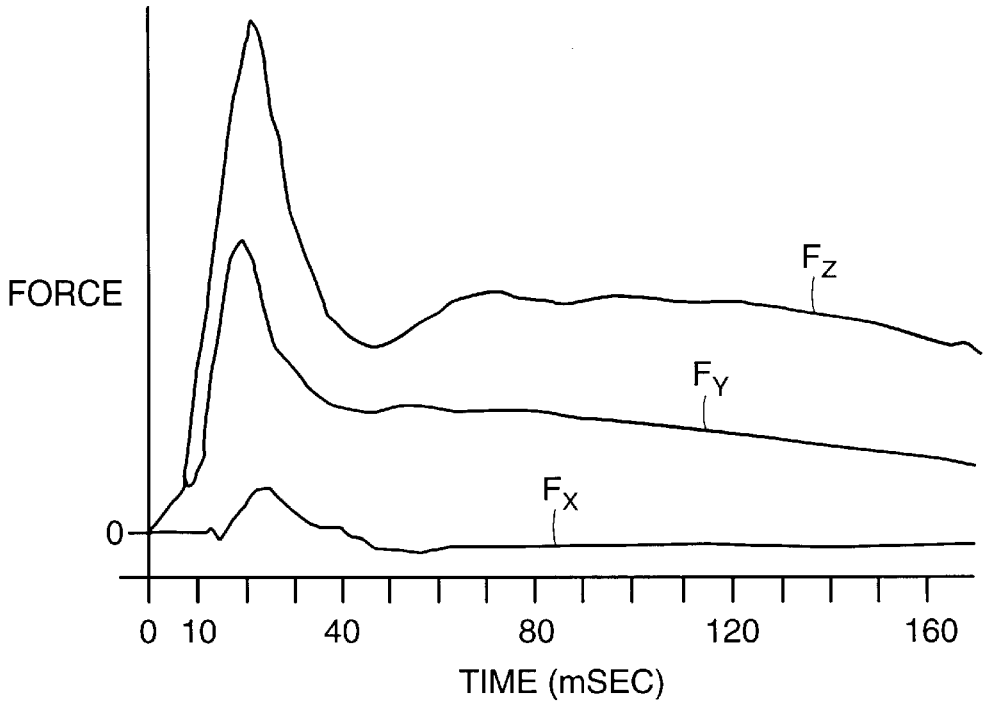

FIG. 16 is a partial side elevation view showing a shoe upper connected to a midsole and an outsole having deformation pads and support elements arranged and constructed in accordance with a preferred embodiment of the present invention;

FIG. 17 is a bottom plan view of the shoe of FIG. 16;

FIG. 18 is a perspective view of a preferred embodiment of an anisotropic deformation pad of the present invention;

FIG. 19 is a cross section view taken along line 4—4, showing the deformation pad in an undeformed state;

FIG. 20 is a cross section view taken along line 4—4, showing the deformation pad in one exemplary deformed state;

FIG. 21 is a bottom plan view of a sole having an alternate preferred embodiment of anisotropic deformation pads and support elements in accordance with the present invention;

FIGS. 22 and 23 are graphical representations of measurements of force of a single footfall of a person wearing footwear running over a force plate;

Outsole With Bulges

FIGS. 24–29 are from co-pending PCT application Serial No. PCT/PE 95/01128.

Figure 24:
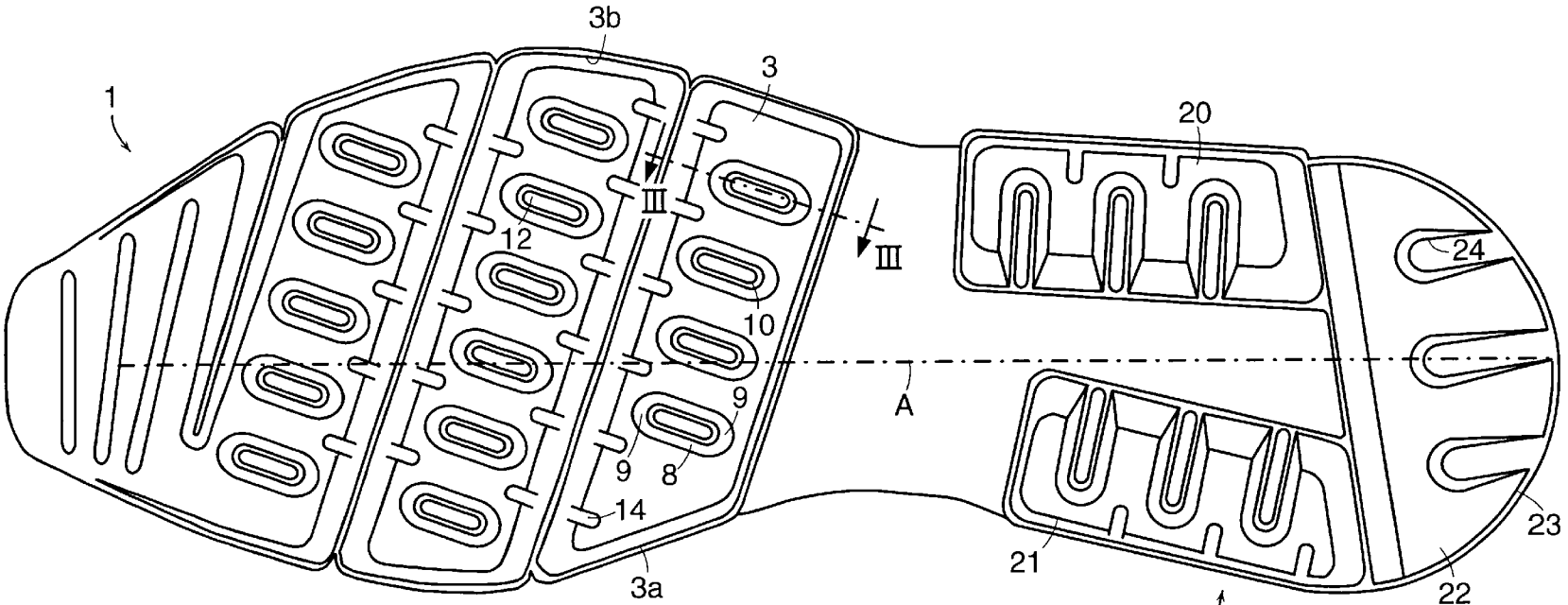
Figure 26:
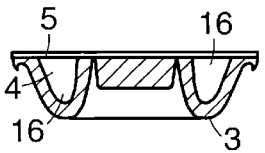
Figure 25:
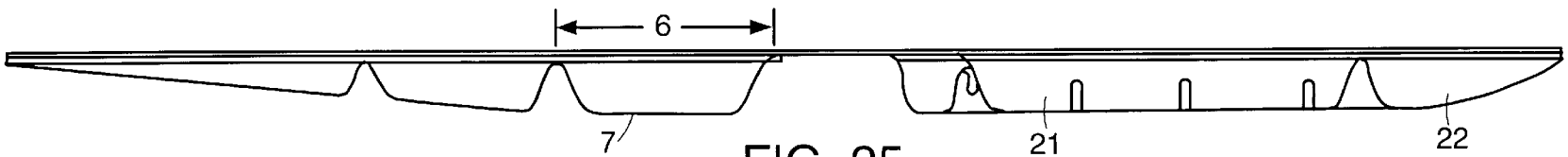
Figure 27:
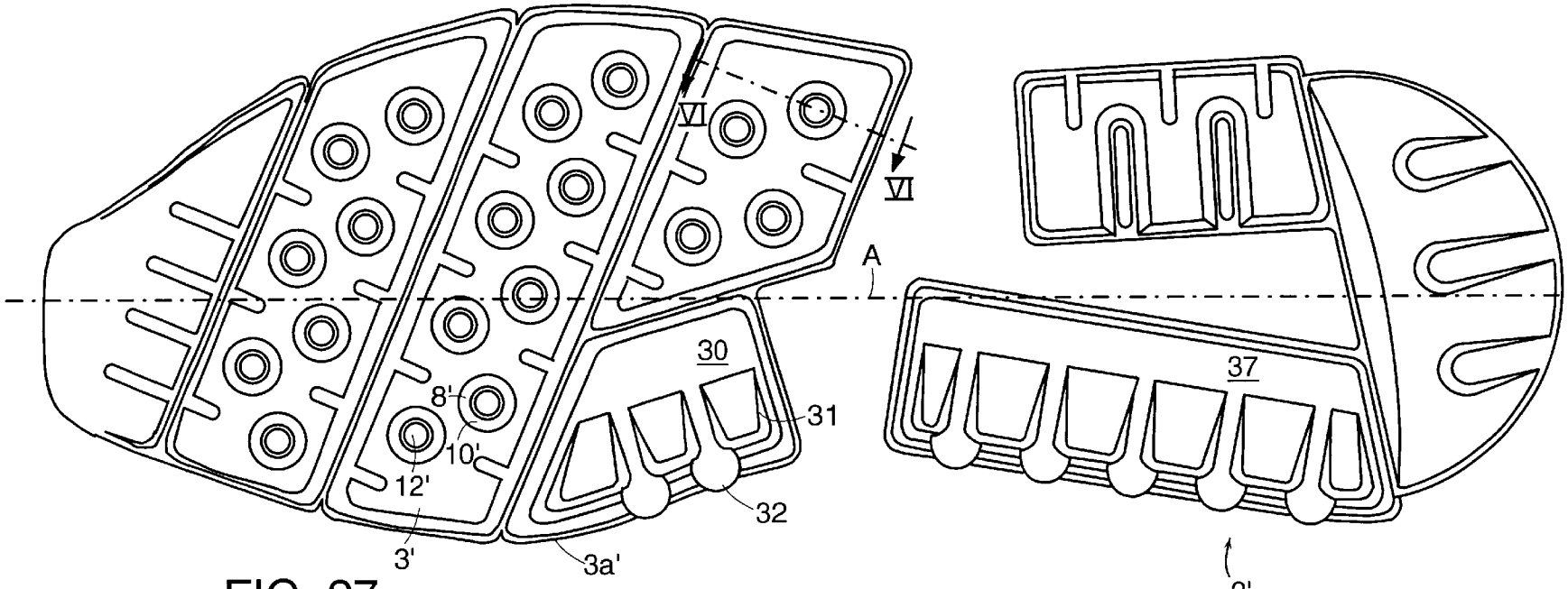
Figure 28:
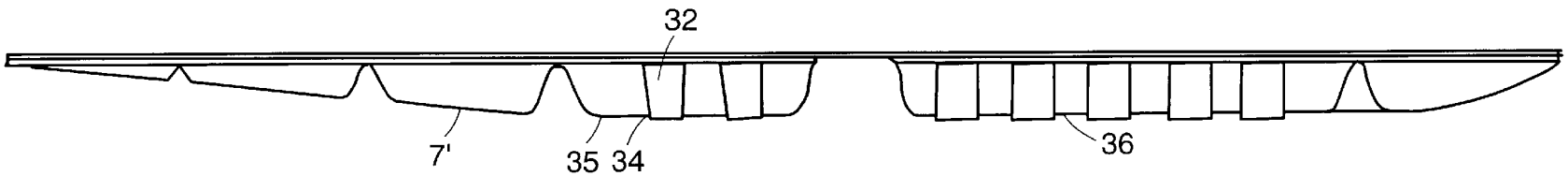

FIG. 24 is a plan view of the ground-engaging side of a first embodiment of the outsole according to the invention;

FIG. 25 is a side view of the outsole from the medial side II;

FIG. 26 is a partial view in section taken along line III—III in FIG. 24;

FIG. 27 is a plan view similar to that shown in FIG. 24, of a modified embodiment;

FIG. 28 is a side view of the outsole from the medial side V; and

Figure 29:
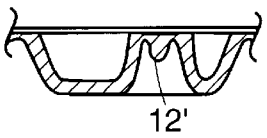

FIG. 29 is a partial view in section, similar to that shown in FIG. 26, taken along line VI—VI in FIG. 27.

DESCRIPTION OF THE PREFERRED EMBODIMENTS OF THE INVENTION

Ground-Contacting Systems Including 3D Deformation Elements

General Details

The inventors have found that shoes and shoe soles can be manufactured having specifically designed elements associated with those regions of the foot that are primarily involved in receiving and carrying the load associated with foot impact during all varieties of sports and non-sport activities. These elements are designed to provide damping and energy dissipation through deformation directly at or near the contact zones where the shoe comes in direct/physical contact with a ground surface.

These elements are specifically designed to deform three dimensionally. The elements, therefore, deform both vertically (i.e., compress perpendicular to the ground surface toward the foot) and horizontally (i.e., shear or deform in a plane parallel to the ground surface). In this way, these elements dissipate the energy of foot impact and simultaneously reduce force transference in these three directions and reduce overall stress and strain on a wearer's feet, ankles, knees, back and joints.

Additionally, by changing the shape and materials used in the elements, the resistance to deformation in three directions can be adjusted to produce elements that have the ability to deform substantially in all three directions simultaneously, to elements that distort or deform primarily only horizontally or vertically and finally to elements that deform primarily only in one direction.

The ground contacting systems of the present invention include elements having chambers where the chambers are designed to allow the elements to respond to an applied force three dimensionally. The 3D response of these elements is measured along three mutually orthogonal axes. As stated previously, one axis is perpendicular to the sole, i.e., vertical or Z-axis, with its zero associated with an undersurface of an outsole. Each chamber of each element has a given height measured along this vertical axis that is at its maximum when the element is unloaded. Therefore, the amount of vertical deformation is simply a value calculated by subtracting a loaded vertical height from a unloaded vertical height. The other two axes (X and Y) are in a plane perpendicular to the vertical axis. The longitudinal or X axis has its zero at the heel and extends in a positive direction to a toe. The Y axis or traverse axis has its zero at a longitudinal center line located about in a center of the sole with its positive direction extending to a lateral side of the sole and its negative direction extending to a medial side of the sole.

Generally, the vertical deformation of the chambers associated with the elements of the present invention is logarithmically related to the magnitude of the applied force when force is on the x-axis and deformation is on the y-axis. The 3D deformation elements of the present invention generally show substantially greater vertical deformation at relatively low forces than do traditional rubber-EVA mid-out sole construction. At forces between about 100N to about 1000N, the present elements have vertical deformation about 50% higher that the traditional rubber-EVA constructions. As the vertical force increases, the 3D elements and the traditional rubber-EVA constructions begin to show less and less difference so that the 3D elements do not become unstable at high force. These 3D elements can be designed to maximize deformation at forces generally encountered in most human athletic endeavors with the possible exception of a high leap in basketball.

The total horizontal displacement (square root of the sum of the squares of the vectorial horizontal axial deformation) for the 3D elements in response to a given magnitude horizontal force at a given vertical loading will be such that a minimum total horizontal deflection is attained, which is explained more fully herein.

The elements and their associated chambers are designed to deform, distort and/or deflect three dimensionally to better responsd to and reduce force transference of the forces associated with foot impact and to convert a portion of the energy of foot impact to thermal energy which is dissipated in the element. These elements and the chambers associated therewith reduce peak force transference by their ability to undergo free (i.e., unconstrained) distortion/deformation along all three axes simultaneously for forces between about 100 N and about 8,000 N (i.e., force generally associated with human movements during all types of activities).

The ground contacting systems of this invention preferably include at least one element capable of undergoing unconstrained distortion in three independent directions in response to an applied force. The ground contacting systems of this invention are designed to have these distortion elements associated with regions of the sole that carry a major part of the overall load associated with foot impact and standing.

Of course, the 3D deformation characteristics of the heel element(s) can be the same or different from the 3D deformation characteristics of the forefoot element(s), and, preferably the heel element has different deformation characteristics from the characteristics of the forefoot element. The preferred heel elements for running generally should have a significant damping or shock absorbing characteristic, i.e., the element undergoes significant vertical deformation. Additionally, the heel elements should also undergo significant horizontal deformation. Thus, the preferred heel elements are designed to have considerable ability to distort vertically and horizontally.

The ability of the heel elements to deform both vertically and horizontally is thought to significantly reduce the peak force of foot fall that is transmitted to the wearer's heel and associated load bearing bone, tendon, ligament, and muscle structure, and to reduce lever arm and stress and strain on the wearer's joints. The overall deformation of the heel elements is also designed to provide a substantially constant contact surface during foot fall. Such heel elements are generally gas filled or filled with a substance that will allow the element to act like an air spring where the springiness is provided by the compression of the filling fluid such as a gas and the elasticity of the rubber.

The preferred forefoot elements on the other hand are designed to transmit more of the feel of the ground to the foot, i.e., the forefoot elements should not have as much vertical deformation as the heel elements and preferably have greater horizontal deformation than vertical deformation. The horizontal deformation which is thought to increase energy dissipation in the horizontal directions and reduce maximum forces is generally due to filling all or a part of the chamber(s) associated with the elements with a highly damping viscoelastic material such as butyl rubber, oil extended elastomers, interpenetrating networks such as the material described in European Patent Application Ser. No. 94118155.4, Publication No. 0 653 464 A2 assigned to Bridgestone Corporation, incorporated herein by reference, and other highly damping (high hysteric loss) materials.

This type of element, which can of course be associated with any part of the sole, generally includes an outer wear resistant and traction tread surface that covers the entire ground contacting surface of the element. These elements further include a continuous sidewall and the interior is filled with the above referenced viscoelastic materials that are generally cured to the tread cap and the sidewall.

Additionally, the filled interiors generally have grooves and channels that segment the viscoelastic material filling the chamber into members that can deform horizontally and vertically independent of other members, i.e., the grooves and channels are of sufficient width to allow the members and the element to undergo a significant amount of horizontal deformation without having the members contact each other. The grooves and channels extend from the top surface of the member about half to three quarters of the height of the element, excluding profiling; however, the grooves generally do not extend all the way to the rubber cover surrounding the element. Preferably, the grooves are between about half to about ⅗ the height of the element excluding profiling. The elements generally are between about 5 mm to about 15 mm or more in height excluding profiling, which can extend above the base surface of the tread surface an additional amount of between about 1 mm to 4 mm or more, preferably about 2 mm to about 3 mm.

The cover is generally cured to a continuous member of the viscoelastic material that has a thickness of about 1 mm to about 6 mm or more. Of course, the cover may also include a separate tread cap with or without tread profiling where the tread cap can be between about 1 mm and about 5 mm or more thick. The interior members are generally joined to the sidewall member by tabs and to each other by a center tabs that meet in a center region of the interior of the element. The top surface of the element includes the tops of the sidewall, the top of the sidewall member and the tops of the interior members. Additionally, the element can include a lip that extends above the top surface. This lip is designed to wrap up and attachably engage to a side portion of the sole and potentially the upper.

As stated above, the distortion elements or energy dissipation elements have to be associated into the sole design in such a way that the elements are free to undergo 3D distortion. This design feature can be accomplished in a variety of ways. One way is to ensure that each distortion element or chamber within the ground contacting systems is sufficiently removed from the other elements or other features of the shoe so that it can undergo relatively free distortion along all three of the axes defined above.

A second way is to arrange the chambers or elements so that as one element or chamber distorts, it is designed to contact at least one other chamber or element after a given amount of distortion to change the amount and characteristics of the distortion the element or chamber can undergo. Third, the element or chamber can be arranged such that upon a given amount of distortion in any given direction, the distortion is inhibited from further distortion by contact with at least one rigid element.

One embodiment of the ground contacting systems of the present invention includes at least one heel element having a top and a bottom. The top has a substantially flat upper surface designed to attachably engage a heel portion of an under surface of a sole. The bottom includes at least one chamber designed to hold a gas, a fluid, a viscoelastic material, a viscous material, or a mixture thereof. Preferably, the heel element is in the general shape of a half-dome or half-ellipse and the element follows the basic heel contour of the shoe. The chamber can include at least one indentation or slot in a back portion of the chamber designed to increase structural stability of the element.

One preferred embodiment of this type of heel element includes a bottom having at least two chambers. The first chamber is associated with a back portion of the element and is of a general half-domed shape and has an outer edge which is designed to follow the contour of the heel region of the sole. The first chamber preferably has at least one indentation or slot associated therewith as described above and the front (toe-side) edge of the chamber is substantially straight.

The second chamber is preferably situated in front (i.e., toward a toe section of the sole) of the first chamber and is elongate with its back edge substantially parallel, but displaced an amount from the front edge of the first chamber. The amount of displacement or gap between the chambers is sufficient to allow the chambers to deflect without causing contact between the chambers during deflection induced by an applied force acting on the elements.

In a particularly preferred embodiment, the bottom includes at least three chambers. The first element is substantially the same as the first chamber of the preferred embodiment described above. The second and third chambers can simply be a partitioning of the second chamber of the preferred embodiment so that the partition fully divides the chamber to generate two smaller elongate chambers. Again, these two chamber are preferably situated in front of the first element with their back edges substantially parallel to the front edge of the first element and where the distance between each chamber is preferably sufficient to allow each chamber to response separately to an applied force.

Each chamber defined above includes an interior, a continuous side wall and a ground contacting or tread surface. One preferred design of the first chamber described above, has a sloped side wall extending from a back edge of the heel element in a convex fashion, transitioning smoothly into a tread surface culminating in an apex ridge near or associated with the front edge of the chamber. The apex ridge in turn has a generally elongated convex shape in its traverse direction with curved end portions which form part of the side wall and that transition into the bottom of the heel element. The apex ridge also has a substantially flat top profile between the two curved end portions. The substantially flat top profile of the apex ridge is also associated with a substantially flat top region of the tread surface of the chamber. The convex sloped part of the side wall and the flat top region of the tread surface are design to assume a substantially flat enlarged contact region under load, i.e., a part of the side wall participates in ground contact, which helps to maintain a more or less constant contact profile.

The second and/or third chambers also have an interior, a continuous side wall, and a tread surface. These chambers are elongate, i.e., their length greater than their width. The chambers are generally sloped at their ends. In the case of a single chamber, the ends slope convexedly to the bottom (i.e., convex side walls), while the tread surface is substantially flat, but preferentially rounds into the side wall along its front and back edges. In the case of two chambers, one end of each chamber has a convex side wall portion transitioning into the bottom near the bottom's outside edge, while the other end rounds into a more vertical portion of the side wall extending to a gap in the bottom between the second and third chamber.

Additionally, an inner surface of the interior of the chambers, and especially, the first chamber can include a plurality of reinforcing members such as ribs running either front to back, side to side, criss-crossed or a combination of such members. A bottom surface of the interior of the chamber can also have associated therewith, a run-flat device. The run-flat device can be any means for maintaining the essential element profile, if a fluid filled element has been damaged so as to have lost fluid confinement. Such devices can include relatively rigid ridges, fingers, platforms or other members associated with the bottom surface of the interior, of the chambers extending from the bottom surface a sufficient height to afford run-flat characteristics so that the contacts profile of the element, although reduced in vertical extent under load, is similar to the contact profile of an undamaged chamber.

Additionally, the tread surface and side wall can be made of different resilient materials. The side wall is preferably constructed out of a resilient material with substantially flex fatigue resistance and enhanced oxygen and ozone tolerance. Such rubber compounds are generally prepared from elastomers such as natural rubber, butadiene rubber, SBR rubbers, EPDM rubbers and butyl/isoprene rubbers filled with N-660 or N-550 carbon blocks, clays and using standard (normal or variable) sulfuir vulcanization cures system. The tread surface, on the other hand, is preferably constructed out of a high traction, high wear resistance compound, an all purpose tire tread compound, or mixtures thereof. Such rubber compounds are generally repaired from elastomers such as natural rubber, butadiene rubbers, and SBR rubbers. Additionally, the tread surface can be made of different rubber compounds depending on the type of road and weather conditions the wearer anticipates encountering. For low temperature use, the tread compound should be made of a major amount of low $T_g$ elastomers such as high cis 1,4-polybutadiene and the like. While for hot weather use, the tread can be made of higher $T_g$ elastomers such as SBR (styrene-butadiene rubber), SI (styrene-isoprene rubber), natural rubber, and the like.

The entire heel element can be attached to the outsole so that the front edge of the element is substantially parallel to the traverse axis described above. Preferably, the heel element is attached to the sole in an angled configuration with respect to the center longitudinal line so that the angle between the front of the element and the center line on the lateral side is less than the angle between the front of the element and the center line on the medial side.

Furthermore, the chamber can have a web, fabric or fiber reinforced carcass, where the fabric or fiber can be a PET web, fabric or fiber, an amide or imide web, fabric or fiber, or other web, fabric or fiber or mixtures thereof The ground contacting surface of the chamber can also be a multilayered structure including an inner liner associated with the inner surface of the chamber, a base or carcass layer contiguous with the side wall, a belt top and bottom layer with a belt or belt package therebetween, and a tread cap positioned on the top belt layer. The chamber can also have an apex for transitioning from the tread cap to the side wall.

The belt layers are made of specially designed elastomeric compounds for effectuating adequate adhesion between the belt material and the elastomeric compound. The belts can be made of a surface treated steel, an amide or imide fibers, nylon or rayon fibers, graphite or other carboneous fibers, boron nitride fibers, or similar fibers or mixtures thereof. The surface treatment of the steel can be brass, bronze, zinc-copper alloys, nickel-copper alloys, zinc, nickel, nickel undercoat/copper topcoat, cobalt containing nickel-copper or zinc-copper alloys, tin, tin alloys or similar metal coating or mixtures thereof, where the surface treatments are designed to adhesively and/or cohesively interact with the elastomeric compound as is well known in the art of sulfur vulcanization.

Another preferred embodiment of a heel element of the present invention includes a top for attachment to an underside of an outsole and a bottom having associated therewith at least one chamber. Each chamber includes an interior, a continuous side wall and a ground contacting or tread surface. The element is generally U-shaped where the top of the U includes a protrusion where a central chamber extends, but preferably tapers inwardly at a top of the U. The chamber(s) generally occupies a majority of the surface area of the element and extends from the bottom downward by an amount between about ¼" and about ¾" with an amount between about ⅜" and about ⅝" being preferred.

The U-shaped element preferably has at least one chamber that follows an outer contour of the element which in turn follows the contour of the sole and preferably at least two chambers and particularly three or four chambers that follow the outer contour of the element. When three or more chambers that follow the outer contour, then at least one of these chamber will follow the curved back portion of the U-shaped element, while two less curved chambers will follow the front portions of the element along a lateral and medial side, thereof.

The U-shaped element also has at least one chamber and preferably two chambers associated with a central region of the bottom of the element contained within the chambers associated with the outer contour of the element. In the case of a single central chamber, the chamber has a more or less triangular shape similar to the contour of the element itself and covers substantially all of the central region of the bottom of the element. In the case of two central chambers, the front most chamber is shaped like a chopped off triangle, while the back chamber is somewhat oval shaped.

All of the chambers are positioned so that each chamber can respond separately to an applied force without contact between the side walls of neighboring chambers during deformation in response to applied forces. All of the chambers can be contoured the same or different. Preferably, the back chambers are more rounded on a back portion of the side wall and more vertical on a front portion of the side wall so that the tread surface is ridge-shape; while the medial and lateral front chambers are more symmetrically rounded so that the tread surface is generally dome-shaped. The central element(s) has substantially flat tread surfaces associated therewith.

An alternate structure for the two heel elements described above is to remove the top so that the chambers themselves are open at the top. The edge of the element includes a stiff bead member, such as a wire bead used in tire rims or a stiff lip that is designed to detachably engage a retaining groove in the underside of the sole. The bead or lip and the groove are designed to form a seal which is capable of containing a gas, a liquid, a fluid, a viscous material, a viscoelastic material, or a mixture thereof. Optionally, the sole can have associated therewith a means for inflating the chambers defined by the element and the undersurface of the sole.

Of course, the sole would have to have indents matable with the outline of the individual chambers associated with the elements so that each chamber would not be in fluid communication with the other chambers. Additionally, the heel element could be adhesively or otherwise attached and/or bonded to the sole; provided, however, that the chambers are separated and sealed. One of ordinary skill in the art should recognize that any other means for matably engaging the elements to the outsole could be used as well, such as clip rings, adhesive bonding, thermal setting, thermal curing, radiation curing, stitching, riveting, and the like.

Alternatively, each chamber could have associated therewith an insert designed to occupy substantially the entire interior volume of the chamber when the chamber attached to the undersole and sealed. The inserts could be gas filled bags, fluid filled bags, resilient/viscoelastic members, or similar inserts or mixtures thereof, where the inserts are designed to enhance and/or modify the natural damping and/or deformation/deflection/distortion characteristics of the elements and their associated chambers. These inserts can be either detachably associated with the chambers or bonded, cured or otherwise intimately associated with the chambers. The use of inserts can avoid the difficulties associated with inflation of the chambers.

The above described elements are all elements designed parallel to the ground and do not include portions of the element or chambers associated therewith that wrap up above the underside of the sole and extend an amount above the upper surface or side of the sole. These latter wrap-up elements are preferably associated with the forefoot regions of the shoe, but can also be associated with other regions of the shoe such as the heel or toe. The wrap-up elements include a top for attachably engaging the underside of the sole, a side portion of the sole and optionally a part of the upper. The wrap-up elements also include a bottom having associated therewith at least one chamber. The chamber includes an interior, a continuous side wall, and a ground contacting or tread surface. Again the interior region can be filled with any of the materials mentioned above.

Alternatively, the element can include only a bottom and can include inserts designed to occupy substantially the entire volume of the chamber once sealed and where the inserts are filled with any one of the materials previously mentioned. The chamber(s) associated with the wrapped up portion of the wrap-up elements are designed to inhibit rollover and enhance stability while providing cushioning and deflecting actions when foot impact causes the ground to contact the wrapped up portion of these wrap-up elements.

The elements can also have structure associated therewith and can be designed with deformation chambers arranged to facilitate deformation isotopically or anisotropically, i.e., the deformation chambers are arranged such that the element has the same deformation to an applied force regardless of the direction of the force (isotropic response) or the deformation chambers are arranged such that the element deforms differently depending on the direction of the applied force (anisotropic response).

Additionally, the tread surface of any of the elements can include profiling or ground contacting members such as lugs, raised arcs or circles, ripples, ridges, or the like to augment the nature of the ground to element contact zone or to provide anti-slip character to the ground contacting surfaces.

Along with the elements of the present invention, the ground contacting system can include barriers to impede the transmission of heat from the ground contacting system through the sole into the upper and the wearer's foot. Such barriers can include so-called radiant barriers either attached to or incorporated into the sole on its under or top surfaces. The barriers can also incorporate a sole which allows air from the ambient surroundings to either directly flow though it such as through channels in the sole or the sole can be made of a gas permeable material.

Additionally, the elements of the present invention can be made with clear or translucent side walls, tread caps or the entire element can be clear. Such clear elements or element portions can be dyed or colored in any desired way. Additionally, the clear elements can have colored inserts or can be filled with a colored fluid. The elements can also have surface treated sidewalls or bottoms where the surface treating changes color with either applied force, temperature, humidity levels, water or the like.

The rubber compositions used to make the elements of this invention can also include elastomers and rubber compounds that are sensitive to the ground condition and are designed to improve traction in wet and dry conditions. Such rubber compounds generally include elastomers that have a certain critical number of hydrophilic groups integrated into the elastomer back-bone. Because the elastomer is generally hydrophobic, on dry surfaces, the hydrophilic groups will be turned inside away from the round surface, while on wet surfaces the hydrophilic groups turn outside and improve interaction between the wet surface and the rubber compound.

As stated previously, the tread surface can be profiled or can include various elements to modify the contact zone of the elements with the ground surfaces. The profiling can also be designed to help wet traction by including channels or grooves in the surface that act to pump water away from the contact zone during normal foot impact, loading, and push off. These groove and channels can be designed in analogy to the tire tread patterns that include such features as channels such as the Goodyear AquaTread™.

The ground contacting systems of the present invention are designed to allow for greater dissipation of the energy associated with foot impact and to allow for reduced forces and moments on the wearer's body parts involved in ground contacting. The ground contacting system of this invention has the capability of deforming simultaneously in three mutually orthogonal directions at or near the contact surfaces of the ground with the ground contacting surface of this invention. The extent and nature of the deformation and the resistance to deformation in the three orthogonal directions can be tailored by the shape of the elements within the ground contacting system and by the materials used to make the ground contacting elements. If the elements of the ground contacting system are filled with a compressible fluid like a gas or a compressible liquid, then the elements behave somewhat like a tire and somewhat like an air bag. The tire like behavior relates to the way in which the elements come in contact with a surface, while the air bag behavior relates to the fact that the compressible fluid is compressed at foot fall and decompressed when the foot is raised. When the fluid is decompressed, the element springs back to its original form.

The basic properties that these fluid filled elements must possess for effective reduction in force transference and energy dissipation and ground contacting engagement require the ground contacting surfaces to be made of rubber compounds that have good wear resistance and good traction. Such compounds will generally be similar to the compounds used in the tire industry for tire treads. These compounds can be selected to have very good traction or very good wear resistance or a trade off between these two extremes. The trade off comes about because tract and tread wear are properties that are opposed. Thus, improving tread wear will generally adversely affect traction, and visa-versa.

The 3D deformation elements of the present invention can be associated with all load bearing areas of the shoe or with only one load bearing area of the shoe. Moreover, the 3D elements can be associated with any part of the load bearing areas of the shoe. For running and walking, the ground-contacting system of the present invention is generally associated with only a part of the heel area of the sole and with parts of the forefoot area of the sole. While for court sports such as tennis, basketball and the like, the ground-contacting system of the present invention typical covers the entire heel area in 3D deformation elements and a large part of the forefoot area and well as including various wrap-up 3D deformation chambers or elements to cushion the foot from side impacts and to reduce rollover tendancies of the shoe.

The present invention also includes shoes and soles that include a ground contacting system having one or any combination of each of the elements and chambers described above.

Ground Contacting Systems Including No Wrap-Up Elements

Figure 1A:
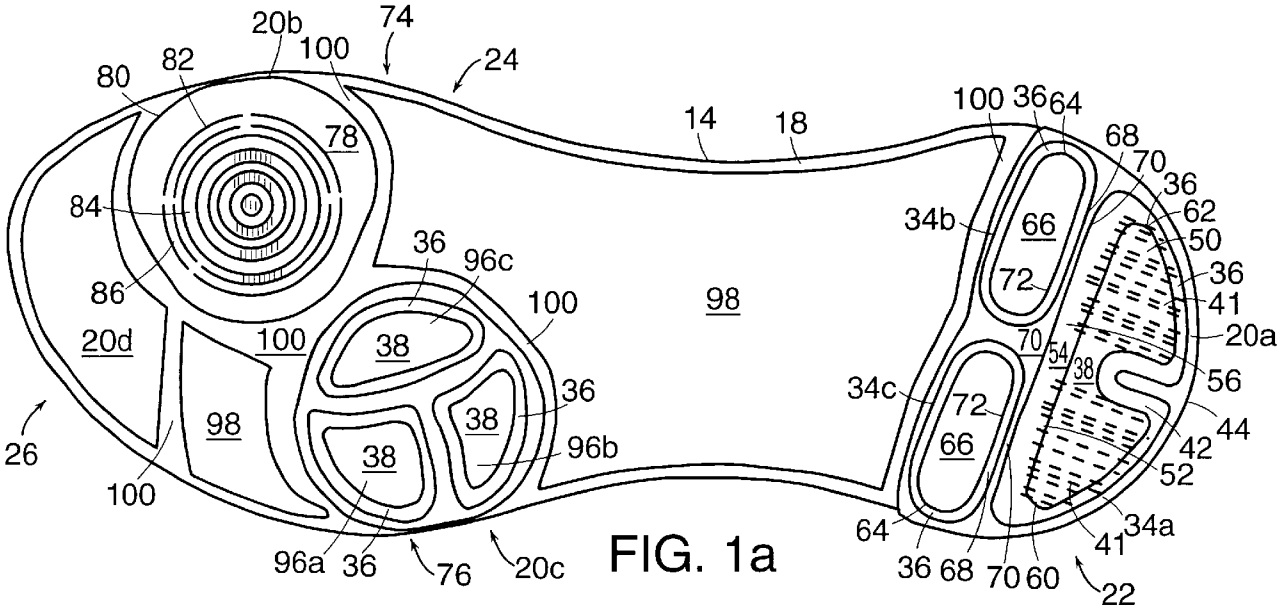
FIG. 1 a is a bottom view of a shoe including one embodiment of a ground-contacting system of the present invention including a set of 3D deformation elements associated with an undersurface of the sole.
FIG. 1*b* is a side plan view of the sole of FIG. 1*a;*
FIG. 1*c* is a top plan view of the medial element of FIG. 1*a;*
Figure 1B:
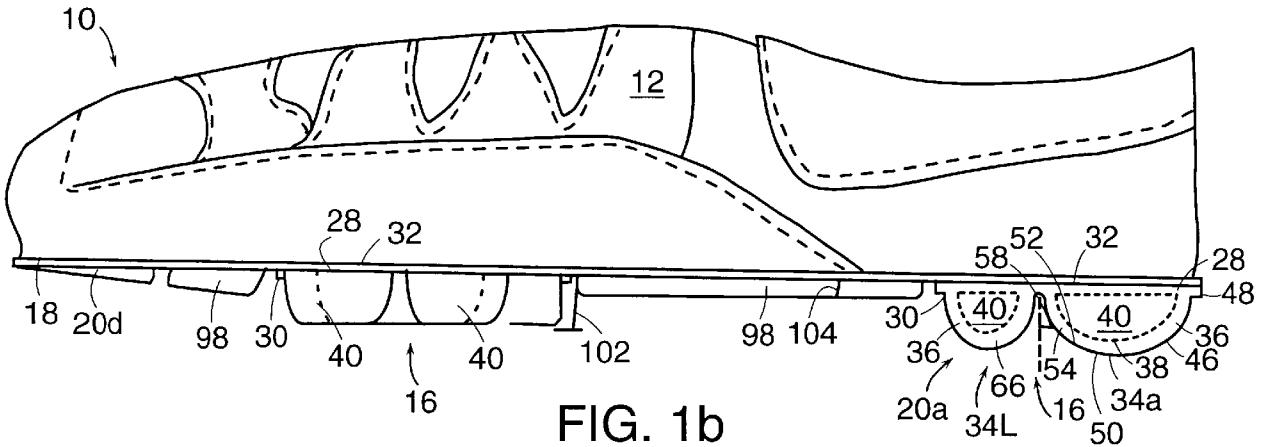
Figure 1C:
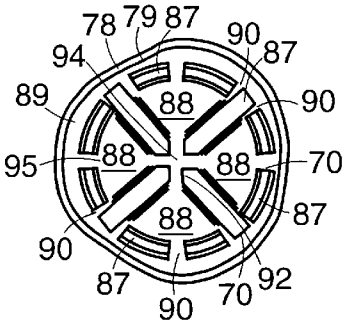

Referring now to FIGS. 1*a–c*, one embodiment of a shoe 10 of the present invention can be seen to include an upper 12, a sole 14 and a ground contacting system 16 attached to an undersurface 18 of the sole 14. The ground contacting system 16 includes 3D deformation elements 20*a–c* associated with a heel region 22 and a forefoot region 24 of the sole 14, while a toe region 26 of the sole 14 can optionally have a 3D deformation element 20*d* associated therewith, which is generally an element with low vertical deformation and moderate or high horizontal deformation and is typically of a sandwich structure having a hard rubber tread surface, a soft middle, horizontal displacement layer, and a hard bottom layer, as described herein. The elements 20*a–c* are attached to the sole 14 so that these elements store and/or dissipate varying amounts of the energy associated with foot impact to reduce, modify or minimize force transference to a wearer's foot, legs, hip, back, and joints and allow for vertical and horizontal displacement of the tread contact zones relative to the sole or foot during foot impact.

As shown in FIGS. 1*a–c*, the 3D elements 20 of the present invention include a top 28 and a bottom 30. The top 28 has a substantially flat top surface 32 designed to attachably engage the underside surface 18 of the sole 14. The bottom 30 of heel element 20*a* includes three chambers 34*a*, 34*b*, 34*c* designed to hold a gas, a fluid, a viscous material, a viscoelastic material, a cured elastomeric material, or a mixture thereof The chambers 34*a*, 34*b*, 34*c* include a continuous sidewall 36, a tread or ground contacting surface 38, and an interior 40 having re-inforcement ribs 41 shown in phantom. The chamber 34*a* is half-elliptically or semi-circular shaped optionally having one or more stress modification indentations 42 associated with a back edge region 44 thereof The chamber 34 a rises in a convex curved region 46 from a heel edge 48 gradually to a flattened top region 50 which comprises a part of the ground contacting surface 38 of the chamber 34*a*. The top region 50 terminates in a ridge 52 which transitions into a substantially straight part 54 of the sidewall 36. The straight part 54 of the sidewall 36 forms a surface 56 angled from the vertical by an angle 58. The angle 58 is generally less than 45°, but is preferably between about 0° and 30° and particularly between about 5° and 30°. Additionally, the ridge 52 transitions smoothly into the sidewall 36 at its lateral and medial ends 60,62. The convex curved region 46 of element 34*a* flattens out under load to form a second part of the ground contacting surface 38, while the remainder of the curved region 46 forms part of the continuous sidewall 36. Alternatively, the angle between any two adjacent sidewalls in any element should be between about 0° and 120° with angles between about 0° and about 90° being preferred.

The element 20*a* also includes chambers 34*b* and 34*c*, which are of a generally oval shape with ends 64 having a length about one to about five times their width. The chambers 34*b* and 34*c* have a generally rounded ground contacting surface 66, which smoothly transitions into their continuous sidewalls 36. A heel side 68 of each of the chambers 34*b* and 34*c* are substantially parallel to the straight part 54 of chamber 34*a*. The chambers 34*a*, 34*b*, and 34*c* are generally separated from each other by a gap 70 sufficient to allow each chamber to distort substantially free of interference from an adjacent chamber under load. However, the chambers can be arranged so that the sidewalls of the chambers contact each other to a small extent under load or so that the sidewall of each chamber is designed to contact one or more adjacent chamber sidewalls under load or any combination of such arrangements. The heel element 20*a* is designed so that chambers 34*a*, 34*b*, and 34*c* do not come into significant contact with each other under load where significant contact would refer to a situation where more than 25% of the area of each sidewall 36 was in direct (physical) contact with an adjacent sidewall, e.g., under load, less than 25% of the surface 56 of the chamber 34*a* is in contact (directly physical contact) with a heel side portion 72 of sidewall 36 of either chamber 34*b* or 34*c* and preferably less than about 10% and especially where the gap 70 does not allow the chamber sidewalls to contact at all.

The sidewall 36 and the ground contacting surfaces 38 and 66 of the chambers 34*a* and 34*b*, 34*c*, respectively, can be made out of the same material as would generally be true if the element 20*a* is manufactured by blow molding or injection molding. However, the element 20*a* could also have considerably more structure including a separately designed tread cap with a ground contact surface which can be profiled, a fabric or fiber reinforced sidewall, transition members from the tread cap to the sidewall and a belt package, etc as will be desired in more detail herein.

The elements 20*b* and 20*c* of the ground contacting system 16 of FIGS. 1*a–c* are associated with a medial side 74 and a lateral side 76 of the forefoot region 24 of the sole 14 and are somewhat circular as compared to the semi-circle element 20*a*. The element 20*b* associated with the medial side 74 of the forefoot region 24 is an internally structured element type having an outer rubber cover or skin 78 that makes up an outer surface 80 of the entire element 20*b* and a surface profiling 82 associated with the tread/ground contact surface 38 thereof As shown in FIG. 1*a*, the profiling 82 comprises raised concentric circles 84 and circular arcs 86.

The interior 40 of element 20*b* includes a plurality of interior members 88 of generally triangular shape as shown in FIG. 1*c* and an interior member 89 that follows the contour of an interior surface 79 of the skin 78. The members 88 can be optionally connected to the member 89 by a plurality of tabs 90. Additionally, the members 88 can all be joined together at a central area 92 of the interior 40 at an X 94. The members 88 of this type of internally structured 3D deformation element are preferably filled either with a cured or uncured viscoelastic material with a cured viscoelastic material being preferred. The top 28 of the element 20*b* includes tops 95 of the members 88 and 89 and the cover 78, that attachably engage the undersurface 18 of the sole 14. The members 88 are separated by grooves 87 that separate the elements 88 and 89 from each other by a gap 70 sufficient to allow the members to distort or deform independently.

The members of these internally structured elements are filled with a viscoelastic material preferably having high damping characteristics which are found in relative soft rubber compounds, such as compounds used in race tire tread formulation, compounds containing butyl rubber, highly oil filled vulcanized rubber matrices, or interpenetrating networks made of a traditional vulcanizable elastomer and a non-vulcanizable material such as a low molecular weight additive or a high molecular weight additives. Generally, the low molecular weight additives are traditional reagents such as extender oils or non-vulcanizable oligomers such as siloxanes, butyl rubber, hydrogenated diene oligomers or the like. Additionally, materials using an oil extended elastomer and a non-oil extended elastomer can be used with the two elastomeric phases being cured to different extent. Of course, the member 88 can also be filled with a gas, a fluid, a foam or a mixture of a gas, a fluid, a foam, and/or a viscoelastic material, cured or uncured. The grooves 87 are filled with a compressible material, preferably air or another gas.

The element 20*c* associated with the lateral side 76 of the forefoot region 24 includes three chambers 96*a*, 96*b*, and 96*c*. The lateral two chambers 96*a–b* are of a rounded triangular shape, while the chamber 96*c* is of a general football shape. The three chambers 96*a–c* are designed to give the element 20*c* substantially an isotropic response to an applied force irrespective of the direction of the applied force in a manner similar to the response one would obtain in the case of element 20*b* above. Of course, for a purely isotropic response, the elements 20*b* and 20*c* should be circular in shape with substantially equivalent chambers located in a symmetrical pattern within the circle, e.g., three substantially equivalent chambers located substantially within the three 120° sectors of the circle or four substantially equivalent chambers located within the four 90° sectors of the circle. Of course, all three of the elements 20*a*, 20*b*, and 20*c* could be similar element types arranged to reduce, modify or minimize force transference to the wearer's foot and to increase, modify or maximize the dissipation of energy associated with foot impact. Of course, it is important in the forefoot region to ensure that more of the feel of the ground be transmitted to the wearer's foot so that the forefoot receives adequate information to adjust to the ground surface.

One of the unique features of the 3D deformation elements of the present invention is that the elements can dissipate the energy associated with foot impact by distorting in three independent directions as described above. The ability for these elements to distort, deflect, or deform in directions parallel to the ground surface as well as deforming vertically, greatly increase the ability of the shoes and soles of the present invention to decrease foot impact strain on the wearer. Additionally, the deformation of the elements in directions parallel to the ground surface or to ground contacting zones (the actual ground engaging surfaces) decreases the stress and strain placed on the wearer's ankles and knees by, it is believed, decreasing the pivot angle between the ground contract surfaces and the wearer's leg. The differences between the traditional element behavior under deformation and the elements of the present invention are explored more fully in the experimental section of this application.

The shoe 10 of FIGS. 1*a–c* can also include support members 98. Preferably, the support members 98 are positioned so that they do not significantly inhibit the distortion of the various chambers associated with the elements of the ground contacting system of the present invention. Generally, this means that there will be an element-support gap 100 between the support members 98 and the elements 20*a–c* of the ground contacting system 16.

The element-support gap 100 is generally several millimeters to tens of millimeters in width. However, if the chambers associated with the 3D deformation elements extend from the undersurface 18 of sole 14 to a height 102 sufficiently greater than a height 104 of the support members 98, then the gap 100 can be essentially zero. However, if the height 102 of the chambers of the elements 20 is only slightly larger than the height 104 of the support member (i.e., the height 102 is less than about 15% greater than the height 104), then the element-support gap 100 can be designed to allow complete freedom of the elements 20 to distort under load without having the sidewalls 36 of the chambers associated with the elements 20 coming in direct contact with the support members 98. Alternately, the element-support gap 100 can be of a lesser extent so that the distortion/deformation of the chambers associated with the elements become constrained after any given amount of distortion. Preferably, the element-support gap 100 should be of an amount sufficient to allow the elements or the chamber associated therewith to distort at least 50% of the distortion the element or chamber would undergo in a completely free condition. But, the gap 100 can be adjusted to change the deformation characteristics of any part of a elements or chamber so that the 3D deformation characteristics of the element or chamber can be tuned by placement of support member 98 and the control of the gap 100.

Figure 2B:
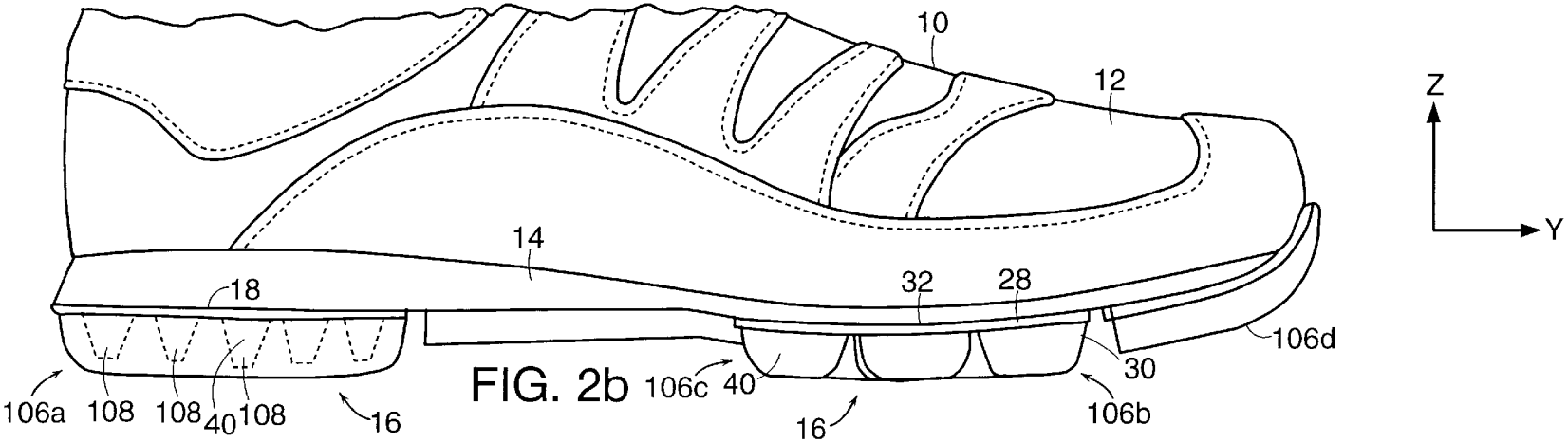
FIG. 2*b* is a side plan view of the sole of FIG. 2*a;*
Figure 2A:
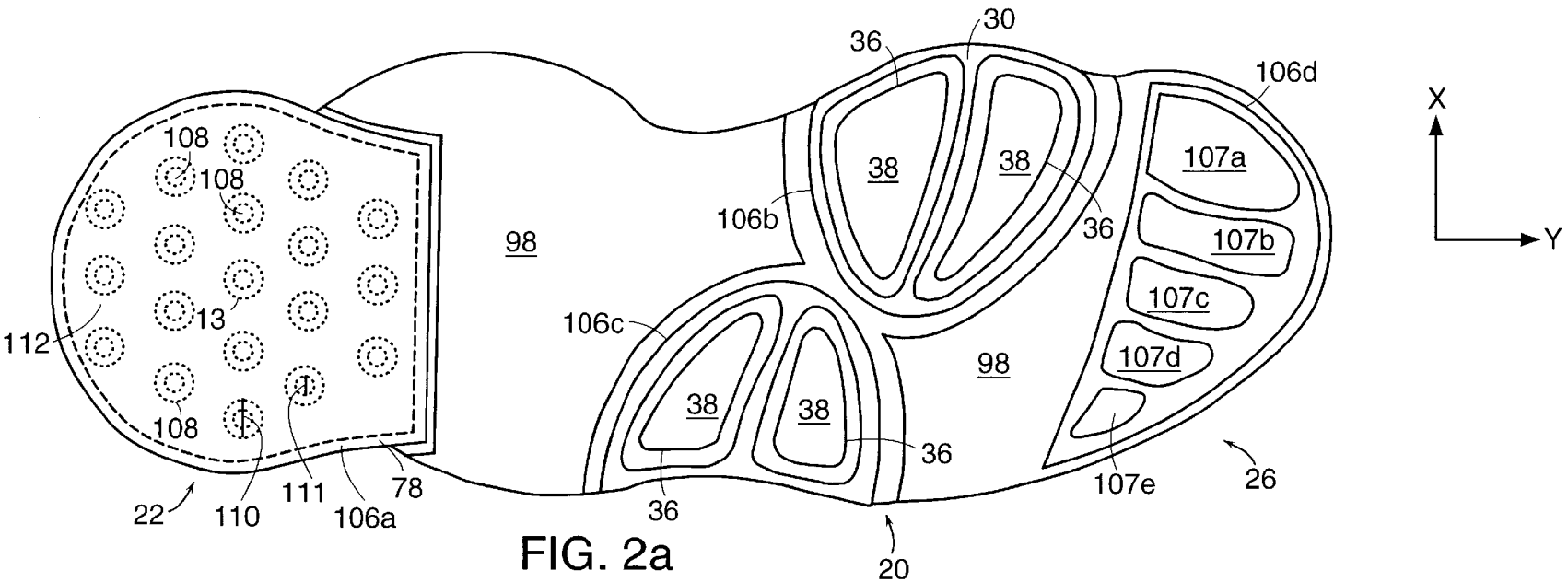
FIG. 2*a* is a bottom view of a shoe including a second embodiment of a ground-contacting system of the present invention including a set of 3D deformation elements associated with an undersurface of the sole.

FIGS. 2*a* and *b* show another shoe 10 of the present invention having an upper 12, a sole 14 and a ground contacting system 16 associated with an undersurface 18 of the sole 14. The ground contacting system 16 of FIGS. 2*a–b* includes elements 106*a–d*, again associated with the heel region 22, the forefoot region 24, and optionally the toe region 26 of the sole 14. The elements 106*a–c* are attached to the sole 14 so that these elements reduce, modify, or minimize transfer of force to the wearer's foot and increase, modify or maximize the dissipation of energy associated with foot impact to the wearer's foot. The element 106*d*, which is optional, is designed to modify, enhance, or augment the "push off" characteristics of the shoe 10 and is shown here as comprising toe contact members 107*a–e*, which are generally of a layered design having a rubber contacting surface, a soft middle material that allows substantial horizontal deformation, and a hard bottom layer as described herein.

The heel element 106*a* in another example of an internally structured 3D deformation element of the present invention having a generally solid U shape. The element 106*a* has a ground contacting cover 78 made of a wear resistant rubber composition such as a rubber compound used in tire treads and a plurality of interior conical chambers or cutouts 108 surrounded by filled region 109 of the interior 40 of the element 106*a*. The conical chambers 108 having a top diameter 110 of about 6 mm to about 12 mm and a bottom diameter 111 of about 4 mm to about 10 mm. The chambers 108 are generally separated by a gap 112 of about 4 mm to about 8 mm and are more or less symmetrically distributed throughout the entire interior 40 about a central region 113. Here, the chambers 108 are shown as a pattern having a central chamber surrounded by six chambers which are in turn surrounded by twelve outer chambers. However, any arrangement of chambers can be used with the shape of the chamber also being only a matter of convenience or manufacturing expediency. The number of chambers 108 is a function of the amount of vertical deformation desired, the weight of the element and the amount of horizontal deformation desired. The more chambers, the more hollow like and lighter the element will be and the more vertical compression, while the less chambers, the more filled like and heavier the chamber and the less vertical compression. The top 28 of this element is made up of top regions 114 of the filled regions 109 which attachably engage the undersurface 18 of the sole 14. Of course, the nature of the cutouts 108 is not critical and can be of any shape or a combination of shapes dictated only by manufacturing convenience.

The elements 106*b–c* associated with the forefoot region 24 of the sole 14 of FIGS. 2*a–b* are half oval shaped and include the top 28 having the substantially flat top surface 32 adapted to attachably engage the undersurface 18 of sole 14. The elements 106*b–c* also include the bottom 30 having two chambers 116 of a generally rounded triangular shape as viewed in FIG. 2*a*. Again the chambers 116 have a continuous sidewall 36, a tread surface 38 and an interior 40. The interior 40 can again be filled with a gas, a fluid, a foam, a cured or uncured viscoelastic material, a material that has a resistance to deformation that increases with applied force or a mixture thereof.

Looking now at FIGS. 3*a–e*, still another embodiment of a shoe 10 including a sole 14 and a ground contacting system 16 of this invention is shown. The ground contacting system 16 includes four 3D deformation elements 118*a–d*; the element 118*a* being associated with a heel region 22, the element 118*b* being associated with a forefoot region 24, the element 118*c* being associated with a medial lateral region 120 between the forefoot region 24 and the heel region 22 of the sole 14, and the element 118*d* being associated with the arch region 119 of the shoe as described herein.

The heel element 118*a* includes a top 28 having a substantially flat top surface 32 designed to attachably engage the undersurface 18 of sole 14 and a bottom 30 having six chambers 122*a–f* associated therewith. The chambers 122*a–d* follow an edge 124 of the generally closed U shape of element 118*a*. The chambers 122*a* and 122*d* are generally rounded on their toe-side ends 126 and angled at their heel-side ends 128 to define a frustoconical substantially planar area 130 at their heel-side ends 128.

The angled area 130 is angled away from the vertical by an angle that is generally between about 0° (i.e., the sidewall is vertical) to about 40° from the vertical. The remainder of the sidewall 36 generally rounds into a substantially flat tread/contact surface 38. Preferably, the sidewall 36 is substantially vertical along outer edges 134 of the chambers 122*a* and 122*d*; while the sidewall 36 has an angled planar surface 136 along inner edges 138 of the chambers 122*a* and 122*d*.

The chambers 122*b–c* are curved, cut doughnut shaped with ends 140 defining angled planar sidewall regions 142 where the planar regions 142 are angled away from the vertical as described for angle 132, above. The sidewalls 36 of the chambers 122*b–c* are rounded up to the tread surface 38 to a greater extent along outside edges 144 of the chambers 122*b–c* than along their inner edges 146. The chambers 122*b–c* have curved tread surfaces 38 that smoothly transition into the sidewall 36 along a toe-side 148 and a heel side 150 of the tread surface 38, while tread surface 38 rounds into the planar regions 142.

The chamber 122*e–f* are associated with a central region 152 of the element 118*a*. The chamber 122*c* is of a triangular shape having three edges 154*a–c*. The edges 154*a–b* are associated with a medial side 156 and a lateral side 158 of the chamber 122*e*. The edges 154*b–c* have sloped sidewall regions 160 of the side wall 36. The sidewall region 160 and the interior sidewall regions of elements 122*a* and 122*d* form an angle of about 50° to about 70° with an angle of about 60° preferred. The edges 154*a–b* transition into the edge 154*c* at their heel-side ends 162 to define cusped ridges 164 that form the ends 162 of the edge 154*c*. A sidewall region 166 extends from ridge to ridge in a generally shallow arc 168. The tread surface 38 of chamber 122*e* is generally flat.

The final chamber 122*f* is somewhat football shaped having a heel side curved sidewall portion 170 and a less curved toe-side sidewall portion 172. These two sidewall portions 170 and 172 meet in cusped ridges 174. The chamber 122*f* also has a substantially flat tread surface 38. Of course, all of the chambers 122*a–f* have interiors 44 that can be filled with the materials described above in conjunction with the other elements.

Figure 3A:
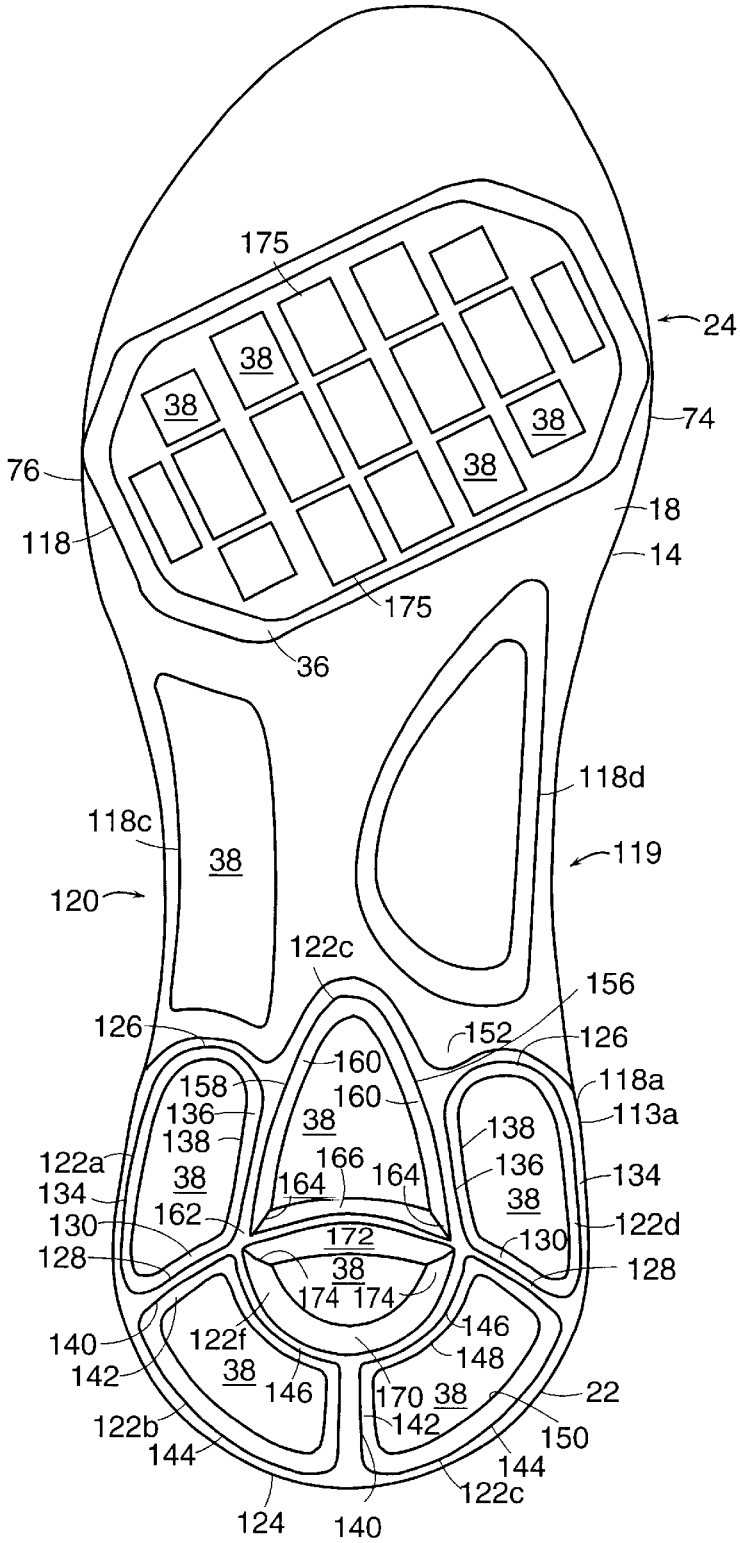
FIG. 3*a* is a bottom view of a shoe including another embodiment of a ground-contacting system of the present invention including a set of 3D deformation elements associated with an undersurface of the sole.
Figure 3B:
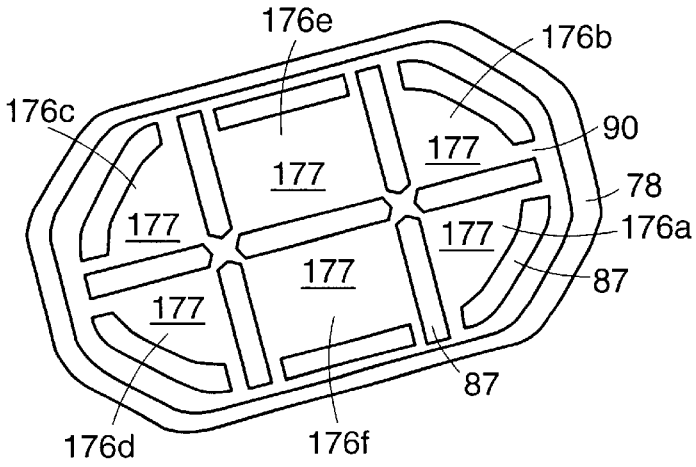
FIG. 3*b* is a top plan view of the forefoot element of FIG. 3*a;*
Figure 3C:
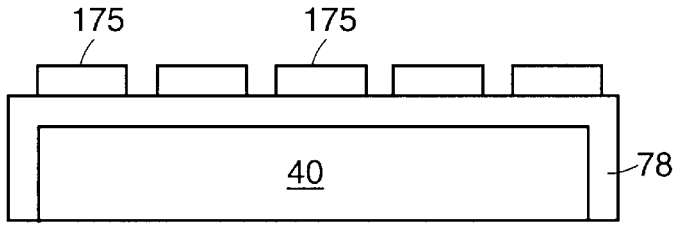
FIG. 3*c* is a cross-sectional view of the forefoot element of FIG. 3*a;*
Figure 3D:
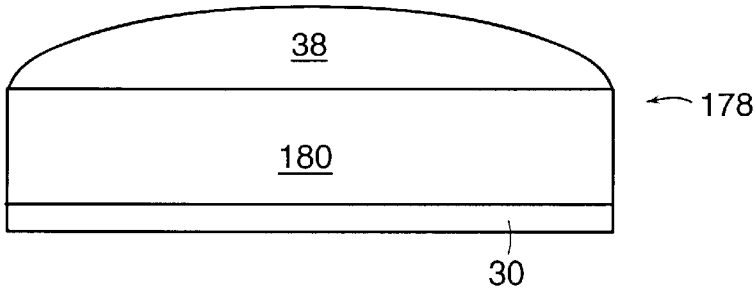
FIG. 3*d* is a cross-sectional view of the lateral element that extends from the forefoot element to the heel element of FIG. 3*a;*

The element 118*b* is of a generally rounded rectangular shaped internally structured element that extends across the forefoot region 24 of the sole 14 from its medial side 74 to its lateral side 76 as also shown in FIG. 3*c*. Thus, the element 118*b* can be seen to be more or less a combined element spanning the entire forefoot region. The element 118*b* includes six interior solid members 176*a–g* associated therewith having connecting tabs 90 and grooves 87 and a rubber cover 78. The members 176*a–d* are similar in structure to the chambers 88 of FIG. 1*b*; while the members 176*e–f* are substantially rectangular in shape. The member 176*g* follows the interior profile of the cover 78 and is similar to member 89 of element 20*b*. The top 28 comprising tops 177 of the member 176, which again is designed to attachably engage the undersurface 18 of sole 14. The element 118*b* also includes rectangular lug elements 175 as shown in FIGS. 3*a* and *c* where the top surfaces are ground-contacting surfaces 38.

Figure 3E:
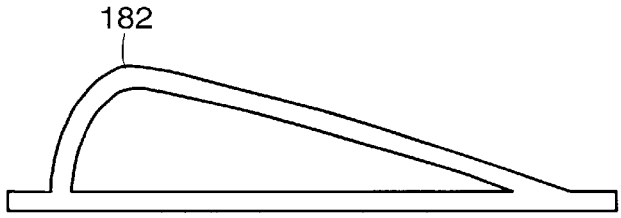
FIG. 3*e* is a cross-sectional view of the arch element of FIG. 3*a;*

The element 118*c* is of a generally elongate shape and is a horizontal deflection element including a single chamber 178, which has a relatively hard tread surface 38 and a relatively hard bottom 30 and a middle region 180 made out of a relative soft cured viscoelastic material. The sole 14 can also have an arch element 118*d*, which is shown as a crescent moon shape tapering to an apex ridge 182 toward an arch region 184 of the sole 14. The apex ridge 182 is arced as shown in FIG. 3*e*.

The elements of the present invention that are associated substantially with the undersurface of the sole of the shoe can include wrap-up lips 187 for an element similar to 20*b* and 118*a*, respectively, that extend above the sole of the shoe onto the upper of the shoe as shown in more detail herein. Although these lips 187 wrap-up above the undersurface of the sole of the shoe, these tabs 187 do not have associated with them 3D deformation chambers in contrast to the wrap-up elements described below.

Ground Contacting Systems Including Wrap-Up Elements

FIGS. 4*a–d* and FIGS. 5*a–c* depict two other embodiments of a shoe 10 of the present invention having an upper 12 (not shown), a sole 14 and a ground contacting system 16 associated with the shoe 10. However, in these two embodiments, the ground contacting systems 16 include 3D deformation elements that are associated with the undersurface 18 of the sole 14, and elements that are associated with the undersurface 18 of the sole 14 and at least one side region 186*a–d* of the shoe 10. The four side regions 186*a–d* are the heel side region 186*a*, the medial side region 186*b*, the toe side region 186*c*, and the lateral side region 186*d*. These side regions 186*a–d* include portions of the sole 14 and portions of the upper 12. 3D deformation elements of this invention that have portions thereof that are associated with the shoe sides as well as with the undersurface of the sole are sometimes referred to herein as wrap-up elements.

Figure 4B:
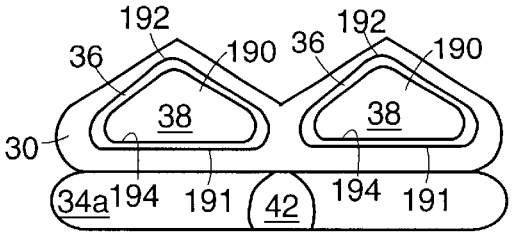
FIG. 4*b* is a front view of a portion of the 3d wrap-up heel element viewed looking at the center indentation in the heel element of FIG. 4*a;*
Figure 4C:
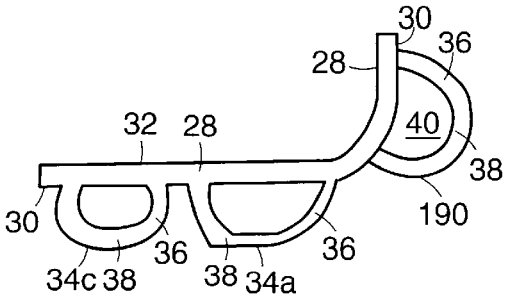
FIG. 4*c* is a cross-sectional view of the heel 3D wrap-up element of FIG. 4a along line X—X.
Figure 4D:
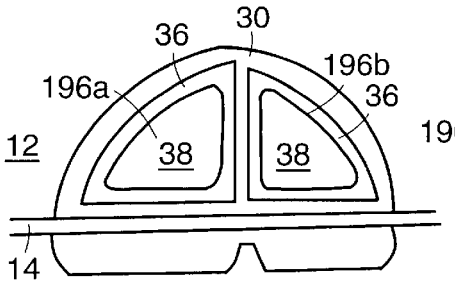
FIG. 4*d* is a front view of the medial 3D wrap-up element of FIG. 4*a;*
Figure 4A:
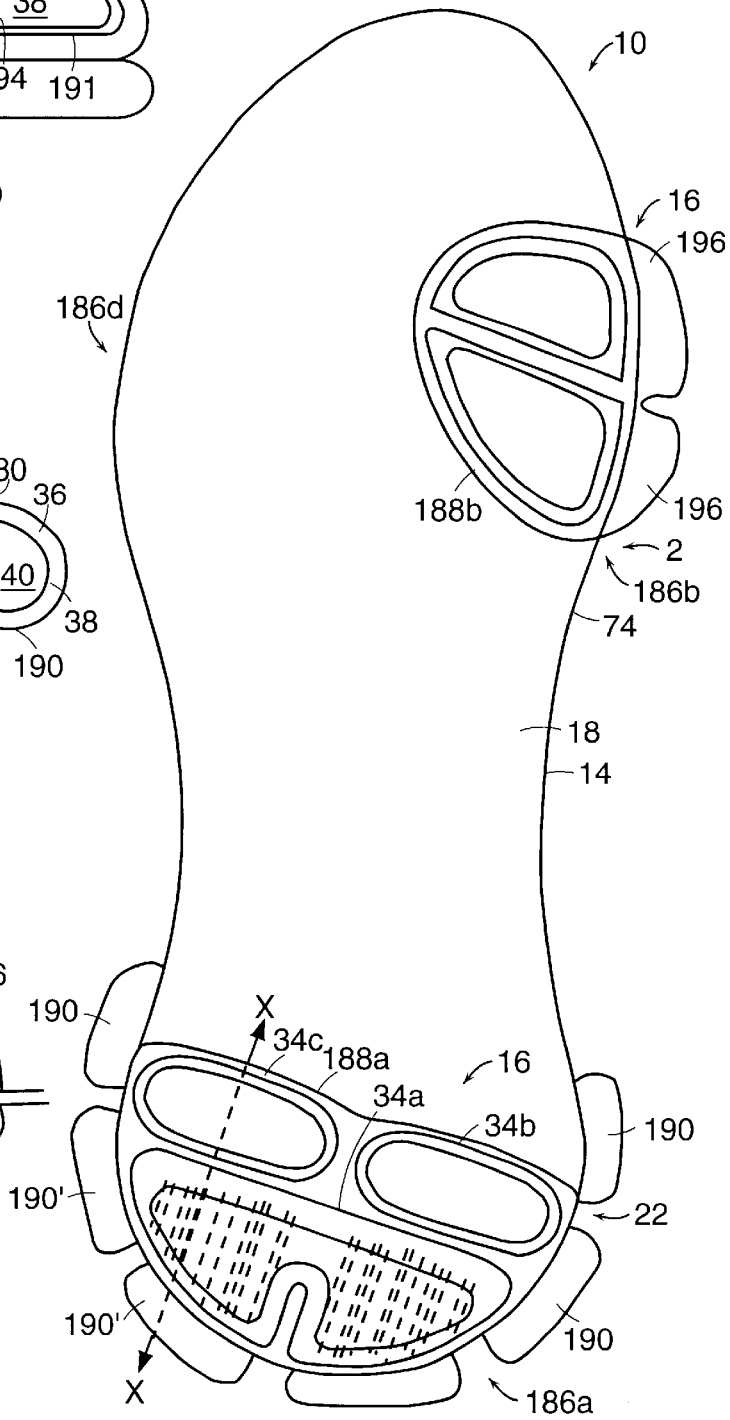
FIG. 4*a* is a bottom plan view of a shoe including another embodiment of a ground-contacting system of the present invention including a 3D wrap-up deformation elements associated with the heel and medial forefoot.

As shown in FIG. 4*a*, the ground contacting system 16 the shoe 10 includes two 3D wrap-up elements 188*a–b*. The element 188*a* is associated with the heel region 22, while the element 188*b* is associated with the medial side 74 of the forefoot region 24 of the sole 14. The element 188*a* is generally depicted to be similar to element 20*a* of the embodiment described in FIGS. 1*a–b* for the portion of the element 188*a* that is parallel to the undersurface 18 of the sole 14. The wrapped up portion of the element 188*a* includes a plurality of chambers 190 that are associated with the heel side region 186*a* of the heel region 22 of the shoe 10.

The plurality of chambers 190 extend from a point at or near the undersurface 18 of the sole 14 up onto the upper (or if the shoe has a midsole onto the midsole and the upper) a sufficient distance to provide adequate side impact shock resistance, energy dissipation, and deflection of the shoe relative to the ground contacting surfaces of the chambers 190. The chambers 190 have elongate bottom edges 191 as shown in FIGS. 4*a–b* and are generally of a rounded tear drop shape when viewed in cross-section as shown in FIG. 4*c*. The wrap-up chambers 190 generally extend an amount above the undersurface 18 of the sole 14 from about ½ inches to about 2 inches. Although, greater and lesser amounts can also be used with amounts between about ¾ inches to about 1½ inches being preferred.

Of course, these wrap-up chambers 190 can be of any other cross-sectional shape including half cylindrical, triangular, rectangular, or the like. The chambers 190 are also generally of an overall triangular shape when seen from the front as shown in FIG. 4*b*, where the chambers taper from an apex 192 to a lower ridge 194. Of course, the chambers 190 include a continuous sidewall 36, a tread or ground-contact surface 38, and an interior 40. Besides having a plurality of chambers 190, the wrap-up element 188*a* can include a single wrap-up chamber that extends around any amount of the heel side region of the shoe. Moreover, such a continuous chamber could have any wrap-up configuration including a cylindrical shape, a triangular shape, a tear drop shape, or any other shape or combination of shapes.

Generally, for these wrap-up elements the interior 40 will be designed so that their vertical and horizontal deformation characteristics are fairly high and are preferably filled with a compressible material that acts like a spring once the compressive force has been removed. The preferred elements are either air filled or filled with gas bags inserted into the interior 40 and occupy the majority of the volume of the interior. However, for certain sports activities such as soccer, football, rugby or other sports that require ball handling with the feet, the elements can also be constructed of a three component construction including a hard outer surface, a soft middle surface and a lower surface bonded to the side region of the shoe. Additionally, the elements can be filled with viscoelastic material analogous to elements 20*b*.

As shown also in FIGS. 4*a* and 4*d*, the medial forefoot element 188*b*, which is similar to the elements 106*b–c* of FIG. 3*a*, except that the element 188*b* includes wrap-up chambers 196*a–b*. The chambers 196*a–b* can have similar configurations as the chambers 190, but the frontal profile of elements 196*a–b* as shown in FIG. 4*d* is of a generally triangular or tear drop shape. Of course, the chambers 196*a–b* can have any contour or profile shape with the only criteria being ease of manufacture and the degree of 3D responsiveness desired for a given shoe and a given location on the shoe.

Figure 5C:
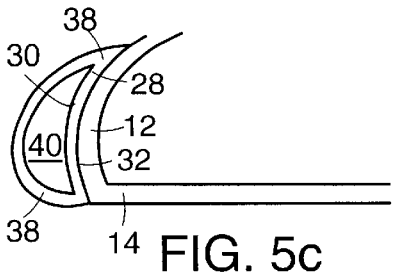
FIG. 5*c* is a cross-sectional view of the toe 3D wrap-up element of FIG. 5*a* along line Y—Y.
Figure 5B:
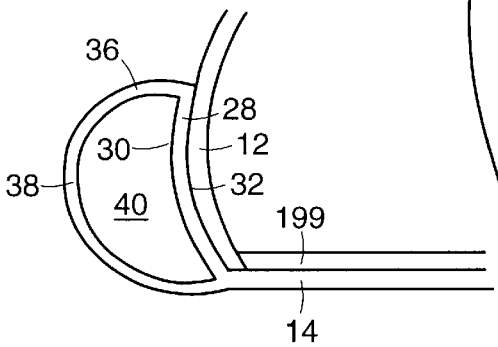
FIG. 5*b* is a cross-sectional view of the medial 3D wrap-up element of FIG. 5*a* along line X—X.
Figure 5A:
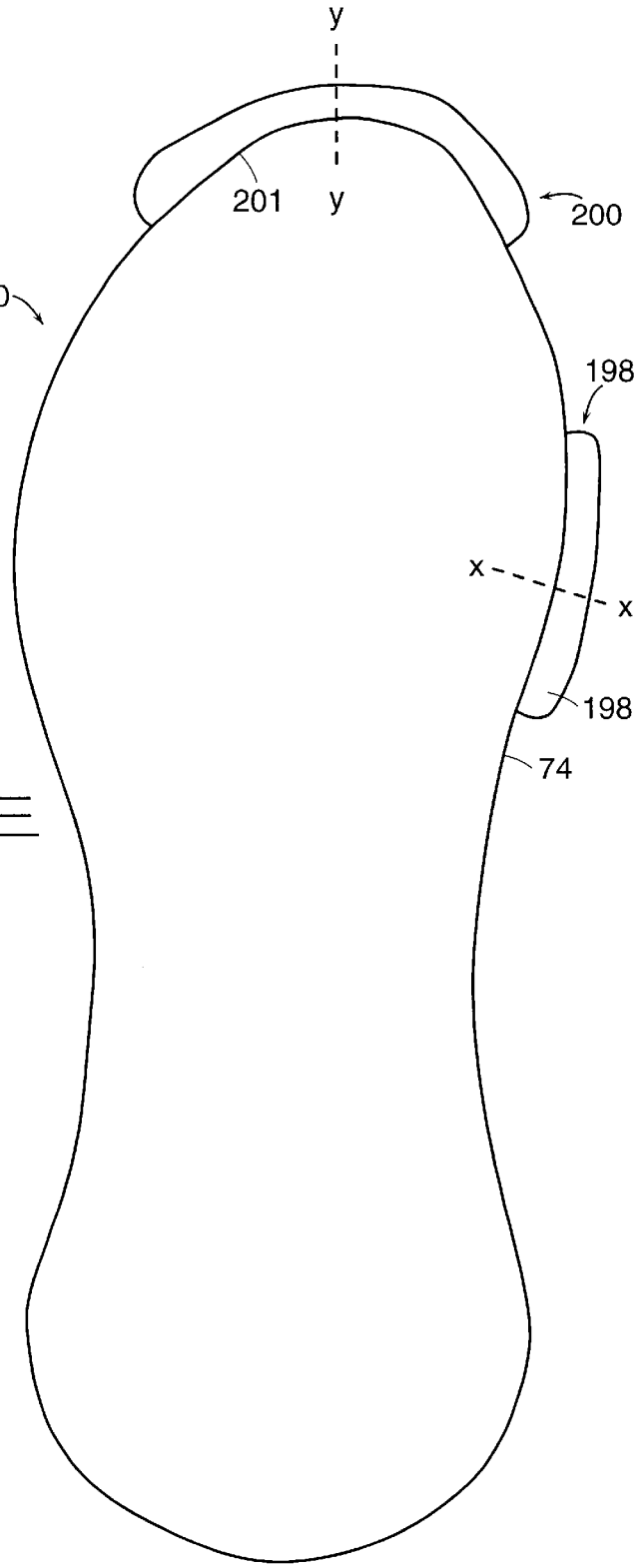
FIG. 5*a* is a bottom plan view of a shoe including another embodiment of a ground-contacting system of the present invention including 3D wrap-up deformation elements associated with the medial forefoot and the toe.

Referring now to FIGS. 5*a–c*, a second embodiment of shoe 10 having 3D wrap-up elements 198 and 200 associated therewith is shown. The element 198 is an elongate element extending along the medial side of the shoe to cushion side impacts to the base of the big toe into the arch region of the foot. The element 198 has a generally half cylindrical shape when viewed in cross-section as shown in FIG. 5*b*, which is shown with insole 199. Of course, wrap-up 3D elements can also be associated with the toe region of the shoe as is seen in the element 200, which has an elongate shape extending along the toe contour of the shoe and extending onto a portion of the upper and is designed to cushion toe impacts.

3D Elements Incorporated Into Other Shoes Designs

The ground-contacting elements of the present invention can also be incorporated into shoe having wrap-up members as described in U.S. Pat. Nos. 4,989,349, 5,317,819, and 5,544,429 to Ellis III, incorporated herein by reference. Again, whether these elements are associated primarily with the bottom portion of the sole or wrap-up, the best performance of the 3D elements of the present invention result when the elements and/or their associated chambers are free to respond three dimensionally without encountering any other structure of the sole or shoe or where the amount of deformation is controlled by the positioning of other 3D elements or support structure in the shoe.

A contoured sole of a shoe, for supporting a foot of a wearer, the sole comprising a sole member including an outer surface for contacting the ground having a plurality of 3D deformation elements of the present invention incorporated therein, and an inner surface for contacting the foot of the wearer.

The outer surface having a heel portion at a location substantially corresponding to a calcaneus of the foot of the wearer, a midtarsal portion at a location substantially corresponding to a midtarsal of the foot of the wearer, and a forefoot portion, the sole member also having a medial side and a lateral side and where the 3D deformation elements of the present invention are located at critical positions in the heel, midtarsal and forefoot portions of outer surface of the sole.

The forefoot portion having a forward medial forefoot part at a location substantially corresponding to the head of the first distal phalange, a rear medial forefoot part at a location substantially corresponding to the head of a first metatarsal of the foot of the wearer, and a rear lateral forefoot part at a location substantially corresponding to the head of a fifth metatarsal of the foot of the wearer. The midtarsal portion being between the forefoot and heel portions, and having a lateral midtarsal part at a location substantially corresponding to the base of a fifth metatarsal of the foot of the wearer. The heel portion having a lateral heel part at a location substantially corresponding to the lateral tuberosity of the calcaneus of the foot of the wearer, and a medial heel part at a location substantially corresponding to the base of the calcaneus of the foot of the wearer;

The sole containing a convexly rounded bulge at least one of the medial heel part, the lateral heel part, the forward medial forefoot part, the rear medial forefoot part, the rear lateral forefoot part, and the lateral midtarsal part, the bulges projecting convexly from at least one of the outer surface, the medial side and the lateral side of the sole member.

A sole wherein the bulge is: (1) continuously rounded between the outer surface under the sole member, and along at least one of the lateral and medial sides of the sole member; (2) rounded only along at least one of the lateral and medial sides of the sole member; (3) at the lateral midtarsal part and projects convexly from the lateral side and along the outer surface under the sole member; (4) at the lateral midtarsal part and projects convexly from the lateral side of the sole member; (5) at the rear medial forefoot part and projects convexly from the medial side and along the outer surface under the sole member; (6) at the rear medial forefoot part and projects convexly from the medial side of the sole member; (7) at the rear lateral forefoot part and projects convexly from the lateral side and along the outer surface under the sole member; (8) at the rear lateral forefoot part and projects convexly from the lateral side of the sole member; (9) at the heel portion and projects convexly from the lateral and medial sides and from the outer surface under the sole member; (10) at the lateral heel part and projects convexly from the lateral and medial sides and from the outer surface under the sole member; (11) at the medial heel part and projects convexly from the lateral and medial sides and from the outer surface under the sole member; or (12) at least one of the lateral and medial heel parts and projects convexly from at least one of the lateral and medial sides of the sole member; and where each bulge can have a 3D deformation element associated therewith.

A sole including the ground-contacting system of the present invention and a bulge at the forward medial forefoot part of the forefoot portion that projects convexly from the outer surface or at the forward medial forefoot part of the forefoot portion that projects convexly from the front of the sole member and where the bulge includes a 3D deformation element associated therewith.

A sole including the ground-contacting system of the present invention can also include: (1) a bulge at the lateral midtarsal part and a bulge at the rear lateral forefoot part the bulges projecting convexly from the lateral side, the bulges also being rounded along the lateral side and the outer surface, and an indentation between the bulges; (2) a bulge at the lateral rnidtarsal part and a bulge at the rear lateral forefoot part the bulges projecting convexly from the lateral side, and an indentation between the bulges; (3) bulges at the heel portion and at the lateral midtarsal part, and an indentation between the bulges; or (4) a bulge at the forward medial forefoot part of the forefoot portion and an indentation between the rear medial forefoot part and the forward medial forefoot part; and where each bulge can be a 3D element of the present invention or have such a 3D element incorporated therewith.

A sole including a ground-contacting system of the present invention and (1) wherein the bulge is contoured at the inner surface so that the sole member extends upwardly at least one of the lateral and medial side for conforming with at least part of a side of the foot of the wearer; (2) wherein the bulge is contoured at the inner surface and at least a midsole of the sole member extends upwardly at least one of the lateral and medial side for conforming with at least part of a side of the foot of the wearer; (3) wherein the bulge is contoured at the inner surface and only a midsole of the sole member extends upwardly at least one of the lateral and medial side for conforming with at least part of a side of the foot of the wearer; (4) wherein the bulge is contoured at the inner surface and at least a midsole of the sole member extends upwardly at least one of the lateral and medial side for contacting with the ground during lateral or medial motion; (5) wherein the bulge is contoured at the inner surface and only a midsole of the sole member extends upwardly at least one of the lateral and medial side for contacting with the ground during lateral or medial motion; (6) wherein the bulge is contoured at the inner surface and at least a heel lift of the sole member extends upwardly at least one of the lateral and medial side for conforming with at least part of a side of the foot of the wearer; or (7) wherein the bulge is contoured at the inner surface and only a heel lift of the sole member extends upwardly at least one of the lateral and medial side for conforming with at least part of a side of the foot of the wearer; and where each bulge or other portions of the sole have at least one 3D deformation element associated therewith especially in regions of the sole expected to experience the maximum impact and force associated with foot fall. Again, 3D elements with high degrees of vertical deformation should be located at portions of the sole that are associated with receiving the major part of foot fall impact such as the heel, while elements with more horizontal deformation characteristics are better for forefoot and toe portions of the foot.

A sole including the bulge comprises an area of increased material firmness to form a structural support or propulsion element for the foot of the wearer and including a transverse indentation in the outer surface of the sole, between the forward medial forefoot part and the rear forefoot parts and where the bulge further includes a 3D deformation element.

A sole including the ground-contacting system of the present invention wherein sole member is contoured at the inner surface so that the sole member extends upwardly to form a contour for conforming to at least part of a contoured underneath portion of the sole of the non-load-bearing foot of the wearer or wherein at least an insole and the bottom sole of the sole member forms the contour.

A contoured sole of a shoe, for supporting a foot of a wearer, the sole comprising a sole member including an outsole and a midsole, the sole member having an outer surface for contacting the ground and at least one 3D deformation element associated therewith, and an inner surface for contacting the foot of the wearer. The outer surface having a heel portion at a location substantially corresponding to a calcaneus of the foot of the wearer, a midtarsal portion at a location substantially corresponding to a midtarsal of the foot of the wearer, and a forefoot portion, the sole member also having a medial side and a lateral side.

The forefoot portion having a forward medial forefoot part at a location substantially corresponding to the head of the first distal phalange, a rear medial forefoot part at a location substantially corresponding to the head of a first metatarsal of the foot of the wearer, and a rear lateral forefoot part at a location substantially corresponding to the head of a fifth metatarsal of the foot of the wearer. The midtarsal portion having a lateral midtarsal part at a location substantially corresponding to the base of a fifth metatarsal of the foot of the wearer. The heel portion having a lateral heel part at a location substantially corresponding to the lateral tuberosity of the calcaneus of the foot of the wearer, and a medial heel part at a location substantially corresponding to the base of the calcaneus of the foot of the wearer.

The sole member being contoured at the inner surface so that the sole member extends upwardly at least one of the lateral and medial side to form a contour for contacting at least part of a side of the foot of the wearer, the contour comprising at least the midsole of the sole member extending upwardly at least one of the lateral and medial sides for conforming with at least part of a side of the foot of the wearer and for forming the outer surface at the lateral or medial sides of the sole member.

A sole further having a sole member where only the midsole thereof forms the contour and where the contour: (1) is at least one of the medial heel part the lateral heel part, the forward medial forefoot part, the rear medial forefoot part, the rear lateral forefoot part, and the lateral midtarsal part, the bulges projecting convexly from at least one of the outer surface, the medial side and the lateral side of the sole member; (2) comprises a convexly rounded bulge at least one of the medial heel part, the lateral heel part, the forward medial forefoot part, the rear medial forefoot part, the rear lateral forefoot part, and the lateral midtarsal part, the bulges projecting convexly from at least one of the outer surface, the medial side and the lateral side of the sole member; or (3) comprises an area of increased material firmness to form a structural support or propulsion element for the foot of the wearer; and where the contours have at least one 3D deformation element incorporated therein.

Yet another sole including the ground-contacting systems of the present invention and a bulge: (1) at the lateral midtarsal part that projects convexly from the lateral side; (2) at the rear medial forefoot part that projects convexly from the medial side of the sole member; (3) at the rear lateral forefoot part that projects convexly from the lateral side of the sole member; (4) at least one of the lateral and medial heel parts that projects convexly from at least one of the lateral and medial sides of the sole member; or (5) at the forward medial forefoot part of forefoot portion; and where each bulge incorporates at least one 3D deformation element therein so that force transference from the sole to the foot is decreased, augmented or minimized.

The sole including the ground-contacting system of the present invention where the outer surface at the lateral or medial sides of the sole member is ground-contacting during lateral or medial motion and where the lateral or medial sides of the sole member have at least one 3D deformation element incorporated therein and further where at least the heel lift of the sole member forms the contour.

The sole described in the preceding paragraph where the sole member is contoured at the inner surface so that the sole member extends upwardly to form a contour for conforming to at least part of a contoured underneath portion of the sole of the non-load-bearing foot of the wearer; where at least an insole and a bottom sole of the sole member forms the contour.

A shoe sole comprising a shoe sole having an upper, a foot-contacting surface at least a portion of which conforms to the shape of a sole of a wearer's heel, including at least a portion of at least one curved side of the wearer's foot sole proximate to a calcaneus of said foot, and said shoe sole portions having a uniform thickness, when measured in frontal plane cross sections.

The direct load-bearing part of the shoe sole includes both that part of the bottom portion and that part of the curved side portion that become directly load-bearing when the shoe sole on the ground is tilted sideways, away from an upright position and where the bottom portion and the part of the curves side portion have at least one 3D deformation element incorporated therein.

The uniform thickness of the shoe sole, as measured in frontal plane cross sections, extends through at least a contoured side portion providing direct structural support between foot sole and ground through a sideways tilt of at least 20 degrees and where the shoe sole has at least a side portion, which adjoins said contoured side portion proximate to the calcaneus, with a thickness that is not uniform through a sideways tilt of at least 20 degrees, in order to save weight and to increase flexibility, whereby, as measured in frontal plane cross sections, the shoe sole's uniform thickness between the upper, foot-contacting surface and the parallel lower, ground-contacting surface maintains a lateral stability of the heel on the shoe sole like that when the foot is bare on the ground, especially during extreme sideways pronation and supination motion occurring when the shoe sole is in contact with the ground.

The shoe sole described in the previous paragraph where the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections.

The shoe sole set forth above where said portion of the upper, foot-contacting surface that conforms to the shape of a sole of a wearer's heel, includes at least a portion of at least a lateral side and a medial curved side of the wearer's foot sole proximate to a calcaneus of said foot.

The shoe sole described above where: (1) the uniform thickness of the shoe sole, as measured in frontal plane cross sections, extends through at least one contoured side portion providing direct structural support between foot sole and ground through a sideways tilt of at least 30 degrees; (2) the uniform thickness of the shoe sole, as measured in frontal plane cross sections, extends through at least a lateral and a medial contoured side portion providing direct structural support between foot sole and ground through a lateral and a medial sideways tilt of at least 30 degrees; (3) the uniform thickness of the shoe sole, as measured in frontal plane cross sections, extends through at least one contoured side portion providing direct structural support between foot sole and ground through a sideways tilt of at least 45 degrees; or (4) the uniform thickness of the shoe sole, as measured in frontal plane cross sections, extends through at least a lateral and a medial contoured side portion providing direct structural support between foot sole and ground through a lateral and a medial sideways tilt of at least 45 degrees.

A shoe sole for a shoe and other footwear comprising a shoe sole having an upper, foot-contacting surface at least a portion of which conforms to the shape of a wearer's forefoot sole, including at least a portion of a curved side of the wearer's forefoot sole proximate to a head of a fifth metatarsal of the wearer's foot and said shoe sole portions having substantially uniform thickness, when measured in frontal plane cross sections.

The shoe sole further comprising the direct load-bearing part of the shoe sole includes both that part of the bottom portion and that part of the curved side portion which become directly load-bearing when the shoe sole on the ground is tilted sideways, away from an upright position and having at least one 3D deformation element associated therewith.

The shoe sole further comprising the substantially uniform thickness of the shoe sole, as measured in frontal plane cross sections, extends through at least a contoured side portion providing direct structural support between foot sole and ground through a sideways tilt of at least 45 degrees; the shoe sole has at least a side portion, which adjoins said contoured side portion proximate to the head of the fifth metatarsal, with a thickness that is not uniform through a sideways tilt of at least 45 degrees, in order to save weight and to increase flexibility; whereby, as measured in frontal plane cross sections, the shoe sole's substantially uniform thickness between the upper, foot-contacting surface and the parallel lower, ground-contacting surface maintains a lateral stability of the forefoot on the shoe sole like that when the foot is bare on the ground, especially during extreme sideways pronation and supination motion occurring when the shoe sole is in contact with the ground.

The shoe sole set forth above where: (1) the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections; or (2) the uniform thickness of the shoe sole portion extends through at least part of a contoured side portion providing direct structural support between foot sole and ground through a sideways tilt angle of at least 120 degrees, whereby the amount of any shoe sole contoured side that is provided the shoe sole is sufficient to maintain lateral stability of the wearer's foot throughout the most extreme range of sideways motion, including at least 120 degrees of inversion and eversion; said lateral stability being like that of the wearer's foot when bare.

A shoe sole for shoe and other footwear, comprising a shoe sole having an upper, foot-contacting surface at least a portion of which conforms to the shape of a wearer's forefoot sole, including at least a portion of a curved side of the wearer's forefoot sole proximate to a base of a fifth metatarsal of the wearer's foot; and said shoe sole portions having a substantially uniform thickness when measured in frontal plane cross sections; the direct load-bearing part of the shoe sole includes both that part of the bottom portion and that part of the curved side portion that become directly load-bearing when the shoe sole on the ground is tilted sideways, away from an upright position and including at least one 3D deformation element associated therewith; the substantially uniform thickness of the shoe sole, as measured in frontal plane cross sections, extends through at least a contoured side portion providing direct structural support between foot sole and ground through a sideways tilt of at least 30 degrees; the shoe sole has at least a side portion, which adjoins said contoured side portion proximate to the base of the fifth metatarsal, with a thickness that is not uniform through a sideways tilt of at least 30 degrees, in order to save weight and to increase flexibility; whereby, as measured in frontal plane cross sections, the shoe sole's substantially uniform thickness between the upper, foot-contacting surface and the parallel lower, ground-contacting surface maintains a lateral stability of the forefoot on the shoe sole like that when the foot is bare on the ground, especially during extreme sideways pronation and supination motion occurring when the shoe sole is in contact with the ground.

The shoe sole set forth in the preceding paragraph where: (1) the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections; or (2) the uniform thickness of the shoe sole portion extends through at least part of a contoured side portion providing direct structural support between foot sole and ground through a sideways tilt angle of at least 90 degrees, whereby the amount of any shoe sole contoured side that is provided the shoe sole is sufficient to maintain lateral stability of the wearer's foot throughout the most extreme range of sideways motion, including at least 90 degrees of inversion and eversion; said lateral stability being like that of the wearer's foot when bare.

A shoe sole for a shoe and other footwear, comprising a shoe sole having an upper, foot-contacting surface at least a portion of which conforms to the shape of a wearer's forefoot sole, including at least a portion of a curved side of the wearer's forefoot sole proximate to a head of a first metatarsal of the wearer's foot; and said shoe sole portions having a substantially uniform thickness, when measured in frontal plane cross sections; the direct load-bearing part of the shoe sole includes both that part of the bottom portion and that part of the curved side portion which become directly load-bearing when the shoe sole on the ground is tilted sideways, away from an upright position and including at least one 3D deformation element associated therewith; the substantially uniform thickness of the shoe sole, as measured in frontal plane cross sections, extends through at least a contoured side portion providing direct structural support between foot sole and ground through a sideways tilt of at least 30 degrees; the shoe sole has at least a side portion, which adjoins said contoured side portion proximate to the head of the fifth metatarsal, with a thickness that is not uniform through a sideways tilt of at least 30 degrees, in order to save weight and to increase flexibility; whereby, as measured in frontal plane cross sections, the shoe sole's substantially uniform thickness between the upper, foot-contacting surface and the parallel lower, ground-contacting surface maintains a lateral stability of the forefoot on the shoe sole like that when the foot is bare on the ground, especially during extreme sideways pronation and supination motion occurring when the shoe sole is in contact with the ground.

The shoe sole set forth in the preceding paragraph where; (1) the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections; or (2) the uniform thickness of the shoe sole portion extends through at least part of a contoured side portion providing direct structural support between foot sole and ground through a sideways tilt angle of at least 60 degrees, whereby the amount of any shoe sole contoured side that is provided the shoe sole is sufficient to maintain lateral stability of the wearer's foot throughout the most extreme range of sideways motion, including at least 60 degrees of inversion and eversion; said lateral stability being like that of the wearer's foot when bare.

A shoe sole for a shoe and other footwear, comprising a shoe sole having an upper, foot-contacting surface at least a portion of which conforms to the shape of a wearer's forefoot sole, including at least a portion of a curved side of the wearer's forefoot sole proximate to a head of a first distal phalange of the wearer's foot; and said shoe sole portions having a substantially uniform thickness, when measured in frontal plane cross sections; the direct load-bearing part of the shoe sole includes both that part of the bottom portion and that part of the curved side portion which become directly load-bearing when the shoe sole on the ground is tilted sideways, away from an upright position and including at least one 3D deformation element associated therewith; the substantially uniform thickness of the shoe sole, as measured in frontal plane cross sections, extends through at least a contoured side portion providing direct structural support between foot sole and ground through a sideways tilt of at least 30 degrees; the shoe sole has at least a side portion, which adjoins said contoured side portion proximate to the head of the fifth metatarsal, with a thickness that is not uniform through a sideways tilt of at least 30 degrees, in order to save weight and to increase flexibility; whereby, as measured in frontal plane cross sections, the shoe sole's substantially uniform thickness between the upper, foot-contacting surface and the parallel lower, ground-contacting surface maintains a lateral stability of the forefoot on the shoe sole like that when the foot is bare on the ground, especially during extreme sideways pronation and supination motion occurring when the shoe sole is in contact with the ground.

The shoe sole set forth in the preceding paragraph where: (1) the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections; or (2) the uniform thickness of the shoe sole portion extends through at least part of a contoured side portion providing direct structural support between foot sole and ground through a sideways tilt angle of at least 60 degrees, whereby the amount of any shoe sole contoured side that is provided the shoe sole is sufficient to maintain lateral stability of the wearer's foot throughout the most extreme range of sideways motion, including at least 20 degrees of inversion and eversion; said lateral stability being like that of the wearer's foot when bare.

A shoe sole for a shoe and other footwear, comprising: a shoe sole with an upper, foot sole-contacting surface that substantially conforms to the shape of a wearer's foot sole, including at least one portion of the curved bottom of the foot sole when not structurally flattened under the wearer's body weight load; and the shoe sole has a substantially uniform thickness when measured in frontal plane cross-sections, in at least a part of the shoe sole providing direct structural support between the wearer's load-bearing foot sole and ground; wherein the direct load-bearing part of the shoe sole includes both that part of the curved bottom portion and that part of the curved side portion that become directly load-bearing when the shoe sole on the ground is tilted sideways, away from an upright position; said shoe sole thickness being defined as the shortest distance between any point on an upper, foot sole-contacting surface of said shoe sole and a lower, ground-contacting surface of said shoe sole, when measured in frontal plane cross sections; the load-bearing part of the lower, ground-contacting surface of the shoe sole is therefore parallel to the upper foot sole-contacting surface of the shoe sole, when measured in frontal plane cross sections; said shoe sole thickness has variation when measured in the sagittal plane; the substantially uniform thickness of the shoe sole, as measured in frontal plane cross sections, extends through the curved bottom portion; and, the substantially uniform thickness of the shoe sole is different when measured in at least two separate frontal plane cross sections; and including at least one 3D deformation element associated with at least one load bearing portions or parts of the sole.

The shoe sole set forth in the preceding paragraph where said curved bottom portion is at least proximate to a base of the calcaneus of a wearer's foot; where said curved bottom portion is at least proximate to a lateral tuberosity of the calcaneus of a wearer's foot; where said curved bottom portion is at least proximate to a base of the fifth metatarsal of a wearer's foot; where said curved bottom portion is at least proximate to a head of the fifth metatarsal of a wearer's foot; where said curved bottom portion is at least proximate to a head of the first metatarsal of a wearer's foot; where said curved bottom portion is at least proximate to a head of the first distal phalange of a wearer's foot.

A shoe sole for a shoe and other footwear, comprising: the shoe sole having an upper, foot sole-supporting surface; the shoe sole having at least one load-bearing portion with at least one curved side portion merging with a side of said load-bearing portion; the shoe sole also including a lower, ground-contacting surface; at least a part of the load-bearing portion of said shoe sole has a substantially uniform thickness, as measured in frontal plane cross-sections; said substantially uniform thickness of the shoe sole, as measured in frontal plane cross-sections, extends through said curved side portion of the shoe sole sufficiently far up said curved side portion to maintain said substantially uniform thickness between said sole of the wearer's foot and the ground, through a sideways tilt of at least 7 degrees, of either inversion or eversion; and including at least one 3D deformation element associated with at least one load bearing portions or parts of the sole.

A shoe sole for a shoe or other footwear, comprising: a shoe sole with an upper, foot sole-contacting surface that conforms substantially to the shape of at least part of a sole of a wearer's foot, including at least part of one curved side of the foot sole; the shoe sole is characterized by at least a part of the load-bearing portions of the shoe sole having a substantially uniform thickness, so that a lower, ground-contacting surface substantially parallels said upper surface, when measured in frontal plane cross sections; said shoe sole thickness being defined as the shortest distance between any point on an upper, foot sole-contacting surface of said shoe sole and a lower, ground-contacting surface of said shoe sole, when measured in frontal plane cross sections; the substantially uniform thickness of the shoe sole, as measured in frontal plane cross sections, extends through at least one contoured side portion at least high enough to provide direct load-bearing support between sole of foot and ground through a sideways tilt of 20 degrees; the shoe sole thickness has variation when measured in sagittal plane cross sections; and the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections; and including at least one 3D deformation element associated with at least one load bearing portions or parts of the sole.

The shoe sole set forth in the preceding paragraph where at least part of said at least one contoured said portion of the shoe sole in a given cross section is substantially constructed using a mathematical approximation in the form of a part of a ring with substantially the same thickness as that of said at least one sole portion of said given frontal plane cross-section; in the said given frontal plane cross section, at least a part of the upper, foot sole-contacting surface of the shoe sole said at least one contoured side portion is constructed as a relatively smaller circle defining the inner surface of the ring, which is made with an appropriate radius and center to coincide approximately with at least a part of the contoured surface of a sole of the wearer's foot; and at least a part of the lower, ground-contacting surface of the said at least one contoured side portion is constructed as a relatively larger circle defining the outer surface of the ring, which is made, while substantially maintaining the same center of rotation, by a radius increased by an amount substantially equal to the thickness of the said at least one sole portion in the given frontal plane cross section.

And further the shoe sole includes at least a part of the curved structure of said at least one contoured side portion includes a tread pattern on the ground-contacting surface that is approximated by using at least one straight line segment to construct a portion of the contour, when measured in frontal plane cross sections where said shoe sole has a shape that conforms to an average shape of more than one individual wearer.

A shoe sole for a shoe or other footwear, comprising a shoe sole with an upper, foot sole-contacting surface that conforms substantially to the shape of at least part of a sole of a wearer's foot, including at least part of one curved side of the foot sole; the shoe sole is characterized by at least a part of the load-bearing portions of the shoe sole having a substantially uniform thickness, so that a lower, ground-contacting surface substantially parallels said upper surface, when measured in frontal plane cross sections; said shoe sole thickness being defined as the shortest distance between any point on an upper, foot sole-contacting surface of said shoe sole and a lower, ground-contacting surface of said shoe sole, when measured in frontal plane cross sections; the substantially uniform thickness of the shoe sole, as measured in frontal plane cross sections, extends through at least one contoured side portion at least high enough to provide direct load-bearing support between sole of foot and ground through a sideways tilt of 20 degrees; the shoe sole thickness is varying when measured in sagittal plane cross sections and is greater in a heel area than in a forefoot area; and the substantially uniform thickness of the shoe sole is different when measured in at least two separate frontal plane cross sections wherein the shoe sole has at least one contoured side portion with the substantially uniform thickness extending through at least a sideways tilt of 20 degrees, so that there are at least two different thicknesses of the contoured side portions, when measured in frontal plane cross sections, wherein said at least one contoured side portion is sufficient to maintain lateral stability of the wearer's foot throughout its full range of sideways pronation and supination motion in a manner substantially equivalent to that of the wearer's foot when bare on the ground, the method comprising the steps of: demonstrating by a wearer the substantial equivalency of that lateral stability by the wearer, who can simulate a common inversion ankle sprain while standing in a stationary position to reduce and control forces on the ankle joint, the step of demonstrating including the steps of first, tilting out the wearer's unshod foot laterally in inversion to the extreme 20 degree limit of the range of motion of the subtalar ankle joint of the wearer's foot to demonstrate firm lateral stability; second, repeating the same inversion motion by the wearer shod with the shoe sole with said at least one contoured side portion with substantially uniform thickness to demonstrate the substantially equivalent firm lateral stability; and third, in contrast, again repeating the same inversion motion, very carefully, by the wearer shod with any conventional shoe sole to demonstrate its gross lack of lateral stability; and including at least one 3D deformation element associated with at least one load bearing portions or parts of the sole.

A shoe sole, comprising: an upper, foot sole-contacting surface that conforms substantially to the shape of at least a part of a sole of a wearer's foot, said shape including at least a part of the load-bearing portion of at least a curved side of the foot sole; and a lower ground-contacting surface; said shoe sole has at least a sole portion including said foot sole contacting surface and at least one contoured side portion merging with said sole portion and conforming substantially to the shape of the corresponding side of the sole of said foot; said shoe sole thickness varies when measured in sagittal plane cross-sections; said sole portion and said contoured side portion have a substantially uniform thickness when measured in frontal plane cross-sections; said shoe sole thickness being defined as about the shortest distance between any point on said upper, foot sole-contacting surface and the closest point on said lower, ground-contacting, when measured in frontal plane cross sections; said substantially uniform thickness of said shoe sole is different when measured in at least two separate frontal plane cross sections wherein the shoe sole has at least one said contoured side portion of at least 20 degrees, so that there are at least two different thicknesses of said at least one contoured side portion, when measured in frontal plane cross sections; and including at least one 3D deformation element associated with at least one load bearing portions or parts of the sole.

The shoe sole construction set forth in the preceding paragraph wherein the shoe sole is made of flexible material; said flexibility being such that the shoe sole deforms to flatten against the ground under a wearer's body weight load in a manner substantially paralleling the flattening deformation of the wearer's foot sole directly against the ground under the same load.

3D Element Configuration

The next series of Figures relate to a variety of different elements configurations and internal structures free of the shoe and/or sole to which they would attach. The Figures are included for the purpose of illustration as to the diverse shapes and configurations that are envisioned by the present application and is not included for the purpose of limitation and/or inclusiveness.

Figure 6A:
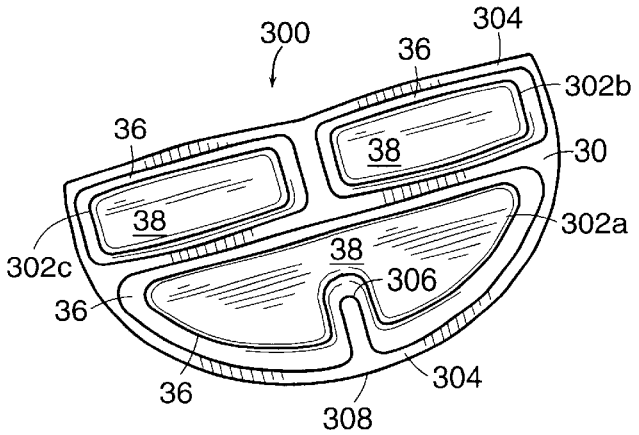
FIG. 6*a* is a bottom view of one embodiment of a 3D deformation element of this invention.
Figure 6B:
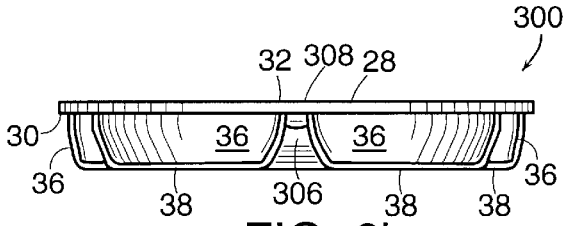
FIG. 6*b* is a front view of the 3D deformation element of FIG. 6*a;*
Figure 6C:
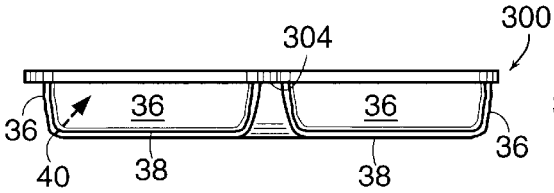
FIG. 6*c* is a back view of the 3D deformation element of FIG. 6*a;*
Figure 6D:
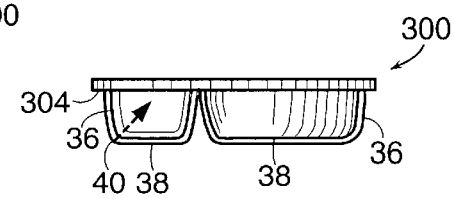
FIG. 6*d* is a side view of the 3D deformation element of FIG. 6*a;*
Figure 7A:
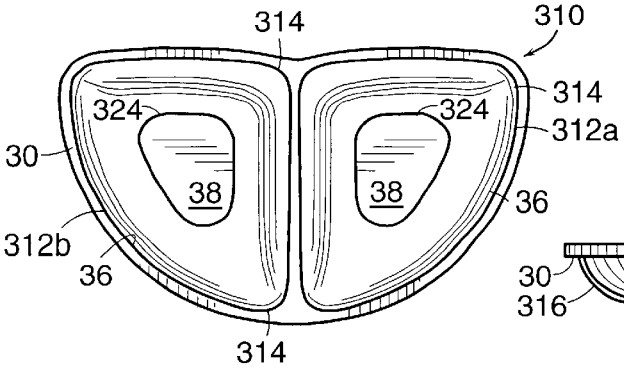
FIG. 7*a* is a bottom view of another embodiment of a 3D deformation element of this invention.
Figure 7B:
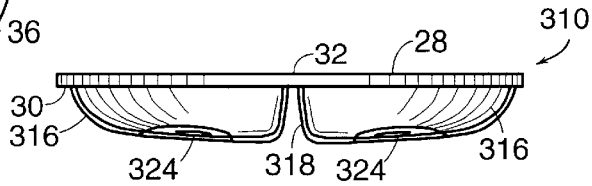
FIG. 7*b* is a front view of the 3D deformation element of FIG. 7*a;*
Figure 7C:
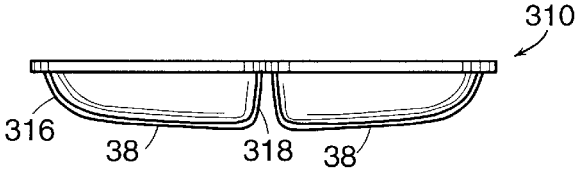
FIG. 7*c* is a back view of the 3D deformation element of FIG. 7*a;*
Figure 7D:
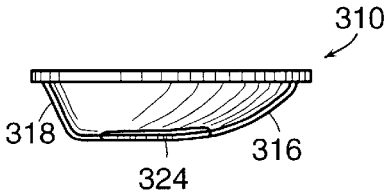
FIG. 7*d* is a side view of the 3D deformation element of FIG. 7*a;*

Referring now to FIGS. 6*a–d*, a 3D element 300 similar to the element 20*a* of FIGS. 1*a–b* is shown. The element 300 includes a top 28 having a substantially flat top surface 32 for attachably engaging a sole 14. The element 300 also includes a bottom 30 having three chambers 302*a–c* extending from a flat portion 304 of the bottom 30. The chambers 302*a–c* include a continuous sidewall 36, a ground contacting or tread surface 38, and an interior 40. The sidewall 36 and the tread surface 38 are one continuous and contiguous material and of uniform thickness as shown in cross-section in FIG. 6*b*. The interior 40 of this type of element is generally filled with a gas, liquid, fluid or mixture thereof and is hermetically sealed. The chamber 302*a* is generally half-moon shaped with an key indention 306 at or near a mid-point 308 thereof. However, unlike the chamber 34*a*, the chamber 302*a* does not slope in a convex fashion from a flat region of the tread surface to the heel edge of the sidewall as was the case for the element shown in FIGS. 1*a–c*. Here, all three chambers 302*a–c* have a generally rectangular cross-section with somewhat rounded sidewalls 36 as shown in FIG. 6*c–d*. The rectangular cross-section of these chambers will provide a more or less constant tread contact surface and allow horizontal deflection through distortion of the sidewall 36 under load.

This type of element can be manufacture by blow molding or injection molding techniques as are well-known in the art. Thus, the entire element is made at one time from a single rubber and then cured to a finished product. The blow molding process allows the interior 40 of the chambers 302*a–c* to be at or above atmospheric pressure. However, the blow molding process limits the nature and type of rubbers that can be used to manufacture the 3D deformation elements of the present invention.

Looking now at FIGS. 7*a–d*, another 3D element 310 of the present invention is shown which also includes a top 28 having a substantially flat top surface 32 for attachably engaging a sole 14. The element 310 also includes a bottom 30 having two chambers 312*a–b* extending from a flat portion 304 of the bottom 30. The chambers 312*a–b* include a continuous sidewall 36, a ground contacting or tread surface 38, and an interior 40 as do all the chambers of the present invention. The element 310 is seen to be generally semi-circular with the two chambers 312*a–b* occupying approximately half of the entire element surface and are generally of a triangular shape with rounded outer contour 314. The chambers 312*a–b* have a rounded sidewall portion 316 along its outer contour 314 and near vertical sidewall portions 318 associated with its toe side edge 320 and its interior edge 322. The elements 312*a–b* also include a tread insert 324 which can be a clear window or differently colored rubber compositions.

Figure 8A:
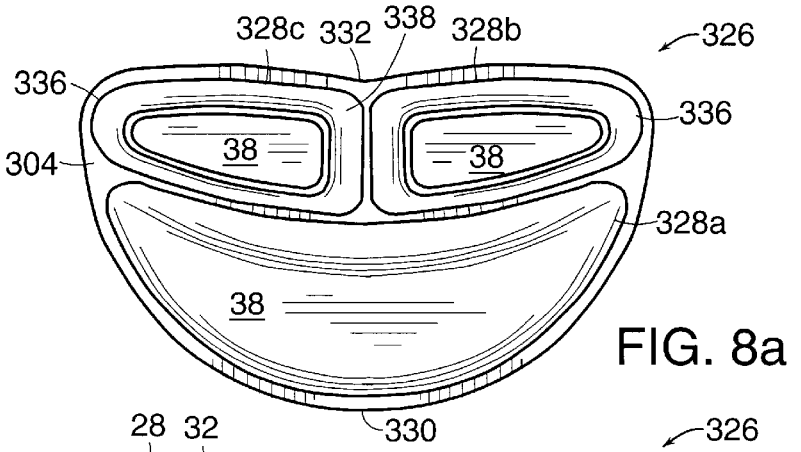
FIG. 8*a* is a bottom view of another embodiment of a 3D deformation element of this invention.
Figure 8B:
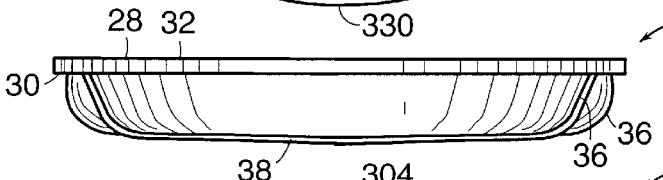
FIG. 8*b* is a front view of the 3D deformation element of FIG. 8*a;*
Figure 8C:
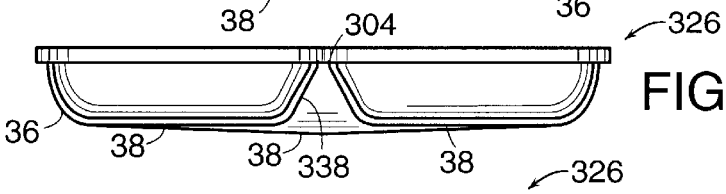
FIG. 8*c* is a back view of the 3D deformation element of FIG. 8*a;*
Figure 8D:
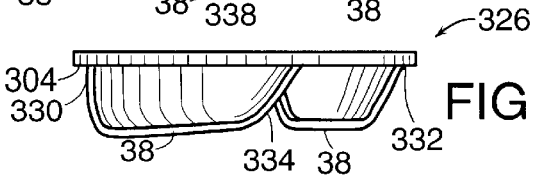
FIG. 8*d* is a side view of the 3D deformation element of FIG. 8*a;*
Figure 9A:
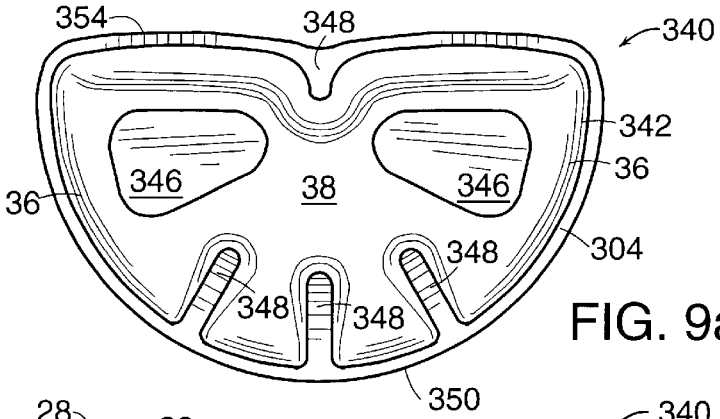
FIG. 9*a* is a bottom view of another embodiment of a 3D deformation element of this invention.
Figure 9B:
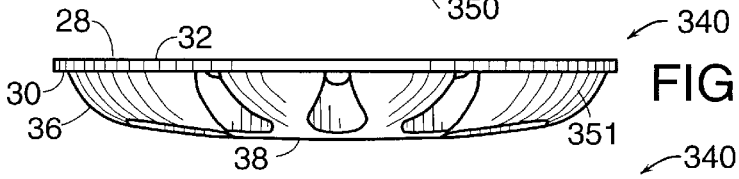
FIG. 9*b* is a front view of the 3D deformation element of FIG. 9*a;*
Figure 9C:
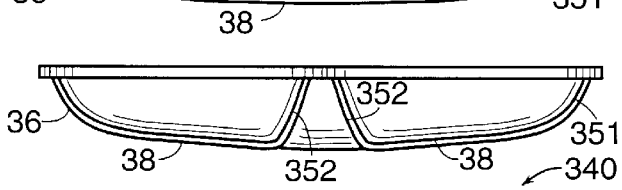
FIG. 9*c* is a back view of the 3D deformation element of FIG. 9*a;*
Figure 9D:
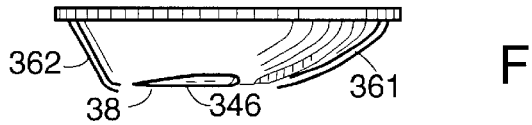
FIG. 9*d* is a side view of the 3D deformation element of FIG. 9*a;*
Figure 10A:
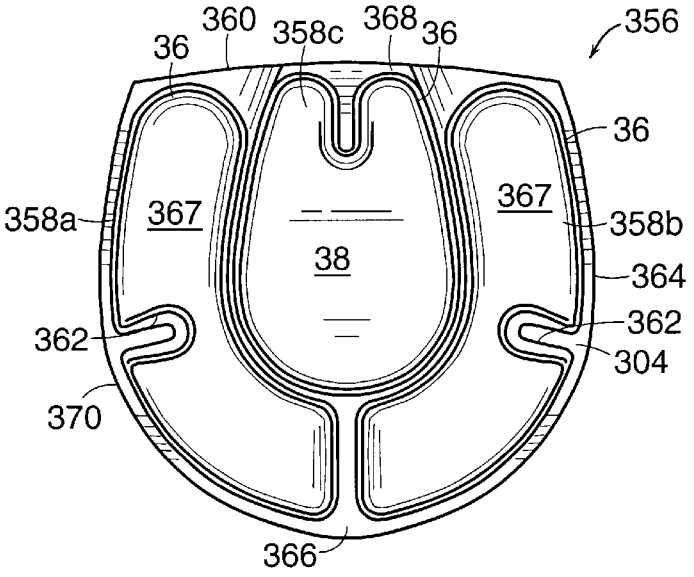
FIG. 10*a* is a bottom view of another embodiment of a 3D deformation element of this invention.
Figure 10B:
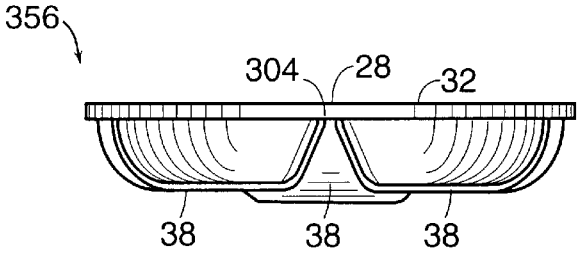
FIG. 10*b* is a front view of the 3D deformation element of FIG. 10*a;*
Figure 10C:
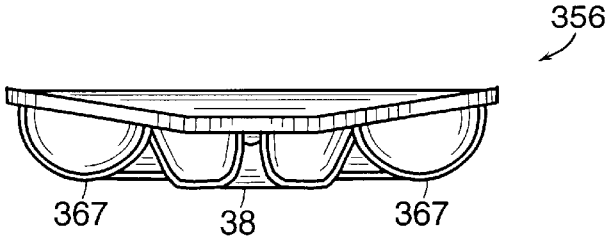
FIG. 10*c* is a back view of the 3D deformation element of FIG. 10*a;*
Figure 10D:
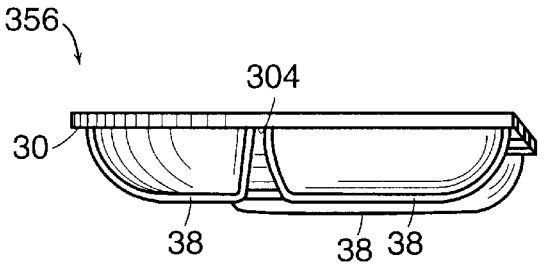
FIG. 10*d* is a side view of the 3D deformation element of FIG. 10*a;*
Figure 11A:
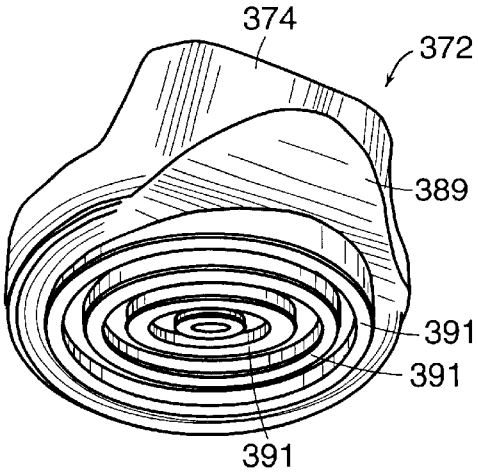
FIG. 11*a* is a perspective view of another embodiment of a 3D deformation element of this invention.
Figure 11B:
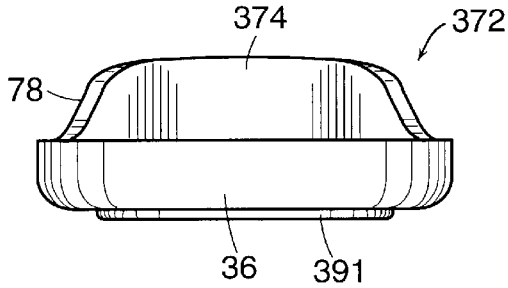
FIG. 11*b* is a back view of the 3D deformation element of FIG. 11*a;*
Figure 11C:
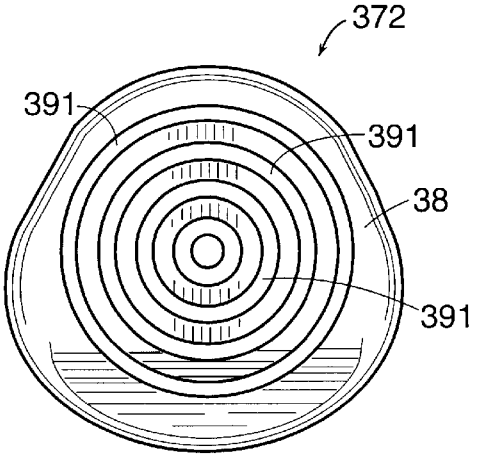
FIG. 11*c* is a bottom view of the 3D deformation element of FIG. 11*a;*
Figure 11D:
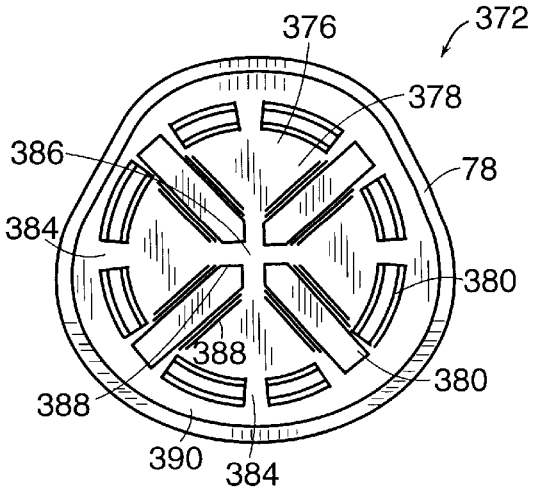
FIG. 11*d* is a top view of the 3D deformation element of FIG. 11*a;*
Figure 11E:
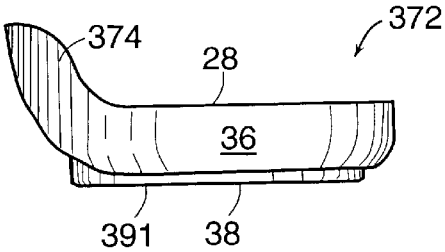
FIG. 11*e* is a side view of the 3D deformation element of FIG. 11*a;*
Figure 11F:
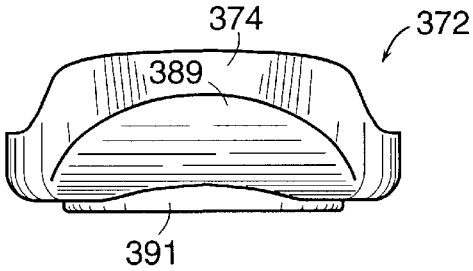
FIG. 11*f* is a front view of the 3D deformation element of FIG. 11*a;*
Figure 12A:
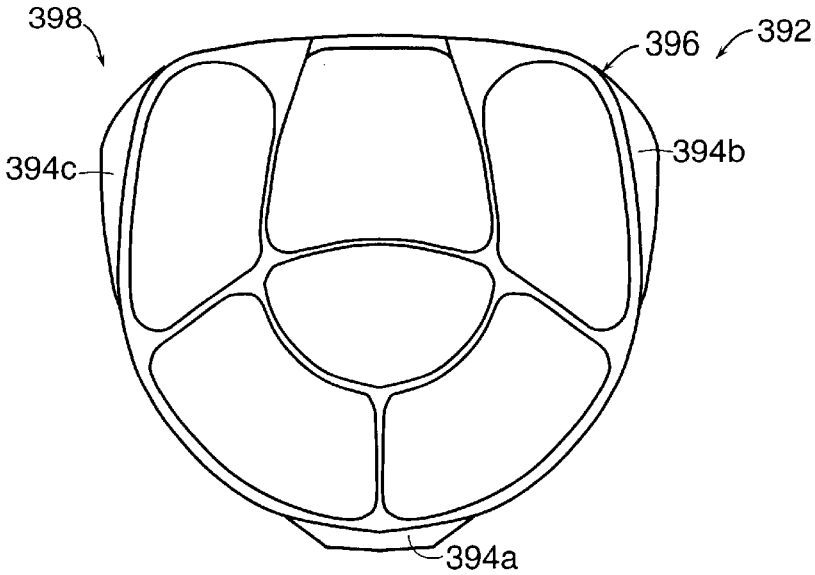
FIG. 12*a* is a bottom view of another embodiment of a 3D deformation element of this invention.
Figure 12B:
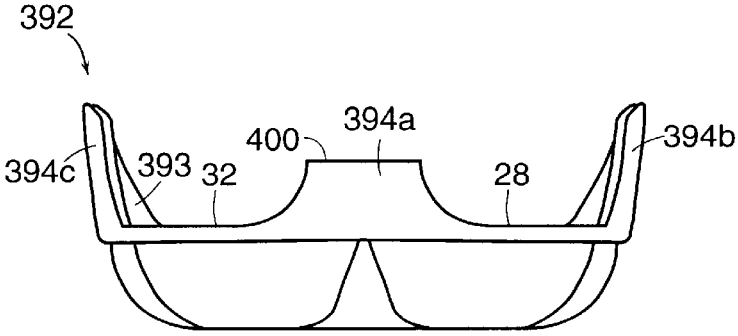
FIG. 12*b* is a front view of the 3D deformation element of FIG. 12*a;*
Figure 12C:
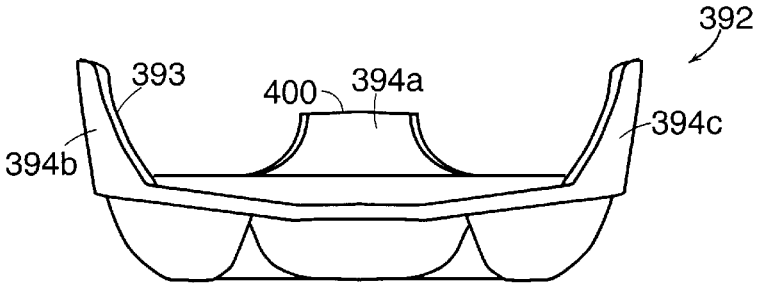
FIG. 12*c* is a back view of the 3D deformation element of FIG. 12*c;*
Figure 12D:
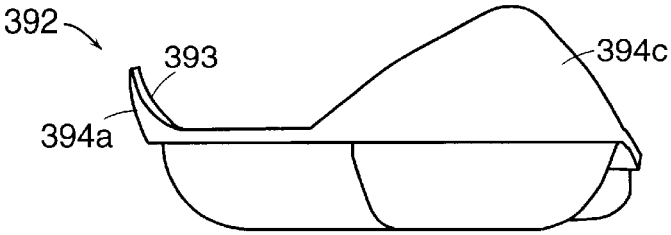
FIG. 12*d* is a side view of the 3D deformation element of FIG. 12*c;*

Looking now at FIGS. 8*a–d*, yet another 3D element 326 of the present invention is shown which also includes a top 28 having a substantially flat top surface 32 for attachably engaging a sole 14. The element 326 also includes a bottom 30 having three chambers 328*a–c* extending from a flat portion 304 of the bottom 30. The chambers 328*a–c* include a continuous sidewall 36, a ground contacting or tread surface 38, and an interior 40. The element 326 is similar in some respects to elements 20*a* and 302*a*, but differs somewhat in the shape of the chambers that extend from the bottom 30 of the element 326. The chamber 328*a* has a general crescent moon shape and has no indentation as does chambers 34*a* and 302*a*. The chamber 328 a has a more or less rectangular cross-section along its heal edge 330, the tread surface 38 slopes slightly toward its toe edge 332 and a toe side portion 334 of the sidewall 36 tappers to the bottom 30. The chambers 328*b–c* are rounded triangularly shaped and have a more or less rectangular traverse cross-section as shown in FIG. 8*d*, while their longitudinal cross-section profile shows rounded outer ends 336 and angled inner ends 338 where the ends make up portions of the sidewall 36 as shown in FIG. 8*c*.

Looking now at FIGS. 9*a–d*, another 3D element 340 of the present invention is shown, which also includes a top 28 having a substantially flat top surface 32 for attachably engaging a sole 14. The element 340 also includes a bottom 30 having a single chamber 342 extending from a flat portion 304 of the bottom 30. The chamber 342 include a continuous sidewall 36, a ground contacting or tread surface 38, and an interior 40. The chamber 342 includes three indentations 344 and two tread inserts 346. The chamber 342 is generally semi-circular in shape with a toe side indentation 348 as well. The elements 342 can be seen to have rounded sidewall portions 351 associated with its heel contour edge 350, and angled sidewall portions 352 in the toe portion 354 of the sidewall 36 and associated with indentations 348.

Looking now at FIGS. 10*a–d*, an other 3D element 356 of the present invention is shown, which also includes a top 28 having a substantially flat top surface 32 for attachably engaging a sole 14. The element 356 also includes a bottom 30 having three chambers 358*a–c* extending from a flat portion 304 of the bottom 30. The chambers 358*a–c* include a continuous sidewall 36, a ground contacting or tread surface 38, and an interior 40. The element 356 is generally U-shaped and tapers at its toe side 360. Each chamber 358*a–c* has one indentation 362 associated therewith. Two of the chambers 358*a–b* are associated with the outer contour 364 of the element 356 and following the heel contour of the shoe and are divided at a mid-point 366 of the element 356. The final chamber 358*c* is shaped similar to the element itself, but has its indentation 362 associated with its toe side edge 368 The elements 358*a–b* are elongate and curved with their indentation 362 at or near a center region 370 of the chamber on its outer edge. The chambers 358*a–b* are generally rounded with a rounded tread surface 367, while the inner chamber 358*c* is more trapezoidal shaped in cross-section. The inner chamber 358*c* can be the same height as the outer elements 358*a–b*, but can also have a greater height than the outer elements 358*a–b*. The sidewalls can be seen to be angled at chamber gaps by an angle of about 60°, while most of the other sidewall portions are rounded.

Looking now at FIGS. 11*a–f*, a 3D element 372 having a wrap-up lip 374 of the present invention is shown, which includes a top 28 made up of tops 376 of solid internal members 378 that are separated by deformation grooves 380. The combination top 28 is of course designed to attachably engaging the sole 14. The element 372 also includes a cover 78 of a wear resistant rubber including a continuous sidewall 36 and a ground contacting or tread surface 38. The internal members are connected to each other by tabs 384 that meet at a cross 386 in a central region 388 of the element 372. The grooves 380 are between about 1 mm and about 5 mm in width and extend about ¾ of the height of the element. The element 372 also includes an internal member 390 that follows the cover 78 and extends from the cover about 1 mm to about 5 mm. The lip 374 is designed to extend above the sole and attach to or be integrated into the upper. The element 372 also includes an angled sidewall portion 389 and circular thread profiling 391.

Looking now at FIGS. 12*a–d*, another 3D element 392 of the present invention including three wrap-up lips 394*a–c* is shown, which also includes a top 28 having a substantially flat top surface 32 and inner surface 393 of the lips 394 for attachably engaging a sole 14. The element 392 is similar to the element 118*a* and will not be further described here. The lips 394*b–c* are designed to extend above the sole and attach to or be integrated into the upper at in the heel region of the shoe. One lip 394*a* is centered at the mid-point of the heel while the other two lips 394*b–c* are positioned on the lateral end 396 and medial end 398 of the element 392, respectively. The heel lip 394*a* is trapezoidal in shape and tapered at its top 400, while the medial and lateral end lips 394*b–c* are generally triangularly shaped.

3D Chamber Structure

Figure 13A:
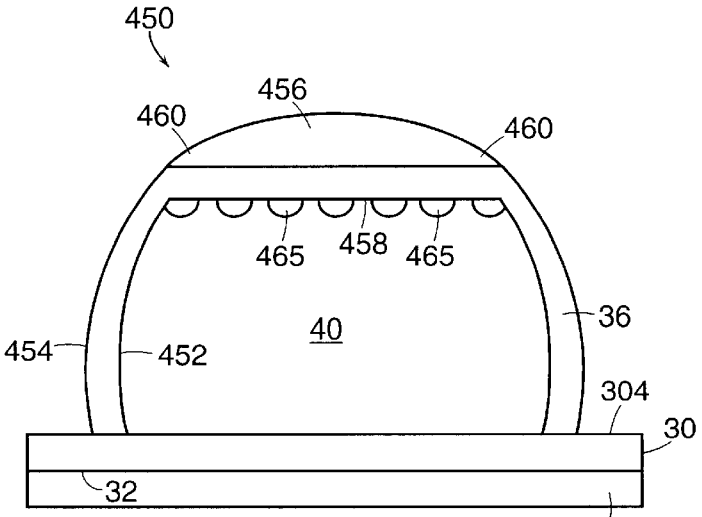
FIG. 13*a* is a cross-sectional view of a chamber structure associated with a 3D deformation element of this invention.

Referring now to FIG. 13*a*, an illustrative chamber 450 is shown including the sidewall 36, which forms an interior surface 452 of the interior 40 of the chamber 450 and an exterior surface 454 of the chamber 450 and extends from the tread cap 456 to the flat portion 304 of the bottom 30. The tread cap 456 is attachably engaged, generally cured to, the sidewall 36 at a crown region 458 of the chamber 450. The tread cap 456 includes a ground contacting surface 38 that can be profiled with lugs or other profiling structures and rounds into the sidewall 36 at ends 460. The tread cap 456 and the sidewall 36 are generally made of different materials, because the physical demands on the components are different. Tread caps are generally made of rubber compounds that either have good wear resistance and good traction, while sidewalls, which undergo less direct wear and much more flexing, are generally made of rubber compounds with high flex fatigue resistance and high oxidation resistance. Sidewall rubber compounds preferably contain natural rubber, polybutadiene rubber, SBR rubber, EPDM or halogenated Isoprene-isobutylene rubber or mixtures thereof Sidewall compounds generally use N-660 and N-550 carbon black fillers and/or clay fillers and a variable cure system that is adapted to the specific polymers being used and used to enhance flex fatigue resistance. Additionally, these compounds usually have fairly high levels of anti-ozonants and anti-oxidants to reduce adverse aging effects. On the other hand, tread cap compounds are generally made from isoprene, butadiene and/or styrene rubbers with natural rubbers, synthetic natural rubber, polybutadiene rubber, isoprene-butadiene copolymer rubbers and styrene, isoprene and/or butadiene containing polymers using a normal to low sulfur-high accelerator cure system (semi-efficient to efficient cure systems).

The tread cap 456 can be attached to the sidewall 36 during blow molding by pre-making the cap 456, placing it in the blow mold so that during molding the sidewall compound will come into physical contact with the tread cap 456 are cure to it during curing. The cap 456 can be made by traditional techniques including, without limitation, blow molding, compression molding, extrusion, or injection molding or RIM. The top 28 is generally made of the same rubber composition as the sidewall.

The top 28 can optionally have a hard flexurally resilient top member 462 affixed to the top surface 32 of the top 28 of the element. The preferred flexurally resilient materials are plastic-rubber blends, plastics or resins that are capable of curing or bonding or otherwise adhering to the rubber compositions making up the element. The member 462 is designed to inhibit the upward distortion of a bottom portion 464 of the interior 40 of the chamber 356 into the sole 14 . In the absence of the member 462, the portion 464 tends to distort upward, under load, decreasing the efficiency of the ground-contacting system 16 and decreasing the extent of horizontal deformation the ground-contacting system undergoes during foot impact.

Additionally, the crown region 458 of the chamber 45 may include re-inforcement interior ribs 465. These ribs are designed to increase the overall stiffness of the tread cap and to provide a more uniform ground-contact surface during foot fall and push off.

Figure 13C:
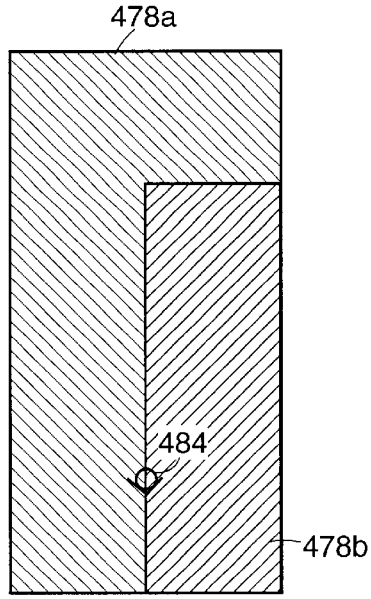
FIG. 13*c* is a top view of an angle between the two belts bottom of the chamber of FIG. 13*b;*
Figure 13B:
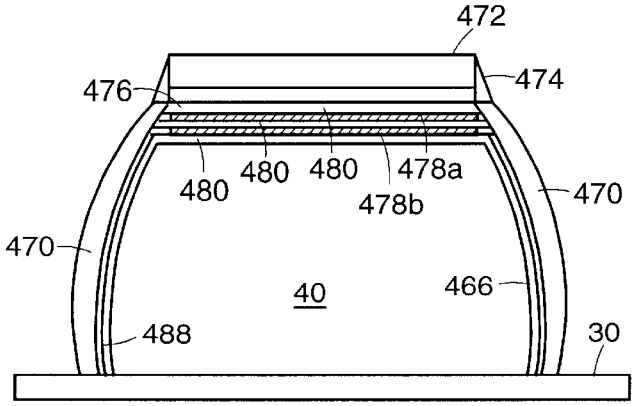
FIG. 13*b* is a cross-sectional view of another chamber associated the 3D deformation element of this invention.

Looking at FIG. 13*b*, a second more detailed chamber structure is shown for the same illustrative chamber 356. This structure includes an interior 40, an inner liner 466, a carcass 468, a sidewall 470, a tread cap 472, an apex 474, a tread base 476, two belts 478*a–b* and associated wire coat layers 480. The two belts 478*a–b* compounds are depicted in the drawing as including wires or fiber bundles 483. Additionally, the two belts 478*a–b* are generally aligned so that the bundles run at an angle 484 to each other as shown in FIG. 13*c*. The angle 484 can range from 0° to 90° with about 15° to about 75° being preferred and about 30° to about 60° being particularly preferred. The belts 478 provide puncture resistance to the chambers, but also increase the stiffness of the tread cap to horizontal and differential vertical deformation. The tread cap 472 has a ground-contacting surface 487 associated therewith that can include profiling, such as lugs, arcs, circles or the like. The carcass 468 may also included a fabric re-inforcement ply 489. The apex 474 is a member that provides a transition between the tread cap 472 and the sidewall 470.

The rubbers useful in wire coat compounds include natural rubber and polyisoprene rubbers and usually uses an inefficient cure system with high sulfur content so that wire adhesion is promoted and silica or low surface carbon black such as N-330 fillers. Tread base compounds usually contain natural rubber, polyisoprene rubbers and polybutadiene rubbers with semi-efficient to efficient cure systems and N-300 or N-550 carbon black fillers. The inner liner is generally made of N-660 and/or clay filled butyl rubber or isoprene-isobutylene copolymers which have low permeability. For a general discussion of rubber compounding, the Vanderbilt Rubber Handbook is referenced and incorporated herein by reference.

Figure 13E:
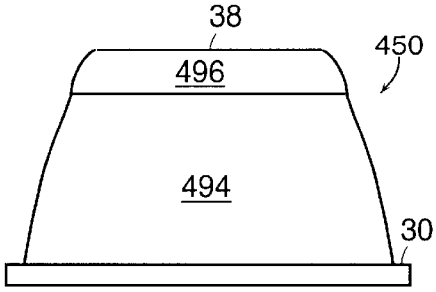
FIG. 13*e* is a cross-section view of another chamber associated with the 3D deformation elements of this invention where the chamber is a three layer construction.
Figure 13D:
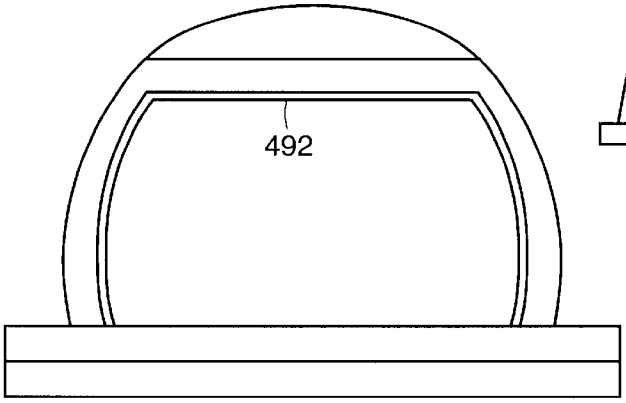
FIG. 13*d* is a cross-section view of another chamber associated with the 3D deformation elements of this invention including an interior insert.

Referring now to FIG. 13*d*, the illustrative chamber of FIG. 13*a* is shown with a chamber interior insert 492. The insert 492 can be fluid filled, a foam, a cross-linked viscoelastic material or the like. If air or gas filled, the insert should be made of a low permeability material and that material should be viscoelastic such as rubber compounds used for tire inner liners. Foam and visco-elastic inserts should be highly deformable so that the chamber responds as if the entire interior was filled with the filling agent. The insert 492 can be used with elements that are not closed at their top to simplify manufacturing of the shoe incorporating such elements.

Looking now at FIG. 13*e*, the chamber 450 includes a hard, flexurally resilient top 28, a soft, highly damping middle 494, and a bottom tread cap 496 having a ground-contacting surface 38 which has a hardness significantly greater than the hardness of the middle 494. The top 28 and tread cap 496 are both layers of a thickness less than the thickness of the soft middle 494. The soft middle 494 is designed to allow the surface 38 to move slightly in the direction of an applied force relative to that part of the top 28 during foot impact and to allow considerable horizontal deformation. The soft middle 494 is also designed to dissipate the energy associated with foot impact horizontally to a greater degree than vertically. Additionally, the amount of deformation of this type of element will be greater horizontally than vertically, because the material is a solid viscoelastic material.

3D Element Run Flat Devices

Figure 14A:
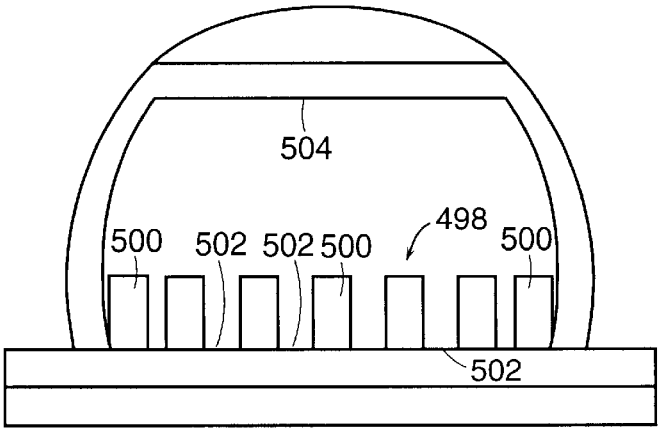
FIG. 14*a* is a cross-section view of yet another chamber structure having a run-flat device.
Figure 14B:
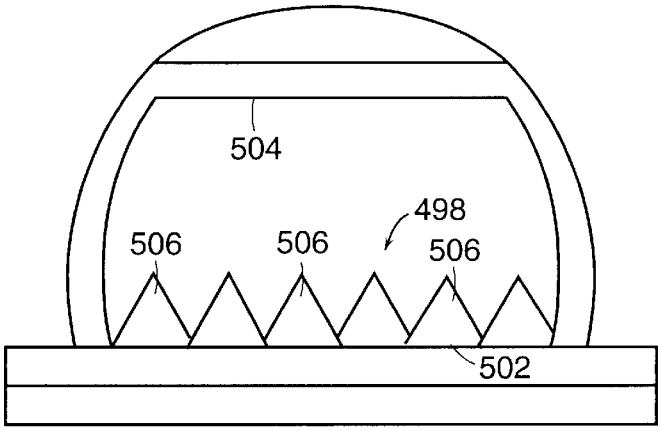
FIG. 14*b* is a cross-sectional view of yet another chamber structure having another run-flat device.
Figure 14C:
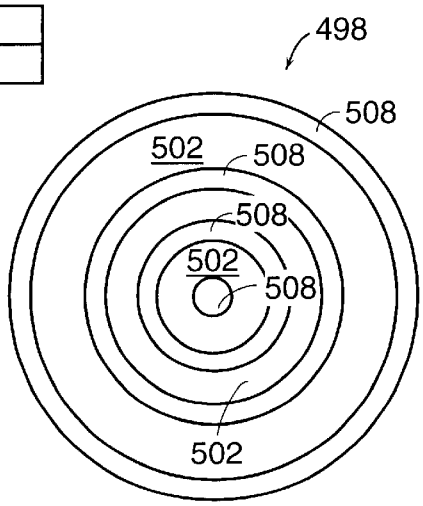
FIG. 14*c* is an inside top view of another run-flat device in a chamber associated with a 3D deformation element of this invention.
Figure 14D:
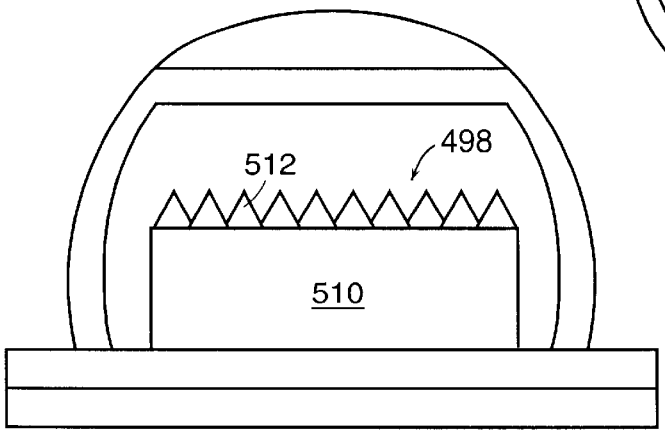
FIG. 14*d* is a cross-sectional view of yet another chamber structure having another run-flat device.

FIGS. 14*a–d* show several different run-flat devices that can be used with the ground-contacting systems of the present inventions. The run-flat devices are generally any means by which the general profile of the element can be maintained until the piece can be repaired are replaced. The run-flat device does not allow the element to function as if it were still fluid filled, but does allow it to perform at some reduced efficiency. In FIG. 14*a*, the device 498 can be seen to comprise a plurality of rectangular ribs 500 extending from a bottom surface 502 toward a top surface 504 of the interior 40. The ribs generally extend from about ¼ the total height of the interior of the element to about ¾ the total height of the interior with about ⅜ to about ⅝ being preferred. In FIG. 14*b*, the device 494 comprises a plurality of triangular ribs 506, while in FIG. 14*c*, the device 494 comprises a plurality of concentric circles 508 shown here looking down. Of course, the circles would be inside the interior 40 of the chamber 450. In FIG. 14*d*, the device 494 is a single structured member 510 having ribs 512 extending therefrom. Of course, any other device will work as well.

Open Chambered 3D Elements and Their Attachment to a Sole

Figure 15A:
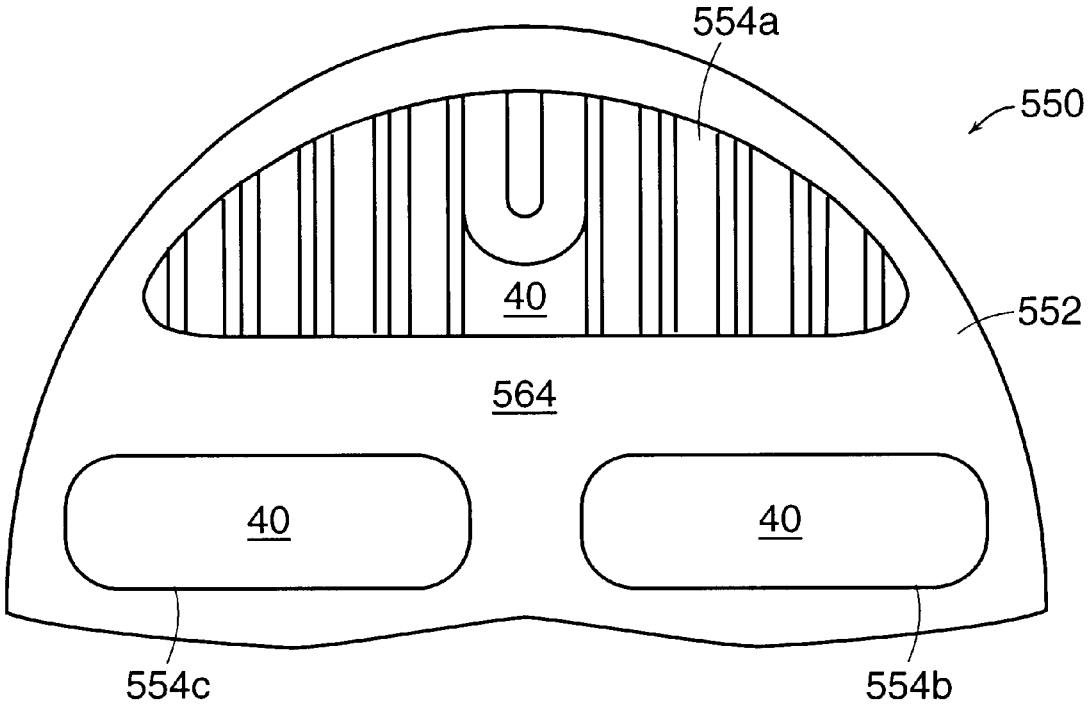
FIG. 15*a* is a top view of another embodiment of a 3D deformation element of this invention.
Figure 15B:
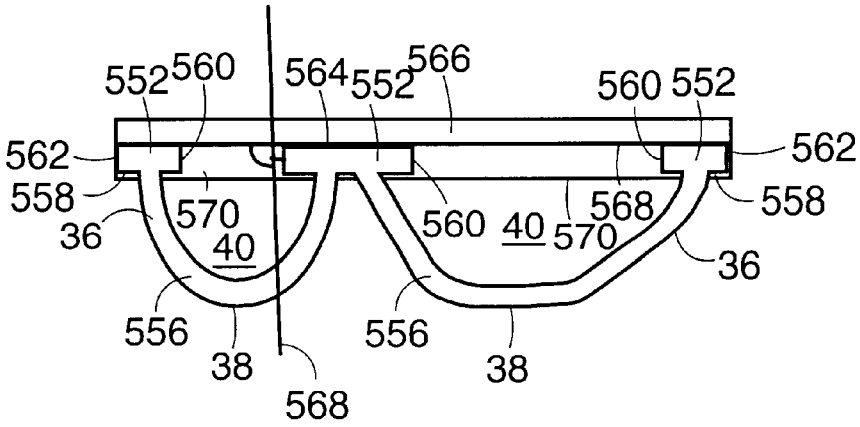
FIG. 15*b* is a cross-sectional view of the 3D deformation element of FIG. 15*a;*

Referring now to FIGS. 15*a–b*, yet another type 3D element 550 of the present invention is shown, which has chambers that are open and unfilled with a visco-elastic material. The element 550 does include bottom tabs 552 and three unclosed chambers 554*a–c* where the chambers are similar in shape and location to the chambers 20*a–c* of FIG. 1. The chambers 554 include a tread cap 556 having a tread or ground-contacting surface 38 that may be profiled, a continuous sidewall 36 extending from a bottom portion 558 of the tabs 552 to the tread cap 556 and an interior 40 that is not closed on its top.

The retention tabs 552 have interior ends 560 and exterior ends 562. The element 550 does not include a top 28 having a substantially flat top surface 32; in fact, the top 28 of the element 550 comprises only top surfaces 564 of the retention tabs 552 of the element 550. The tabs 552 are the means for attaching the open chambered elements to a top member that can be the sole 14 itself or a top member 566 that is essentially equivalent to top member 462, which attaches to the sole 14.

Attachment of the Elements to the Sole

Closed chamber, visco-elastic filled chamber and open chamber elements can all be attachably engaged to the sole or to a top member that can then be attached to the sole by a variety of methodologies. The elements can be adhesively affixed, integrally affixed, or mechanically affixed to the sole or to a top member that is then attached to the sole.

For adhesively affixing the 3D elements of the present invention to a sole, the top or top member is simply bonded to the sole using any conventional adhesive system well known in the art that securely affix the element to the sole or top member and hermetically seal the associated chambers in the case of open chambers.

One procedure for integrally affixing the element 550 to a sole or top member is to cure or thermally set the member into a suitable plastic, rubber, or plastic-rubber composition. Thus, after the element 550 is made by compression or injection molding techniques as is well known in the art, the element 550 can be pushed into an uncured rubber or rubber-plastic composition or unset thermal setting resin composition in a mold until the tabs 552 are embedded in the composition in the mold. The composition in the mold is then thermally set or cured, locking the tabs 552 in place and forming the completed structure so that after curing or setting the element 550 is integrated into the formed top member 566. The chambers 554 can be filled with a gas, liquid, fluid, or foam during the thermal setting process by use of a heated needle inserted into the interior 40 of the chambers 554 or the chambers 554 can be equipped with a sealable insertion system 492 as described previously. If the composition is a rubber or rubber-plastic composition, then the element 550 can be in an uncured, a partially cured, or a fully cured state so that the tab material can co-cure with the composition. The top 566 can attach directly to the top surfaces 564 of the tabs 552 (which is actually just a continuous tab or flange associated with the chambers) or it can extend into the interior 40 of the chambers to lines 570. The lines 570 can extend into the interior 40 of the chambers by any desired amount provided the chamber characteristics are not impaired, but generally, the lines 470 should extend only enough to securely hold the open chambered element.

Alternatively for integral affixing, the element 550 can simply be co-cured to the top member 566 where the top member 566 is co-curable to the composition making up the tabs 552 of the element 550 as is well known in the art. In either process, the chambers 554 become closed during the sealing process with portions 568 of the top member 566 forming chamber tops.

For mechanically affixing the 3D elements of the present invention to either a sole or a top member, there are a number of different means that can be employed so that the elements are detactably engaged to the sole. The ability to make elements that are detactably engaged to the sole allows for replacement of damaged elements or an element with different 3D deformation characteristics can be swapped augmenting the performance of the shoe. Several mechanical attachment protocols will be described herein; however, it should be recognized at any similar mechanical affixing means can be used, provided that the open chambers are hermetically sealed if inserts are not used.

Rubber Compound and Mixing Technology

The present invention is directed to articles made of rubber compounds that generally include 100 phr of one or more curable elastomers, from about 10 to about 200 phr of one or more fillers, from about 0 to about 50 phr of one or more extender oils, from about 0 to about 10 phr of an anti-degradant package, from about 0 phr to about 10 phr of one or more isl situ methylene donor—methylene acceptor resin systems, from about 0 phr to about 5 phr of one or more organic acids, from about 0 phr to about 10 phr of one or more waxes, from about 0 phr to about 10 phr of one or more metal oxide cure activators, and from about 0.1 to about 10 phr of a cure package.

The rubber compositions used to make the 3D deformation elements of the present invention can be prepared according to well known rubber compounding mix, molding and curing procedures. Generally, the components, absent the cure package, are mixed in one or more non-productive mix steps at an elevated temperature, generally between about 250° F. and 400° F., for a time sufficient to achieve complete mastication (mixing) of the components. Generally, the mixing is performed in an internal mixer such as a Bradbury™ type internal mixer. However, the components can also be mill mixed. The mixing time for an internal mixer is generally between about 30 seconds to about 5 minutes. Of course, shorter and longer times can be used depending on the elastomers and fillers used and the final product desired.

Thus, 100 phr of one or more vulcanizable elastomers, from about 50 to about 100 phr of one or more fillers, from about 0 to about 5 phr of one or more waxes, from about 0 to about 50 phr of one or more extender oils, and, optionally, from about 0 to about 10 phr of an anti-degradant package and from about 0 phr to about 10 phr of in situ methylene donor—methylene acceptor resin system, are added into an internal mixer for a period from about 30 seconds to about 5 minutes to yield a non-productive composition. The temperature of the non-productive mix step is generally controlled by the heat generated during the mastication of the elastomer and generally ranges between 250° F. and 400° F. at the peak temperature. Peak temperatures much higher than 400° F. can result in harm to the elastomers and concurrent loss in final cure properties.

The non-productive composition can also be prepared in multiple non-productive mix steps. When multi-step non-productive mixing is desired, the elastomer, a portion of the fillers, and a portion of the oils are generally pre-mixed to "break" the elastomer down and lower its mix viscosity. Such a break-down step is more commonly performed in rubber compounds containing large amounts of natural rubber as the elastomer. The first non-productive mix step is then followed by a second non-productive mix step where the remaining non-productive components are added to the composition. Both mix steps, or additional steps if desired, are carried out under fairly standard non-productive mix conditions as described above.

For mill mixing, the times, temperatures, and procedures for adding the ingredients to the elastomer are much more variable and depend on the number of mill steps, etc. However, one of ordinary skill in the art would be able to mill mix the composition used to make the ground contacting systems of the present invention.

Once the non-productive composition has been formed and mixed according to the above procedure, the non-productive composition and the cure package are mixed together in one or more productive mix steps. The productive mix steps are generally run at lower temperatures compared to the non-productive mix steps. Because the cure package is activated by elevated temperatures and the amount of heat history imparted to the productive composition, the productive mix steps must be performed in such a way that the amount of heat input into the composition is not sufficient to promote the onset of vulcanization. If the productive mix step or steps exceed this heat history threshold, the compound can "scorch" during mixing, i.e., the compound prematurely vulcanizes.

Generally, the productive mix steps are carried out at temperatures between about 150° F. and 275° F. However, lower and higher temperatures can be used provided the total amount of heat input into the system is less than that required to result in compound scorch. Again, the mix time depends on the type of mix equipment used, but generally ranges from about 30 seconds to about 5 minutes provided the time and temperature of the productive mix profile does not exceed the cure package scorch profile.

Of course, one of ordinary skill in the art will recognize that compound scorch and therefore, the time-temperature tolerance of a compound during productive mixing is dependent on the elastomers, the fillers, and the cure package used in the compositions. (Oils and waxes generally have only a relatively small impact on the ultimate cure properties of a compound including its scorch properties.) Scorch can be controlled to some extent through the addition of so-called "inhibitors" which delay the on-set of vulcanization, such inhibitors are well known in the rubber art and can be purchased from companies such as Monsanto and others.

Additionally, the anti-degradant package can be added during the non-productive mix protocol or the productive mix protocol or both. Generally, a portion of the anti-degradant package should be added to the non-productive mix protocol to ensure protection of the non-productive composition before it is combined with the cure package.

Masterbatches of the elastomers and oils and optionally fillers, the anti-degradant package and the resin system is a convenient method for reducing manufacturing cost. The masterbatch can be prepared by using conventional internal type mixers, such as a Bradbury™ type internal mixer or an extruder, or an open mill or mill train (dry mixing). Typically, a masterbatch will have much higher loadings of fillers and/or oils than that found in normal or conventional rubber compounds. However, the masterbatch can also be simply the non-productive composition made in bulk at one location and transported to the manufacturing facility for productive mixing. When the masterbatch is to be used as an ingredient in a final rubber composition, it can be used in any amount and the amount used is generally dictated by the properties desired as well as the cure systems used and nature of the final rubber article.

Additionally, the compositions useful in making the viscoelastic material that can be used to fill the entire chambers of the 3D deformation elements of the present invention are either highly damping elastomers such as butyl rubber (polyisobutylene and polyisobutylene-isoprene copolymers) or so-called oil extended elastomers. The oil extended elastomers can be prepared either by mixing the oil and elastomer together in an internal mixer as previously stated or the oil can be added to the elastomer in solution, emulsion, or latex. Oil extended elastomers are generally highly plastized systems that have high hysteresis and high mechanical force to heat conversion. The conversion of mechanical force into heat, of course, is one energy dissipation mechanism. While, rebound (mechanical energy storage and return) is another energy dissipation mechanism that is generally associated with rubber compositions that have low hysteric losses and are more resilient.

The waxes suitable for use in making the articles of this invention include, without limitation: animal waxes, such a aspermaceti, beeswax, Chinese wax and the like; vegetable waxes, such as slack waxes, carnauba, Japan bayberry, candelilla and the like; mineral waxes, such as ozocerite, montan, ceresin, paraffin and the like; synthetic waxes, such as medium weight polyethylene, polyethylene glycols or polypropylene glycols, chloronaphthalenes, sorbitols, chlorotrifluorethylene resins, and the like.

The elastomers suitable for use in making the articles of the present invention include all classes of elastomers generally used to make rubber articles including diene elastomers, vinyl elastomers, vinyl-diene polymers having at least one vinyl monomer and at least one diene elastomer in the polymer, highly saturated, moderate unsaturated and highly unsaturated elastomers or any combination, mixture, analog or grafted variant of these elastomers.

Suitable highly saturated elastomers for use in the present invention include unsaturated ternary copolymers of ethylene, propylene, and a copolymerizable non-conjugated diene ("EPDM"), such as bridged ring dienes including dicyclopentadiene, methylene norbornene, ethylidene norbomene, butenyl norbornene, or other cyclic polymers such as tetrahydroindenes, methyl- or ethyl-norbornadiene and the like, as well as straight-chained non-conjugated diolefins including pentadienes, hexadienes, heptadienes, octadienes, and the like. The ethylene to propylene weight ratio may range from 20:80 to 80:20, the preferred range being from 70:30 to 40:60. The diene, if used, usually amounts to from about 3 to 20% by weight of the terpolymer.

Elastomers suitable for use in the present invention include conventional rubbers or elastomers such as natural rubber and all its various raw and reclaimed forms as well as various synthetic unsaturated or partially unsaturated elastomers, i.e., rubber polymers of the type that may be vulcanized with sulfur. Representative of synthetic polymers include, without limitation, homopolymerization products of butadiene and its homologues and derivatives. For example, isoprene, dimethylbutadiene and pentadiene may be used, as well as copolymers such as those formed form a butadiene or its homologues or derivatives with other unsaturated organic compounds.

Among the latter unsaturated organic compounds are olefins, for example, ethylene, propylene, or isobutylene, which copolymerizes with isoprene to form polyisobutylene also know as butyl rubber; vinyl compounds, for example, vinyl chloride, acrylic acid, acrylonitrile (which polymerizes with butadiene to form NBR), methacrylonitrile, methacrylic acid, alpha-methylstyrene and styrene, the latter compound polymerizing with butadiene to form SBR, as well as vinyl esters and various unsaturated aldehydes, ketones and ethers, e.g acrolein and vinyl ethyl ether. Also included are the various synthetic rubbers prepared from the homopolymerization of isoprene and the copolymerization of isoprene with other diolefins and various unsaturated organic compounds. Also included are the synthetic rubbers such as cis-1,4-polybutadiene and cis-1,4-polyisoprene. The term also includes arene-conjugated diene copolymers such as styrene-butadiene copolymers, styrene-isoprene copolymers, styrene-butadiene-isoprene terpolymers, butadiene copolymers with substituted styrenes, isoprene copolymers with substituted styrenes, butadiene and isoprene terpolymers with substituted styrenes, styrene and substituted styrene copolymers with butadiene, isoprene, 2,3-dimethylbutadiene, styrene-butadiene-4-vinylpryidine terpolymers, styrene-isoprene-4-vinylpryidine terpolymers, styrene-butadiene-isoprene-4-vinylpryidine copolymers, and mixtures thereof.

Such recently developed rubbers include those that have polymer bound functionalities such as antioxidants and antiozonants. These polymer bound materials are know in the art and can have functionalities that provide antidegradative properties, synergism, and other properties.

The preferred diene containing polymers for use in the present invention include natural rubber, polybutadiene, synthetic polyisoprene, styrene/butadiene copolymers, isoprene/butadiene, NBR, terpolymers of acrylonitrile, butadiene, styrene, and blends thereof.

In addition to the highly saturated elastomers mentioned previously, more recent highly saturated elastomers are also suitable for use in the present invention. These new highly saturated elastomers include, without limitation, hydrogenated diene containing elastomers. The hydrogenation is intended to reduce the amount of unsaturation in the diene containing elastomers that improve the elastomers resistance to ozone and oxygen attack. Of course, the hydrogenation cannot be so complete as to render the elastomer incapable of being vulcanized using standard sulfur vulcanization agents well known in the art. Preferred hydrogenated diene containing elastomers include any of the diene containing elastomers described above where the remaining unsaturation is at least 35% of the original unsaturation, preferable at least about 25% of the original unsaturation with at least about 15% of the original unsaturation being particularly preferred. The hydrogenation of the diene containing elastomers can be performed by hydrogenation techniques well known in the art.

The extender oils suitable for use in this invention include, without limitation, aromatic, paraffinic, and naphthenic extender oils. Extender oils are commonly used in rubber compounding to plasticize the rubber and reduce mixing time and cost and to lower the compound cost.

Fillers suitable for use in the present invention include, without limitation, aramide fibers, carbon fibers, boron nitride fibers, glass fibers, carboneous fibers, carbon blacks, fumed silicas, clays, silicas, and mixtures thereof The carbon blacks, silicas, and clays can be of any type known in the art and are selected for the particular use to which the composition will be put.

The rubber compositions useful in preparing the articles of the present invention may also contain in situ generated methylene donor-methylene acceptor (e.g., resorcinol formaldehyde) resin (in the vulcanized rubber/textile matrix) by compounding a vulcanizing rubber stock composition with the phenol/formaldehyde condensation product (hereinafter referred to as the "in siitu method"). The components of the condensation product consist of a methylene acceptor and a methylene donor. The most common methylene donors include N-(substituted oxymethyl) melamine, hexamethylenetetramine and hexamethoxymethylmelamine. A common methylene acceptor is a dihydroxybenzene compound such as resorcinol ro resorcinol ester. A resorcinol-formaldehyde resin of this type is know to promote adhesion to reinforcing cords (e.g., brass coated steel or polyester) and is more fully described in U.S. Pat. Nos. 3,517,722 and 4,605,696 incorporated herein by reference.

The cure systems suitable for making the 3D deformation elements of the present invention are generally sulfur based, but any other cure system can be used as well. The amount of sulfur vulcanizing agent or mixture thereof will vary depending on the type of rubber and the particular type of sulfur vulcanizing agent that is used. Generally speaking, the amount of sulfur vulcanizing agent ranges from about 0.1 to about 10 phr with the range of from about 0.5 to about 7 being preferred.

In addition to the above, other rubber additives may be incorporated in the sulfur vulcanizable material. The additives commonly used in rubber vulcanizates are, for example, carbon black, silica, tackifier resins, processing aids, antioxidants, antiozonants, stearic acid, activators, waxes, oils and peptizing agents. As known to those skilled in the art, depending on the intended use of the sulfur vulcanizable material, certain additives mentioned above are commonly used in conventional amounts.

One of ordinary skill should also recognize that one can add additional components to the formulation such as, but not limited to: tackifier resins from about 0 phr to about 20 phr; processing aids from about 1 phr to about 10 phr; antioxidants from about 1 phr to about 10 phr; antiozonants from about 1 phr to about 10 phr; stearic acid from about 0.1 phr to about 4 phr; zinc oxide from about 2 phr to about 10 phr; waxes from about 1 phr to about 5 phr; oils from about 5 phr to about 30 phr; peptizers from about 0.1 phr to about 1 phr; silica from about 5 phr to about 25 phr; and retarder from about 0.05 phr to about 1.0 phr. The presence and relative amounts of the above additives are not an aspect of the present invention and can be added at any desired level for a particular application.

Accelerators may be used to control the time and/or temperature required for vulcanization and to improve the properties of the vulcanizate. In some instances, a single accelerator system may be used, i.e., primary accelerator. Conventionally, a primary accelerator is used in amounts ranging from about 0.5 phr to about 2.0 phr. Combinations for two or more accelerators may also be used at appropriate levels to accelerate vulcanization. Such combinations are known to be synergistic under appropriate conditions and one of ordinary skill in the art would recognize when their use would be advantageous and at what levels.

Suitable types of accelerators that may be used include amines, disulfides, guanidines, thioureas, thiazoles, thiurams, sulfenamides, dithiocarbamates, and xanthates.

Preferably, the primary accelerator is a sulfenamide. If a secondary accelerator is used, the secondary accelerator is preferably a guanidine, dithiocarbamate, or thiuram compound.

Conventional rubber compounding techniques can be used to form compositions according to his invention. For example, rubber and desired additives (typically all except the accelerators and optionally zinc oxide) can be mixed together in a first mixing stage to form a masterbatch, and the accelerator(s) and zinc oxide (if not added previously) can be added in a second mixing stage to form a production mix, which is formed into the desired uncured rubber article or tire component.

Vulcanization of the rubbers containing the fatty acid deactivating metal oxides of the present invention may be conducted at conventional temperatures used for vulcanizable materials. For example, temperatures may range form about 100° C. to 200° C. Preferable, the vulcanization is conducted at temperatures ranging from about 110° C. to 180° C. Any of the usual vulcanization processes may be used, such as heating in a press mold, heating with superheated steam or hot air or in a salt bath.

Physical Properties of Constituent Parts of 3D Elements

For elements that include gas filled or compressible fluid filled chambers, the chambers should have both high shock absorbing characteristics and high deformation characteristics (vertical and horizontal). The sidewall thickness should be between about 1 mm and about 5 mm or more with thicknesses between about 2 mm and about 5 mm being preferred. The ground-contacting member should be between about 1 mm and about 6 mm or more thick with thicknesses between about 2 mm and about 5 mm being preferred. The ground-contacting member can also have a tread cap associated therewith with or without profiling. The tread cap can be between about 1 mm and about 5 mm with a thickness of between about 1 mm and about 3 mm being preferred.

Figure 30:
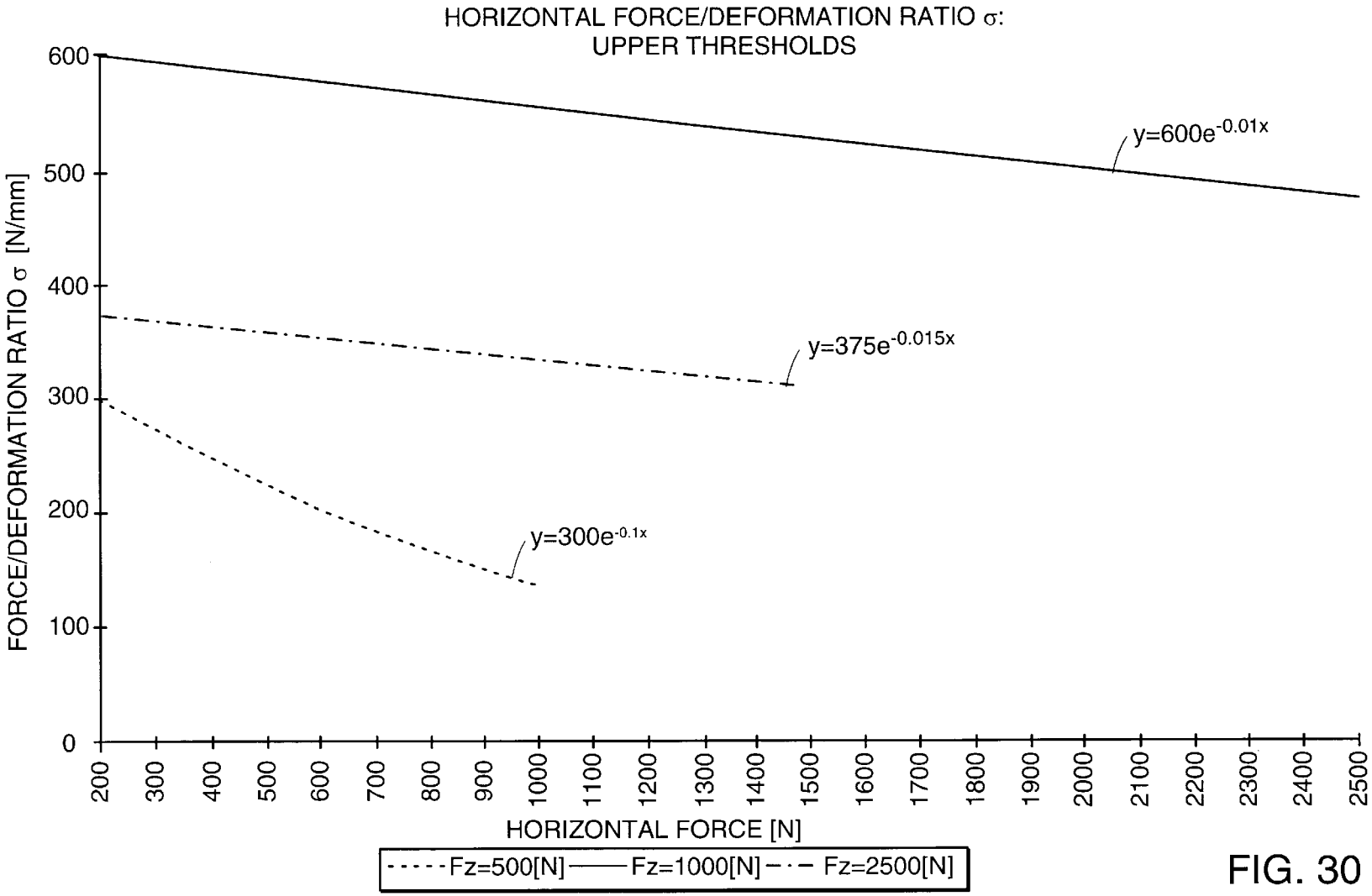
FIG. 30 is a plot of the force induced deformation of the 3D deformation elements of the present invention at three different static vertical forces.

The lower curve of FIG. 30 represents the horizontal deformation characteristic of the 3D elements of the present invention at a fairly low vertical applied force of 500N. In this low vertical force response, the horizontal forces that are attainable are less than the horizontal force that would result in a loss of traction between the ground and the ground contacting surfaces of the shoe. The curve plots the response verse horizontal force on the x-axis and horizontal force/deformation ratio σ on the y-axis.

The element chamber (gas filled, visco-elastic filled or combination filled) should have vertical deformation preferably about 40% higher than conventional rubber-EVA cushioning structures and preferably 50% or more higher for vertical forces between about 200N and about 3,000N. As the vertical force continues to rise, the difference between the vertical deformation of 3D elements of this invention and traditional rubber-EVA structures decreases so that the 3D elements do not contribute to shoe instability in response to large verticals forces, i.e., forces greater than about 5,000N. Thus, the 3D elements of this invention will undergo greater vertical displacement than traditional rubber-EVA structures for forces experienced in most human activities. Such increased vertical deformation tendencies improve cushioning and reduces peak force transference three dimensionally.

The 3D deformation elements of the present invention should have minimum total horizontal displacements for proper function in a sole including the ground-contacting system of the present invention. These minimum total horizontal displacement characateristic are best described graphically as shown in FIG. 30. FIG. 30 shows three curves of minimal horizontal deformation characteristic for the 3D elements of this invention at three value of fixed vertical force: $F_z$=500N; $F_z$=1,000N; and $F_z$=2,500N. The curves in FIG. 30 are response profiles of force in Newtons (N) per amount of displacement in millimeters (mm) plotted against the total applied horizontal force. The lower curve can be represented by formula (I)

$$y=300\ e^{-0.1x} \tag{I}$$

where y is in force/deformation (N/mm) units and represents the characteristics of the elements at a relatively low vertical force of 500N. The plot extends over the servicable magnitudes of horizontal force. Higher horizontal forces would result in traction failures or stick-slip behavior at the contact surfaces of the element. Looking at 200N, the lower curve starts at a y value of 300 which means that the minimum horizontal displacement should be about 0.6667 mm, i.e., 200 (N)/300 (N/mm), and at 1,000N, the minimum horizontal displacement should be about 7.5 mm.

At a vertical force of 1,000N, the horizontal deformation response characteristics of the 3D deformation elements are given by formula (II):

$$y=375\ e^{-0.015x} \tag{II}$$

Again, this formula describes the minimum horizontal deformation characteristics of the 3D deformation elements of this invention at a vertical applied force of about 1,000N. This formula adequately describes the element behavior over a range of horizontal forces from about 200N to about 1,500N.

At a vertical force of 2,500N, the minimal horizontal deformation response characteristics of the 3D deformation elements are given by formula (III):

$$y=600\ e^{-0.01x} \tag{III}$$

This formula adequately describes the element behavior over a range of horizontal forces between 200N and 2,500N. Of course, the horizontal response characteristics or the 3D elements of this invention at different vertical forces would be a curve within the family of curves represented by the formulas (I)–(III) so that the response would actually smoothly transition between formula (I)–(III).

The following table lists the force/deformation vs. force values derived from formulas (I)–(III).

TABLE 1

| Fh | σ for Fz = 500N | Δh (mm) | σ for Fz = 1000N | Δh (mm) | σ for Fz = 2500N | Δh (mm) |
|---|---|---|---|---|---|---|
| 200 | 300 | 0.666667 | 600 | 0.333333 | 375 | 0.533333 |
| 300 | 271 | 1.107011 | 594 | 0.505051 | 369 | 0.813008 |
| 400 | 246 | 1.626016 | 588 | 0.680272 | 364 | 1.098901 |
| 500 | 222 | 2.252252 | 582 | 0.859107 | 358 | 1.396648 |
| 600 | 201 | 2.985075 | 576 | 1.041667 | 353 | 1.699717 |
| 700 | 182 | 3.846154 | 571 | 1.225919 | 348 | 2.011494 |
| 800 | 165 | 4.848485 | 565 | 1.415929 | 343 | 2.332362 |
| 900 | 149 | 6.040268 | 559 | 1.610018 | 338 | 2.662722 |
| 1000 | 135 | 7.407407 | 554 | 1.805054 | 333 | 3.003003 |
| 1100 | | | 548 | 2.007299 | 328 | 3.353659 |
| 1200 | | | 543 | 2.209945 | 323 | 3.71517 |

TABLE 1-continued

| Fh | σ for Fz = 500N | Δh (mm) | σ for Fz = 1000N | Δh (mm) | σ for Fz = 2500N | Δh (mm) |
|---|---|---|---|---|---|---|
| 1300 | | | 538 | 2.416357 | 318 | |
| 1400 | | | 532 | 2.631579 | 313 | |
| 1500 | | | 527 | 2.8463 | 309 | |
| 1600 | | | 522 | 3.065134 | | |
| 1700 | | | 516 | 3.294574 | | |
| 1800 | | | 511 | 3.522505 | | |
| 1900 | | | 506 | 3.754941 | | |
| 2000 | | | 501 | 3.992016 | | |
| 2100 | | | 496 | 4.233871 | | |
| 2200 | | | 491 | 4.480652 | | |
| 2300 | | | 486 | 4.73251 | | |
| 2400 | | | 481 | 4.989605 | | |
| 2500 | | | 477 | 5.197505 | | |

where Fh is the horizontal force and σ is the force/deformation ratio.

Thus, the 3D elements of the present invention can be seen to stiffen at high vertical forces thereby allowing for greater deformation during the early events surrounding foot impact when forces are smallest and continually increasing resistance to deformation as the force builds as that traction is maintained while force transference and joint moments are reduced, because of the horizontal deflection. It is this characteristic of the 3D elements of this invention as expressed by the minimum horizontal deformation responses shown in FIG. 30 and Table 1 that makes the elements of this invention unique over any other cushioning system. Of course, it should be recognized that the elements of this invention can be tuned to a specific type of sports activity and to a particular type of footwear.

The outer rubber cover for an element containing solid visco-elastic member in their interior is preferably made of rubber compounds having the following material properties:

| | | |
|---|---|---|
| DIN 53505 | Hardness (Shore A) | about 50 to 100 |
| DIN 53479 | Density (g/cm$^3$) | about 1.10 to about 1.30 |
| DIN 53516 | Abrasion test plate | maximum about 100 |
| DIN 53516 | Abrasion molded part (mm$^3$) | maximum about 110 |
| DIN 53512 | Elasticity (%) | minimum 45 |
| DIN 53507-A | Tear Strength (N/mm) | minimum 12 |
| DIN 53504 | Tensile Strength (N/mm$^2$) | minimum about 12 |
| DIN 53504 | Breaking Elongation (%) | minimum about 500 |
| DIN 53357 | Cementation to Rubber (N/cm) | minimum about 40 |
| DIN 53357 (50° C./7 fd) | Cementation to Rubber after Aging N/cm | minimum about 40 |
| UV/12 hours | Light Fastness ( ) | minimum about 4 |
| | Color Test on Paper | no chalking |

Elements that undergo greater horizontal displacement as compared to vertical displacement are intended to be preferentially associated with the forefoot region of the sole.

One preferred viscoelastic material useful as a filling material for the interior of the elements of the ground-contacting system of the present invention is a composition described in EPO Publication No. 0 653 464 A2 to Imai et al. assigned to Bridgestone Corporation, incorporated therein by reference and excerpts of which are included below.

Excerpts From EPO 0 653 464 A2

In order to achieve the above-described object, the present invention provides a polymer composition comprising a medium material composite (A), which holds a low molecular weight material, therein and which comprises a low molecular weight material, and a medium material, and a polymer material (B), wherein the low molecular weight material has a viscosity of $5\times10^5$ centipoise or lower at 100° C., difference in solubility parameters of the low molecular weight material and the medium material is 3 or less, ratio by weight of the low molecular weight material to the medium material is 1 or more, difference in solubility parameters of the low molecular weight material and the polymer material is 4 or lower, and ratio by weight of the low molecular weight material to the polymer material is 0.3 or more.

Another aspect of the present invention is a process for producing a polymer composition comprising a process (S1) for obtaining a medium material composite holding a low molecular weight material therein by mixing a low molecular weight material and a medium material, and a process (S2) of mixing the medium material composite obtained at least with a polymer material, wherein the process (S1) comprises mixing the low molecular weight material having a viscosity of $5\times10^5$ centipoise or lower at 100° C. and the medium material having a solubility parameter different from that of the low molecular weight material by 3 or less in such amounts that ratio by weight of the low molecular weight material to the medium material is 1 or more, by using a mixing machine under a shearing condition that the shear rate V which is defined by $V=v/t$ (sec$^{-1}$) [v (m/sec): circumferential rotation speed of a rotor; t(m): clearance between the fixed wall and the rotor] is $5\times10^2$ or higher, and the mixing temperature is equal to or higher than the melting point or the glass transition temperature of the medium material, to obtain the medium material composite holding the low molecular weight material therein, in which the medium material has a backbone structure of a three-dimensionally continuous network; and the process (S2) comprises mixing the medium material composite holding the low molecular weight material therein with the polymer material having a solubility parameter different from that of the low molecular weight material by 4 or less in such amounts that ratio by weight of the low molecular weight material to the polymer material is 0.3 or more, by using a mixing machine at a rotation speed of 20 to 100 r.p.m. at a mixing temperature of 30 to 100° C.

As the low molecular weight material of the present invention, a material having a viscosity of $5\times10^5$ centipoise or lower, preferably $1\times10^5$ centipoise or lower at 100° C. is used. From the view point of molecular weight, a material having a number-average molecular weight of 20,000 or lower, preferably 10,000 or lower, more preferably 5,000 or lower, is used as the low molecular weight material of the present invention. In general, a material in a liquid state or in a liquid-like state at room temperature is preferably used. Any of a hydrophilic low molecular weight material or a hydrophobic low molecular weight material can be used.

As the low molecular weight material, any material satisfying the properties described above can be used and the type of material is not particularly limited. Examples of the low molecular weight material of the present invention include the following materials:

(1) Softening agents: various types of softening agents of mineral oil, plant oil, and synthetic oil used for rubbers and resins. Examples of the softening agent of mineral oil include aromatic process oils, naphthenic process oils, and paraffinic process oils. Examples of the softening agent of plant oil include caster oil, cotton seed oil, linseed oil, rape-seed oil, soybean oil, palm oil, coconut oil, peanut oil, Japan wax, pine oil, olive oil, and the like. Examples of the softening agent of synthetic oil include aromatic oils and the like.

(2) Plasticizers: plasticizers for plastics, such as phthalic acid esters, phthalic acid mixed esters, aliphatic dibasic acid esters, glycol esters, fatty acid esters, phosphoric acid esters, stearic acid esters and the like; epoxy plasticizers; and plasticizers for NBR, such as phthalate plasticizers, adipate plasticizers, sebacate plasticizers, phosphate plasticizers, polyether plasticizers, polyester plasticizers, and the like.

(3) Tackifiers: various types of tackifiers, such as coumarone resins, coumarone-indene resins, phenolterpene resins, petroleum hydrocarbons, rosin derivatives, and the like.

(4) Oligomers: various types of oligomers, such as crown ethers, fluorine-containing oligomers, polyisobutylene, xylene resins, chlorinated rubbers, polyethylene waxes, petroleum resins, rosin ester rubbers, polyalkylene glycol diacrylates, liquid rubbers (polybutadiene, styrene-butadiene rubber, butadiene-acrylonitrile rubber, polychloroprene, and the like), silicone oligomers, polyolefins, and the like.

(5) Lubricants: hydrocarbon lubricants, such as paraffin and wax; fatty acid lubricants, such as higher fatty acids, and oxy-fatty acids; fatty acid amide lubricants, such as fatty acid amides, and alkylene-bis-fatty acid amides; ester lubricants, such as lower alcohol esters of fatty acids, polyhydric alcohol esters of fatty acid amides; ester lubricants, such as lower alcohol esters of fatty acids, polyhydric alcohol esters of fatty acids, polyglycol esters of fatty acids, and the like; alcohol lubricants, such as aliphatic alcohols, polyhydric alcohols, polyglycols, polyglycerols, and the like; metal soaps; and mixed lubricants.

As the low molecular weight material, lateces, emulsions, liquid crystals, pitch compositions, clays, natural starches, sugars, inorganic materials such as silicone oils and phosphazenes, and the like materials, can be used. Further examples of the low molecular weight material used include: animal oils, such as beef tallow, lard, and horse oil; bird oils; fish oils; honey; fruits; solvents, such as milk products like chocolate and yogurt, hydrocarbons, halogenated hydrocarbons, alcohols, phenols, ethers, acetals, ketones, fatty acids, esters, nitrogen compounds, sulfur compounds, and the like; various types of pharmaceutical compounds; soil modifiers; fertilizers; petroleum; water; and aqueous solutions. These low molecular weight materials may be used singly or as a mixture of two or more types.

As the low molecular weight material, the most suitable material is selected and used in the most suitable amount according to requisite properties and application of the polymer composition, and compatibilities with other components of the present invention, such as the medium material and the polymer material.

The medium material used in the present invention is a material having the function to act as a medium between the low molecular weight material and the polymer material. The medium material is an important component for achieving the object of the invention. In more detail, in order to realize a homogeneous composition comprising a polymer material and a large amount of a low molecular weight material, first, a medium material composite which holds a large amount of the low molecular weight material therein is prepared from a large amount of the low molecular weight material and a medium material. Then, a second stage is carried out in which the object polymer composition, which holds a large amount of the low molecular weight material therein, is prepared by the combination of the medium material composite obtained in the first stage with the polymer material. It is impossible to obtain a homogeneous polymer composition having a low modulus by mixing a low molecular weight material with a polymer material. When a large amount of a low molecular weight material and a polymer material are mixed directly in the attempt to obtain a polymer composition holding a large amount of the low molecular weight material therein, the low molecular weight material cannot be mixed homogeneously and bleeding often occurs. Thus, the object polymer composition having a low modulus cannot be obtained. In the present description, "holding" a low molecular weight material means homogeneously dispersing a low molecular weight material into a medium material and a polymer material with no bleeding or with suppressed bleeding. Of course, bleeding can be easily controlled to a desired degree in accordance with the object of the polymer composition.

As the medium material of the present invention, any material that has the function described above and forms a composite holding a large amount of the low molecular weight material therein can be used. In general, a thermoplastic polymer material or a material comprising a thermoplastic polymer material as a component thereof is preferably used.

Examples of the medium material include; thermoplastic elastomers, such as styrenic thermoplastic elastomers (thermoplastic elastomers from butadiene-styrene, isoprene-styrene, and the like), vinyl chloride thermoplastic elastomers, olefininc thermoplastic elastomers (thermoplastic elastomers from butadiene, isoprene, ethylene-propylene, and the like), ester thermoplastic elastomers, amide thermoplastic elastomers, urethane thermoplastic elastomers, hydrogenation products of these thermoplastic elastomers, and other modification products of these thermoplastic elastomers; and thermoplastic resins, such a styrenic thermoplastic resins, ABS thermoplastic resins, olefinic thermoplastic resins (thermoplastic resins from ethylene, propylene, ethylene-propylene, ethylene-styrene, propylene-styrene, and the like), acrylic acid ester thermoplastic resins (thermoplastic resins from methyl acrylate and the like), methacrylic acid ester thermoplastic resins (thermoplastic resins from methyl methacrylate and the like), carbonate thermoplastic resins, acetal thermoplastic resins, nylon thermoplastic resins, halogenated polyether thermoplastic resins (chlorinated polyether and the like), halogenated olefinic thermoplastic resins (thermoplastic resins from vinyl chloride, tetrafluoroethylene, fluorochloroethylene, fluoroethylene-propylene, and the like), cellulose thermoplastic resins (acetylcellulose, ethylcellulose, and the like), vinylidene thermoplastic resins, vinyl butyral thermoplastic resins, and alkylene oxide thermoplastic resins (thermoplastic resins from propylene oxide and the like), and these thermoplastic resins modified with rubber. Among these examples of the medium material, thermoplastic elastomers are preferably used.

Among these medium materials, materials containing both of a hard part having the tendency to become hard blocks, such as a crystalline structure or an aggregated structure, and a soft part such as an amorphous structure in combination are preferable.

The low molecular weight material, the medium material and the medium material composite holding the low molecular weight material therein of the present invention are partly disclosed in Japanese Patent Application Laid-Open Nos. Heisei 5(1993)-239256 and Heisei 5(1993)-194763. The materials having the backbone structure of a three-dimensionally continuous network disclosed in these patent applications can be preferably used as the representative materials for the medium material of the present invention, as well.

More preferably, hydrogenation products of butadiene polymers and butadiene-styrene copolymers are used as the medium material.

1. As the hydrogenation products of butadiene polymers, products having a degree of hydrogenation of the butadiene polymer of 90% or more are preferably used. The hydrogenation product can have various molecular structures depending on the composition and the distribution of the composition of the 1,4-linkage and the 1,2-linkage of the starting butadiene polymer. Depending on the molecular structure, the hydrogenation product can contain, in a single molecular chain, segments exhibiting various types of crystal-related properties, such as the amorphous properties, the crystalline property, and combinations of the amorphous and crystalline properties.

The polymer material used in the present invention is not particularly limited so long as it is a material having the property for general use. A wide range of conventional thermoplastic materials and thermosetting materials can be used.

Examples of thermoplastic materials include: thermoplastic elastomers, such as styrenic thermoplastic elastomers (thermoplastic elastomers from butadiene-styrene, isoprene-styrene, and the like), vinyl chloride thermoplastic elastomers, olefinic thermoplastic elastomers (thermoplastic elastomers from butadiene, isoprene, ethylene-propylene, and the like), ester thermoplastic elastomers, amide thermoplastic elastomers, urethane thermoplastic elastomers, hydrogenation products of these thermoplastic elastomers, and other modification products of these thermoplastic elastomers; and thermoplastic resins, such as styrenic thermoplastic resins, ABS thermoplastic resins, olefinic thermoplastic resins (thermoplastic resins from ethylene, propylene, ethylene-propylene, ethylene-styrene, propylene-styrene, and the like), acrylic acid ester thermoplastic resins (thermoplastic resins from methyl acrylate and the like), methacrylic ester thermoplastic resins (thermoplastic resins from methyl methacrylate and the like), carbonate thermoplastic resins, acetal thermoplastic resins, nylon thermoplastic resins, halogenated polyether thermoplastic resins, acetal thermoplastic resins, nylon thermoplastic resins, halogenated polyether thermoplastic resins (chlorinated polyether and the like), halogenated olefinic thermoplastic resins (thermoplastic resins from vinyl chloride, tetrafluoroethylene, fluorochloroethylene, fluoroethylene-propylene, and the like), cellulose thermoplastic resins (acetylcellulose, ethylcellulose, and the like), vinylidene thermoplastic resins, vinyl butyral thermoplastic resins, and alkylene oxide thermoplastic resins (thermoplastic resins from propylene oxide and the like), and these thermoplastic resins modified with rubber.

The thermosetting material is a material that is heat cured in the presence or absence of a curing agent. Examples of the thermosetting material include: thermosetting rubbers, such as ethylene-propylene rubber (EPR), ethylene-propylene-diene terpolymer (EPDM), nitrile rubber (NBR), butyl rubber, halogenated butyl rubber, chloroprene rubber (CR), natural rubber (NR), isoprene rubber (IR), styrene-butadiene rubber (SBR), butadiene rubber (BR), acrylic rubber, ethylene-vinyl acetate rubber (EVA), and polyurethane; thermosetting specialty rubbers, such as silicone rubber, fluororubber, ethylene-acrylate rubber, polyester elastomers, epichlorohydrine rubber, polysulfide rubbers, Hypalon, and chlorinated polyethylene; and thermosetting resins, such as phenol resin, urea resin, melamine resin, aniline resin, unsaturated polyester resins, diallyl phthalate resin, epoxy alkyd resins, silicone resins, and polyimide resins.

Preferable examples of the polymer material include ethylene-propylene rubber, ethylene-propylenediene terpolymer rubber, natural rubber, isoprene rubber, styrene-butadiene rubber, and butadiene rubber.

In the present invention, the low molecular weight material and the polymer material are selected in such a manner that the difference in solubility parameters of the two materials used is 4 or less, preferably 3 or less. Although the low molecular weight material is mixed with the polymer material by means of the medium material composite, which holds the low molecular weight material therein, compatibility between the low molecular weight material and the polymer material is important. When the difference is more that 4, it is difficult for the polymer material to hold a large amount of the low molecular weight material, which is held in the medium material composite described above, because of the decreased compatibility. It becomes difficult for the modulus of the polymer composition to decrease, and the tendency of the low molecular weight material to bleed increases. Thus, difference in solubility parameters of more than 4 is not preferable.

Ratio by weight of the low molecular weight material to the polymer material is 0.3 or more, preferably 0.4 or more, and more preferably 0.5 or more. A ratio of less than 0.3 is not preferable because it is difficult to obtain a polymer composite having a very low modulus.

The process for producing the polymer composition of the present invention comprises a process (S1) for preparing a medium material composite holding a low molecular weight material therein by mixing the low molecular weight material and a medium material using a mixing machine at a specific shear rate and a specific temperature, and a process (S2) of mixing the prepared medium material composite with a polymer material using a mixing machine under a specific mixing condition. The medium material has a backbone structure of a three-dimensionally continuous network in the medium material composite.

Shear rate in the process (S1) is a very important factor in achieving the object of the present invention. When the shear rate is defined by $V=v/t(sec^{-1})$[v(m/sec): circumferential rotation speed of a rotor, t(m): clearance between the fixed wall and the rotor], V is $5\times10^2$ ($sec^{-1}$) or higher, preferably $1\times10^3(sec^{-1})$ or higher, more preferably $2.5\times10^3$ ($sec^{-1}$) or higher, and most preferably $5\times10^3(sec^{-1})$ or higher. V is expressed by the circumferential rotation speed v and the clearance t, independently of the size of the mixing machine. However, v and t are related to the size of the mixing machine. Particularly, v depends on the rotation speed and the circumferential length of the rotor of the mixing machine, the length being related to the size of the rotor. Therefore, it is difficult to define v and t individually. In general, v is preferably 0.5 (m/sec) or higher, more preferably 1 (m/sec) or higher, and most preferably 2 (m/sec) or higher. In general, t is preferably $3\times10^{-3}$(m) or less, more preferably $2\times10^{-3}$(m) or less, and most preferably $1\times10^{-3}$ (m) or less.

EXAMPLES

The invention will be understood more readily with reference to the following examples; however, these examples are intended to illustrate the invention and are not to be construed to limit the scope of the invention.

Various measurements were conducted according to the following methods.

Number-average molecular weight was measured by gel permeation chromatography (GPC; using an apparatus produced by Toso Co., Ltd.; GMH-XL; two columns connected in a series) using differential refractive index (RI) for the detection. Monodisperse polystyrene was used as the reference material and number-average molecular weight calibrated with the polystyrene was obtained.

Loss tangent (tan δ) was measured by using an apparatus for measurement of viscoelasticity (a product of Rheometrix Co.) at a temperature of 25° C., a strain of 10%, and a frequency of 5 Hz.

Bleeding rate (%) is an index for the bleeding property. To measure the bleeding rate, a sample of 3 cm×3 cm×3 cm was heated in an oven at 65° C. for 40 hours and then a piece of paper was attached to each of the top face and the bottom face of the cubic sample. The pieces of paper to which liquid (low molecular weight material) is applied is removed from the sample. Bleeding rate was calculated from the difference between the weight of the original paper and the weight of the paper after it was removed from the sample.

The viscosity of a liquid and the solubility parameter were measured according to conventional methods.

Example 1

In the process (S1), the low molecular weight material and the medium material described hereinafter were mixed together by using a high shear type mixer shown in FIG. 1. The mixing process is described with reference to FIG. 1.

The specified amounts of the liquid (the low molecular weight material) and the medium material were charged into the mixer. A rotor (a turbine) 14 connected to a rotor shaft (a turbine shaft) 12, which was supported by a bearing 10, was rotated at a high speed. By making use of the sucking action formed by the rotation, the materials for mixing were sucked in from the lower part of a fixed wall (a stator) 16. The materials for mixing were subject to strong action of shear, impact and turbulence at the clearance between the rotor 14 rotating at a high speed and the fixed wall 16. The materials for mixing were then discharged to the upper direction through outlet holes 18. The direction of the upward flow was reversed by a flow-direction reversing plate 20 at the upper part so that the flow was directed downward along the side of the mixer until it reached the bottom part of the mixer.

Condition of the mixing in the process (S1) of the present example was as follows:

| | |
|---|---|
| shear rate V; | $1.0 \times 10^4$ ($sec^{-1}$) |
| circumferential rotation speed of the rotor v: | 5.0 (m/sec) |
| clearance between the fixed wall and the rotor t: | $5 \times 10^{-4}$(m) |
| mixing temperature: | 160° C. |
| mixing time: | 1 hour |

The medium material composite holding the liquid therein and obtained by the process (S1) contained the medium material having a backbone structure of a three-dimensionally continuous network. Further, the composite was homogeneous with little bleeding even though a large amount of the liquid was contained therein.

In the next process (S2), the medium material composite thus prepared was mixed with the polymer material described hereinafter by using a Labo Plastomill at a rotation speed of 70 r.p.m. at 40° C. for 10 minutes. The polymer composition thus obtained was cured at 145° C. for 15 minutes. The cured product obtained had an Asker C hardness of 21 at 25° C. Both the polymer composition and the cured product showed little bleeding and were homogeneous. This was clearly shown by the result that the cured product had a bleeding rate of 0.1%. The cured product had a tan δ value as large as 0.18. The cured product of the polymer composition thus obtained had properties of a general use material because it was prepared by using a general use low molecular weight material and a general use polymer material. Furthermore, the product was found to be a material which held a large amount of the low molecular weight material therein, had a very low modulus, and had a high loss property.

Anisotropic Deformation Pad for Footwear

The following disclosure is from co-pending application Ser. No. 08/327,461. The element number has not been changed from the original numbering and, therefore, the element number has been reset to 1.

The inventors have found that a new ground contacting system can be designed to provide adequately damping action and to mimic the slight sliding action a shoe experiences when a user walks or runs on dirt, sand, or gravel. The moment the foot contacts a surface such as dirt, sand, or gravel, the foot undergoes a slight slide before the weight of the user increases the frictional force and stops the slide. The ground contacting system of the present invention is designed to mimic this slight slide by allowing the user's foot and the shoe upper to move slightly relative to the ground contacting surfaces of the ground contacting system of the present invention. Thus, the ground contacting system of the present invention are slightly deflectable in the forward direction in response to the foot contacting a hard, non-loose ground surface such as concrete, asphalt, or wood.

The present invention seeks to advance the state of the art of athletic footwear by providing anisotropic deformation pad(s) that can be applied to the shoe soles to simulate the sliding that occurs when running on a dirt road. The pad provides a small amount of horizontal relative movement between a lower, ground contacting surface of the pad and the footwear. The deformation pads can be applied to running shoes to simulate slight forward sliding action, or alternatively the pads may be applied at a different orientation to tennis shoes to simulate the effect of sliding sideways on a clay surface. It is further envisioned that the anisotropic nature of the deformation pads will permit them to be applied to all athletic footwear in varying orientations to specifically address the performance needs of each sport.

The deformation pads of the present invention have many preferred embodiments. In one preferred embodiment, the deformation pads include several depending, elongate, deformation elements having interior chambers, or channels. The deformation elements are arranged on a flat surface substantially radially about a common center, much as the toes of a bird are arranged around its leg. The chambers are preferably sealed and have atmospheric pressure air in them so that as the channel is deformed, air pressure builds quickly to assist in cushioning the impact load. Other preferred embodiments include filling the channels with a gelatinous, or viscoelastic, material(s) to further dampen impact loads due to footfall.

In another preferred embodiment, the pads include a plurality of deformation elements depending from a substantially flat surface wherein the deformation elements are arranged parallel to one another and oriented on the shoe to address particular performance characteristics of the sport for which the shoe is intended.

In another preferred embodiment, the deformation pad is provided with a plurality of depending deformation elements that are arranged concentrically about a common center. The deformation elements may be diamond shaped or square shaped, etc., to provide various desired anisotropic properties.

In another preferred embodiment of the present invention, the footwear sole is provided with several anisotropic deformation pads and several isotropic support elements. Preferably, the deformation pads are thicker than the support elements so that upon initial ground contact, the deformation pads would contact the ground first, and the support elements would contact the ground only after the deformation pads are at least partially deformed. The deformation pads may be placed at points of high impact or maximum loads such as at the heel and underneath the ball of the foot. The support elements may then be arranged to provide additional stability and foot support where required such as along the toe and along the midfoot section underneath the arch of the foot. Positioning a support element at the toe of the shoe may also assist with push-off.

Various advantages and features of novelty that characterize the invention are particularized in the claims forming a part hereof. However, for a better understanding of the invention and its advantages, reference should be had to the drawings and to the accompanying description in which there is illustrated and described preferred embodiments of the invention.

With reference to FIGS. 16 and 17, there is shown a shoe 10 including an upper 12, a midsole 14, and an outsole 16 having a plurality of deformation pads 18*a*, 18*b* (collectively 18) and support elements 20. Preferably, the deformation pads 18 are thicker than the support elements 20, such that if an unweighted shoe 10 were placed on a level surface, the deformation pads 18 would contact the surface and the support elements 20 would not.

FIG. 17 shows a preferred embodiment for the arrangement of the deformation pads 18 and support elements 20. This distribution of pads and elements is a proposed arrangement for a court shoe such as basketball or tennis which requires substantial lateral movement and stopping. The pads 18 are placed at points where the foot receives the greatest pressure during footfall, namely at the heel and the ball region of the foot. The pads 18 are oriented to facilitate the rapid starts, stops and direction changes associated with court games. Support elements preferably are provided at the toe section to assist with push-off and at two positions just forward of the heel to provide stability and extra cushioning when the rearward deformation element 18*a* deforms substantially. It is envisioned that shoes intended for other sports and activities could have other pad and support element arrangements optimized to suit the particular sport or activity.

As shown in FIG. 17, the midsole 14 has a midfoot section 22 which is exposed. Alternatively, the midsole 14 could be provided with a wear resistant outer covering to prevent degradation of the midsole, which is typically an EVA foam.

A preferred embodiment of an anisotropic deformation pad 18 of the present invention is shown in FIG. 18. The pad includes a base layer 24 to which a plurality of elongate walls 26 are attached. Pairs of adjacent walls 26 are interconnected by ground-contacting surfaces 28 to form deformation elements 36, 38, 40, and 42, and thereby define a plurality of elongate interior channels 30. The channels 30 are completely enclosed and sealed by the base layer 24 and end walls (unnumbered), which seal off the opposite ends of the channels. The pad also includes a plurality of hollow, intermediate ribs 32 located in slots or recesses formed between adjacent channels 30.

Overall, the deformation elements 36, 38, 40 and 42 are arranged on the base layer 24 as the toes of a bird's foot are arranged, that is, somewhat radially about a common center. As is discussed in detail below, many alternative configurations may be used and still provide the advantages of the present invention.

Preferably, the deformation elements 36, 38, 40 and 42 are vacuum formed or molded of a rubber or a similar material having suitable structural strength and wear resistance. The complete pad 18 is formed by joining the formed deformation elements 36, 38, 40 and 42 to the base layer 24.

As noted, the channels 30 are sealed chambers. Preferably, the chambers contain air at atmospheric pressure. When the deformation pad 18 is subjected to forces causing the deformation elements to deform, the channels 30 will be compressed, thus compressing the inside air causing its pressure to increase. Alternatively, the channels 30 may be filled with a suitable gelatinous material, such as a viscoelastic plasticized PVC manufactured by Spenco, Inc. of Waco, Tex., as is disclosed in U.S. Pat. No. 5,330,249. Other suitable high viscosity fluids may also be used.

FIGS. 19 and 20 show cross section views of the anisotropic deformation pad 18 of FIG. 18. In FIG. 19, the deformation pad 18 is shown in an undeformed state as it would appear when applied to a shoe 10 but having no loads placed on it. In alternative embodiments, such as disclosed in FIG. 21, discussed below, the base layer 24 may be concave upward to conform to a rounded midsole at the heel region.

FIG. 20 depicts the deformation pad 18 as it might appear when placed under a transverse load. It can be seen that the walls 26 and the ground contacting surfaces 28 of the deformation elements 36, 38 and 40 are deformed, causing the ground contacting surfaces 28 to be shifted horizontally relative to the base surface 24. The deformation causes the channels 30 to deform, and because the channels are sealed, the pressure of the fluid within the channels will increase providing added cushioning.

The deformation exemplified in FIG. 20 is caused by the forces associated with ground contact during sports activity. Generally, the forces associated with footfall will have x, y and z components, where x is transverse to a lateral margin of the shoe 10, y is longitudinal and z is vertical. Thus each force F will have components $F_x$, $F_y$ and $F_z$. $F_x$ and $F_y$ components will tend to urge the ground-contacting surface 28 to shift horizontally relative to the base layer 24 and the midsole 14. The $F_z$ component will be a purely compressive force urging the ground-contacting surface 28 to move toward the base layer 24 without any horizontal shift. The performance of the deformation pads 18 depend upon the orientation of the deformation elements 36, 38, 40 and 42 relative to each other and to the forces $F_x$ and $F_y$, as described below in detail with reference to axes a, b, c, and d.

Transverse deformation of each element, e.g. 36, is caused by a force, e.g. $F_x$ or $F_y$. The amount of deformation will depend upon the orientation of the element to the force and on the resistance to deformation inherent in the physical properties of the element. The performance of the elements can be equated with the performance of a spring, that is the amount of deformation will equal the force times a proportionality factor or coefficient, which may be linear or non-linear.

The performance of the deformation pads 18 will also depend upon the interaction of other design factors. Notably, the size of the channels 30 relative to the structural strength of the walls 26. Thicker walls 26 and smaller channels 30 will likely produce greater stability and less cushioning.

Additionally, the walls of opposing channels 30 may be spaced closely so as to make contact during deformation causing a two-stage resistance to deformation: the first stage occurring upon initial ground impact, and a second stage occurring when the walls collide causing increased resistance to further deformation. Further, the walls 26 of channels 30 may be spaced closely to ribs 32 so as to collide upon deformation, again establishing a two-stage resistance to deformation similar to that described above. Additionally, the size of the channels 30 may be enlarged or reduced without a change in the thickness of walls 26 to further adjust the cushioning of the deformation pad 18. Additional design options that would affect performance include changing the width and height of the deformation elements 36, 38, 40 and 42, changing their relative orientation, and changing their shape, e.g., tapered or "cigar-shaped."

It must be noted that under typical deformation loads, the ground contacting surfaces 28 will conform to the ground surface upon which they rest causing the base layer 24 to assume an incline. The amount of inclination may be controlled by the resistance to deformation of deformation pad 18. The inclination of the base layer 24 will only occur in connection with forces $F_x$ and $F_y$. Purely vertical forces, $F_z$, will not cause an inclination.

The deformation elements 36, 38, 40 and 42 are preferably elongate having vertical, longitudinal and transverse axes. The deformation elements are designed to deform primarily along the transverse and vertical axes. Conversely, the deformation elements will substantially resist deformation along their longitudinal axes.

This anisotropic deformation is better understood by reference to FIG. 17 wherein axes a, b, c, and d, are shown superimposed on deformation pad 18*a*. It can be seen that axes a and b are the longitudinal axes for deformation elements 36 and 38, respectively. Axes c and d are transverse axes for deformation elements 36 and 38, respectively. For clarity of illustration and ease of explanation, reference axes for deformation elements 40 and 42 are not shown or described.

Forces acting along transverse axis d on deformation element 38 will cause its respective ground contacting surface 28 to shift substantially horizontally relative to the base surface 24 and the midsole 14. This relative motion simulates the slight sliding that would occur when running on gravel roads or playing tennis on a clay court. Conversely, when a force is acting on deformation element 38 along reference axis b, the element will deform very little and there will be very little longitudinal movement of its respective ground-contacting surface 28 relative to the base surface 24 or the midsole 14.

In addition, as noted, deformation element 38 will have a particular resistance to deformation against forces acting along axes b and d. That is, the amount of horizontal shift of the ground-contacting surface 28 is equal to the magnitude of the applied force limes a proportionality factor, which relates to the resistance to deformation. The deformation elements are designed to have their least resistance to deformation against forces acting along transverse axes, e.g., axes c and d for elements 36 and 38 respectively, and to have their greatest resistance to deformation against the forces acting along their longitudinal axes, e.g., axes a and b for elements 36 and 38, respectively.

The deformation elements 36, 38, 40 and 42 also deform vertically, that is the elements deform such that the ground-contacting surfaces 28 move directly toward the base surface 24 without any sideways (e.g., horizontal) shifting. During typical sports activity forces acting on the deformation pad will cause the deformation elements to deform transversely and vertically, simultaneously.

The embodiment of the deformation pad 18*a* shown in FIGS. 16–18 includes deformation elements 36, 38, 40 and 42 having converging longitudinal axes. Accordingly, when the deformation pad 18*a* is subjected to a force during footfall, the direction of that force will assume various angles of incidence relative to the longitudinal axes of the deformation elements 36, 38, 40 and 42. For example, if the shoe 10 of FIGS. 16 and 17 were subjected to a force F having a component that is transverse to the elongate shoe sole $F_x$ it would be in a direction approximately parallel to the reference axis c. Thus, deformation element 36 would be deformed along its axis of least resistance to deformation. Meanwhile, the force $F_x$ would act on deformation element 38 between its axes of least resistance to deformation and most resistance to deformation; thus deformation element 38 would deform less than deformation element 36. The same analysis can be applied to elements 40 and 42.

The interaction, and the relative amounts of deformation of the various deformation elements, can thus be controlled by controlling the angle between the longitudinal axes of the respective deformation elements. For example, by increasing the angle between the longitudinal axes of the deformation elements, a force that is transverse to one deformation element would be more nearly longitudinal relative to an adjacent deformation element. This arrangement would likely produce greater stability with less "sliding" effect (wherein ground-contacting surface 28 shifts horizontally relative to the base layer 24). On the other hand, if it was desired to increase the sliding effect, the angle between the longitudinal axes of the individual deformation elements would be increased; in the most extreme case, the longitudinal axes would be parallel so that a given force acting transversely on one deformation element would likewise act transversely on all the deformation elements causing equal degrees of deformation. This type of response may be desirable for certain sports activities while being undesirable for other sport activities.

In the embodiment of FIGS. 16 and 17, the deformation elements 18 are arranged to provide deformation along predetermined axes when subjected to ground impact forces during footfall. Using the notation described above, it is apparent that deformation pads 18*b* are arranged to provide deformation primarily along the sole's longitudinal axis, e.g., in response force $F_y$, while providing almost no deformation along the sole's transverse axis in response to force $F_x$. Conversely, deformation pad 18*a*, at the heel of the shoe 10, is arranged to provide minimum deformation in response to force $F_y$ and a maximum deformation in response to force $F_x$. The orientation of deformation pads can also be selected to provide a greater or lesser degree of transverse or longitudinal deformation as may be desired to control injury-prone motion such as over pronation.

FIG. 17 is not represented as an ideal or optimum arrangement, placement, or orientation of deformation pads 18 for any particular support. Rather, it reflects various design considerations and design theory for the use of the deformation pads 18. Further study and experience with the deformation pads may yield other designs and arrangements that produce more favorable results for a given sport.

The support elements 20 are preferably cushioned elements having cushioning 46 and an abrasion-resistant material 48. As noted, preferably the support elements 20A have a thickness that is less than a thickness of the deformation pads 18. Thus, as the outsole 16 encounters the ground during footfall, the deformation pads 18 will first contact the ground and deform as the load of the athlete is applied to shoe. As the deformation pads 18 deform, their thickness will decrease until the support elements 20 come into contact with the ground.

As with the design and orientation of the deformation pads, the design and placement of the support elements can be tailored to individual sports activities. In running, the support elements 20 located near the deformation pad 18*a* may be provided with substantial cushioning to reduce impact, while the support element 20 located at the toe is provided with dense EVA foam to facilitate push-off. Other sports applications may wish to emphasize the stability characteristics and provide a greater density foam in the support elements 20 located near the rearmost deformation pad 18*a*.

Another preferred embodiment of the present invention is exemplified in FIG. 21, which shows a support element 20 at a toe of the shoe, and deformation pads 50 and 52 located at the heel and ball of the foot, respectively. The deformation pad 50 is provided with concentrically arranged square-shaped deformation elements 54 having interior channels (not shown) similar to channels 30 of the embodiment shown in FIGS. 16–20. The deformation pad 52 is a one-piece pad meant to replace the two pads 18*b* of the embodiment of FIGS. 16–20. Deformation pad 52 also includes deformation elements 56 that are arranged to provide deformation along particular axes suitable for a particular sport. Between the deformation pads 52 and 50 there is a portion of exposed midsole 58 and a bottom portion of shoe upper 60.

FIGS. 22 and 23 are graphs of the force on an outer sole of a shoe during footfall of a runner. The data is collected by having a runner wearing a shoe run over a force plate that measures forces along the x, y, and z axes of a single footfall, wherein the y axis is parallel to the direction of travel, the z axis is vertical, and the x axis is orthogonal to the y and z axes (i.e., x and y define the horizontal plane). The ordinate axis on the graph represents the force of the foot on the force plate, and the abscissa axis represents time in milliseconds. There are no units applied to the ordinate axis because force is relative to an individual runner, the runner's speed, and posture. Accordingly, the magnitude of the force varies from test to test, even with the same runner in the same pair of shoes. However, the relationship of the forces is significant, particularly the forces acting in the y direction ($F_y$) and the z direction ($F_z$).

In FIG. 23, representing a runner with one type of prior art footwear, it can be seen that $F_x$, and $F_y$ have an initial, equal onset. That is, $F_z$, and $F_y$ have equal magnitudes and rates of increase for the initial five to eight milliseconds after the shoe first makes contact with the force plate. Thereafter, the rate of increase of $F_z$ and $F_y$ continue equally, but at different magnitudes, until each reaches its respective maximum force. The forces thereafter subside.

The force response of a runner wearing a shoe having the deformation pads of the present invention is shown in FIG. 22. These results are a composite of results obtained using footwear of the present invention, but the pads may have been oriented differently. It can be seen that from its onset $F_z$ has a substantially steady rate of increase up to its maximum force which occurs approximately 30 milliseconds after foot impact, not unlike the response using prior art footwear. However, $F_y$ represents a significant difference over the prior art response because there is a 10 to 15 millisecond delay between the initial shoe contact and an increase in $F_y$. This delay in the onset of $F_y$ correlates with a reduced impact felt by the runner because impact is defined as force divided by time. Thus, even though the actual magnitude of force $F_y$ may be equal in prior art shoes and in shoes incorporating the present invention, empirical data indicates that the onset of that force is delayed. Thus, the force is applied over a longer period of time indicating a reduced impact.

The foregoing explanation includes theory regarding the reasons for the performance advantages that have been realized by the present invention. Further testing and collection of empirical data may modify some of the theory.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

Outsole With Bulges

The following disclosure is from co-pending PCT application Serial No. PCT/PE 95/01128. The element numbers have not been changed from the original numbering and, therefore, the element numbers have been reset to 1.

Another object of the present invention is to design an outsole having a favorable damping function and at the same time a favorable guidance function, irrespective of the magnitude of the loading, for example due to the weight of the runner.

By virtue of the tread surface corresponding to the base surface of the bulge portions, that configuration ensures that the size of the tread surface can alter at most to an insignificant degree, independently of the severity of deformation, and the tread surface is therefore substantially independent of weight.

Furthermore the support walls, which are distributed over the width of the sole in the bulge portions, provide that the bulge portions also experience at least approximately uniform deformation between their medial and lateral ends and thereby the tread surface is guaranteed to be flat, even in the middle region of the outsole. As the support walls admittedly subdivide the air chambers of the bulge portions into a plurality of individual chambers, but still leave them in flow communication, that arrangement ensures that a high pressure cannot build up in the individual chambers due to locally more severe deformation; a high pressure of that kind could give the feeling of irregular contact with the ground over the width of the sole.

At the same time, however, if the communicating openings, which are kept free of the support walls between the abovementioned individual chambers, are of suitable dimensions, the possible air interchange between the chambers can be subjected to a certain throttling effect so that a certain air cushion effect occurs in the event of irregular pressure against the ground (for example when moving over bumpy ground), although the air pressure prevailing in the air chambers generally does not play a decisive part, in regard to the function that the invention seeks to achieve. Altogether, the comparatively large tread surface, which remains uniformly flat even when deformation occurs provides a guide function which results therefrom and which is enhanced by the lateral support function of the support walls.

The support walls can be of different configurations. In accordance with a preferred embodiment, the support walls are rectilinear and extend substantially transversely relative to the bulge portions, wherein the communicating openings are kept free at the front and rear ends of the support walls. In turn, a particularly preferred configuration has a pair-wise arrangement of that kind of support walls, wherein the support walls of each pair are connected together at their front and rear ends and the hollow space or cavity, which is formed in that way between them is open towards the ground-engaging side, in that respect forming a recess. As, in accordance with the number of pairs of support walls of that kind, a corresponding number of recesses is produced in each bulge portion, that configuration provides a kind of profiling on the ground-engaging side, which ensures that the sole is non-slip.

In accordance with another advantageous embodiment the support walls are formed by walls in the form of a cylinder or a truncated cone, wherein the internal space enclosed by the walls is also open towards the ground-engaging side and therefore forms profile recesses in the shape of cups. Desirably, those support walls are arranged in displaced relationship relative to each other, in the longitudinal direction of the sole, over the width of the sole, so that the individual chambers produced thereby form a wavy configuration over the width of the sole.

The deformation pads of the present invention have many preferred embodiments. In one preferred embodiment, the deformation pads include several depending, elongate, deformation elements having interior chambers, or channels. The deformation elements are arranged on a flat surface substantially radially about a common center, much as the toes of a bird are arranged around its leg. The chambers are preferably sealed and have atmospheric pressure air in them so that as the channel is deformed, air pressure builds quickly to assist in cushioning the impact load. Other preferred embodiments include filling the channels with a gelatinous, or viscoelastic, material(s) to further dampen impact loads due to footfall.

In another preferred embodiment, the pads include a plurality of deformation elements depending from a substantially flat surface wherein the deformation elements are arranged parallel to one another and oriented on the shoe to address particular performance characteristics of the sport for which the shoe is intended.

In another preferred embodiment, the deformation pad is provided with a plurality of depending deformation elements that are arranged concentrically about a common center. The deformation elements may be diamond shaped or square shaped, etc., to provide various desired anisotropic properties.

In another preferred embodiment of the present invention, the footwear sole is provided with several anisotropic deformation pads and several isotropic support elements. Preferably, the deformation pads are thicker than the support elements so that upon initial ground contact, the deformation pads would contact the ground first, and the support elements would contact the ground only after the deformation pads are at least partially deformed. The deformation pads may be placed at points of high impact or maximum loads such as at the heel and underneath the ball of the foot. The support elements may then be arranged to provide additional stability and foot support where required such as along the toe and along the midfoot section underneath the arch of the foot. Positioning a support element at the toe of the shoe may also assist with push-off.

Various advantages and features of novelty that characterize the invention are particularized in the claims forming a part hereof However, for a better understanding of the invention and its advantages, reference should be had to the drawings and to the accompanying description in which there is illustrated and described preferred embodiments of the invention.

As shown in FIG. 24, the outsole has a foresole portion 1 and a heel portion 2, which are each connected to a sole plate (not shown), for example by being glued thereto. The sole plate can comprise a separate sole layer consisting of relatively hard but springy material (for example composite material), but the sole plate may also be an intermediate sole comprising elastically compressible material, for example PU or EVA. The foresole portion 1 and the heel portion 2 can, however, also be connected to the shoe upper, which is pinched on to the insole, directly, by way of the pinch edge of the shoe upper.

The foresole 1 as shown in FIG. 24 forms an undersole that has three bulge portions 3 that extend transversely over the width of the sole and which are directed parallel to each other. The bulge portions 3 are arranged inclinedly relative to the longitudinal direction of the sole, as indicated by the dash-dotted line A, so that their respective medial end 3*a* is closer to the tip of the sole, than the oppositely disposed lateral end 3*b*. The bulge portions 3 are hollow and are covered over by a sole layer 5, which is connected to the top side of the foresole 1, so that that arrangement forms air chambers 4 corresponding to the bulge portions 3. The cross-section of the bulge portions 3 is slightly trapezoidal, that is to say the width of a base surface 6 of each bulge portion 3, as measured in the longitudinal direction A of the sole, is only insignificantly greater than the corresponding width of a tread surface 7.

Each bulge portion 3 includes pairs of support walls 8, the pairs being arranged uniformly distributed in the transverse direction of the sole. The support walls 8 in each pair are at a small spacing from each other (for example about 3–4 mm), and they are connected together at their front and rear ends by a respective rounded wall 9. The support walls 8 and their connecting walls 9 enclose a profile recess 10, which is open towards the ground-engaging side 7 of each bulge portion.

In the illustrated embodiment, the recess 10 is of a slightly conical configuration (in particular to facilitate removal from the mold in production of the sole), and on its base the recess 10 has a projection 12 that is directed towards the ground-engaging side and is of a knife edge-like configuration.

The projection 12 is of a height of about one-third of the depth of the recess 10 and serves to loosen and eject accumulated dirt, by virtue of the deformability and mobility of the projection 12. For that purpose, the projection 12 is either formed integrally with the bottom of the recess 10 or it is connected to the sole layer 5. In the latter case, the bottom of the recess 10 either has an opening of suitable size for the projection 12 to pass therethrough, or it is formed by the sole layer 5. In both cases, the bottom of the recess 10 or the sole layer 5 is formed, at least in the bottom region of each recess 10, as a movable membrane in order to guarantee mobility of the projection 12, as is required for loosening dirt that has penetrated into the recess.

On its rectilinear front and rear longitudinal edges, the middle bulge portion 3 has a row of notches or indentations 14 that are each arranged between the respective recesses 10. Corresponding notches are provided at the rear edge of the front bulge portion 3 and at the front 6 edge of the rear bulge portion 3. The tread surface 7 of each bulge portion 3 extends continuously from the lateral to the medial edge of the sole, being locally interrupted only by the recesses 10 and the notches 14.

By virtue of that configuration, the bulge portions 3 have a stabilizing action on the foresole 1, in relation to bending deformation, in the transverse direction of the foresole 1. However, in this connection the recesses 10 and the notches 14 produce an increase in the stretchability of each bulge portion 3 in the transverse direction of the sole, so that the stabilizing effect can be controlled by a suitable choice of the number and width of the recesses 10 and the notches 14. In the illustrated embodiment, the middle and naturally longest bulge portion 3 has six recesses 10 or pairs of support walls 8, thereby providing seven individual chambers in the bulge portion. The two edges of the bulge portion on the other hand are provided with five and six notches 14, respectively.

The support walls 8 and the connecting walls 9 thereof are fixedly joined to the sole layer 5, for example being glued thereto or being vulcanized on to same. They occupy only a part of the width of the recess 3, more specifically in such a way that a respective communicating opening 16 is kept free at each of the front and rear ends. The individual chambers formed between the pairs of support walls 8 are connected together by way of the communicating openings 16.

The heel portion 2 shown in FIG. 24 has at each of the lateral and medial edges of the sole a respective bulge portion 20 and 21, respectively, which is directed substantially parallel to the longitudinal direction A of the sole. The construction of the bulge portions 20 and 21 is in principle the same as that of the bulge portions 3. Adjoining the rear end of the bulge portions 20 and 21 is a heel section 22, which also forms an air chamber 4, which is subdivided into intercommunicating individual chambers by support walls that project in from the rear edge 23 and recesses 24 that are formed by the support walls. The heel section 22 is beveled towards its rear edge 23 (see FIG. 25).

In the embodiment shown in FIGS. 27 to 29 the bulge portions 3' differ from those of the above-described embodiment, only insofar as the support walls 8' are frustoconical and the internal space enclosed by the support walls 8' is open towards the ground-engaging side 7'. That configuration forms cup-shaped recesses 10'. Projecting from the base of each of the recesses 10' is a projection or peg portion 12', which is provided for the appropriate purpose. The recesses 10' are arranged on each bulge portion 3' in a double row and in that arrangement are disposed in mutually displaced relationship relative to each other.

In this embodiment the medial edge of the sole is formed specifically to provide support to resist over-pronation. For that purpose, the rear bulge portion 3' on the foresole is shortened and the space that is formed thereby at the medial edge is occupied by a bulge portion 30 that extends along the edge of the sole. The bulge portion 30 has three recesses 31 that are formed by pairs of support walls. The pairs of support walls are directed approximately perpendicularly to the medial edge **3*a*' of the sole and are each connected to a respective vertical pillar or column 32, which projects from the medial edge 3*a*' of the sole. The columns 32, with their almost fully circular tread surface 34, project slightly (about 0.5 mm) relative to the tread surface 35 of the bulge portion 30**.

The heel portion 2' is constructed similarly to the heel portion 2, but the medial bulge portion 37 corresponds in its design configuration to the bulge portion 30, which has just been described above, that is to say, it is provided with pairs of support walls which are stiffened at the edge by pillars or columns. It extends to a pronounced degree forwardly into the arch region of the foot, in order to control pronation of the foot.

In both embodiments the wall thickness of the bulge portions 3 or 3' is about 2–3 mm, but the wall thickness of the support walls 8, 8' is less, for example 1–2 mm. The material used is a rubber or a rubber-like material with a Shore hardness of about 40A to 60A.

Variations may be made in the above-described embodiments, without departing from the scope of the invention. Thus, instead of extending inclinedly relative to the transverse direction of the sole, the bulge portions may be arranged to extend precisely parallel thereto. The number of support walls can be altered, but should not be substantially less than the number selected in the illustrated embodiments. The projections 12 and 12' provided in the profile recesses may also be omitted, depending on the kind of use to which the footwear is put. For reasons of weight, instead of the illustrated solid arrangement those projections may also be hollow, if the size thereof permits that.

While in accordance with the patent statutes, the best mode and preferred embodiments of the invention have been described, it is to be understood that the invention is not limited thereto, but rather is to be measured by the scope and spirit of the appended claims.

We claim:

1. A ground contacting system comprising:

a sole; and at least one element depending from solely a portion of a bottom surface of the sole comprising:

a ground-contacting member having a ground-contacting surface;

at least one of a continuous sidewall and a top surface bonding the ground-contacting member to the portion of the bottom surface of the sole;

an interior defined by the portion of the bottom surface of the sole, the sidewall and the top surface of the ground-contacting member and including at least one hollow portion;

a perpendicular resistance to deformation relative to an axis perpendicular to the bottom surface of the sole; and a parallel resistance to deformation relative to a deformation surface parallel with the bottom surface of the sole where the parallel resistance to deformation allows the sole to move relative to a ground-contacting surface of the ground-contacting member of each element during foot fall, wherein a portion of the at least one element attached to a portion of a side of the sole.

2. The system of claim 1, wherein the relative motion of the sole to ground-contacting surface of the ground-contacting member of each element reduces force transference to a wearer's joints, muscles, tendons and ligaments.

3. The system of claim 1, wherein at least one element is attached to a heel portion of the bottom surface of the sole.

4. The system of claim 1 further comprising a second element adjacent to the at least one element, wherein at least one of the parallel resistance to deformation and the perpendicular resistance to deformation results from contact of the at least one element with the adjacent element.

5. The system of claim 1, wherein at least one element is attached to a heel portion of the bottom surface of the sole, at least one element is attached to a medial side of a forefoot portion of the bottom surface of the sole and at least one element is attached to a lateral side of the forefoot portion of the bottom surface of the sole.

6. The system of claim 1, wherein the perpendicular resistance to deformation of each element is greater than the parallel resistance to deformation of each element.

7. The system of claim 1, wherein the parallel resistance to deformation of each element is greater than the perpendicular resistance to deformation of each element.

8. The system of claim 1, wherein the hollow portion of the interior comprises the whole volume of the interior.

9. The system of claim 1, wherein the hollow portion of the interior comprises a plurality of hollow regions with a remainder of the interior filled with a viscoelastic material.

10. The system of claim 9, wherein the regions are in fluid communication.

11. The system of claim 1, wherein the parallel resistance to deformation of each element comprises a heel-to-toe resistance to deformation and a lateral-to-medial resistance to deformation and wherein the perpendicular, heel-to-toe, and lateral-to-medial resistances to deformation are mutually orthogonal and correspond to three orthogonal axes relative to the bottom surface of the sole.

12. The system of claim 11, wherein the three resistances to deformation are different and each element deforms in all three directions simultaneously.

13. The system of claim 11, wherein the three resistances to deformation are adjusted so that each element deforms substantially only in two directions.

14. The system of claim 11, wherein the three resistances to deformation are adjusted so that each element deforms substantially only in one direction.

15. The system of claim 11, wherein the lateral-to-medial resistance to deformation comprises a medial component and a lateral component.

16. The system of claim 1, wherein a portion of the at least one element extends above a top surface of the sole.

17. A shoe comprising:

an upper;

a sole coupled to the upper; and at least one element depending from solely a portion of a bottom surface of the sole comprising:

a ground-contacting member having a ground-contacting surface;

at least one of a continuous sidewall and top surface bonding the ground-contacting member to the portion of the bottom surface of the sole;

an interior defined by the portion of the bottom surface of the sole, the sidewall and the top surface of the ground-contacting member and including at least one hollow portion;

a perpendicular resistance to deformation relative to the bottom surface of the sole; and a parallel resistance to deformation relative to the bottom surface of the sole so that the sole moves relative to a ground-contacting surface of the ground-contacting member of each element during foot fall, wherein a portion of the at least one element attached to a portion of a side of the sole.

18. A method comprising the step of bringing a shoe into and out of contact with a ground surface, wherein the shoe comprises:

an upper;

a sole coupled to the upper; and at least one element depending from a portion of a bottom surface of the sole comprising:

a ground-contacting member having a ground-contacting surface;

at least one of a continuous sidewall and a top surface bonding the ground-contacting member to the portion of the bottom surface of the sole;

an interior defined by the portion of the bottom surface of the sole, the sidewall and the top surface of the ground-contacting member and including at least one hollow portion;

a perpendicular resistance to deformation relative to an axis perpendicular to the bottom surface of the sole; and a parallel resistance to deformation relative to a deformation surface parallel with the bottom surface of the sole where the parallel resistance to deformation allows the sole to move relative to a ground-contacting surface of the ground-contacting member of each element during foot fall, wherein a portion of the at least one element attached to a portion of a side of the sole.

* * * * *

UNITED STATES PATENT AND TRADEMARK OFFICE

CERTIFICATE OF CORRECTION

PATENT NO. : 6,266,897 B1
DATED : July 31, 2001
INVENTOR(S) : Seydel et al.

It is certified that error appears in the above-identified patent and that said Letters Patent is hereby corrected as shown below:

Title page,
Item [63], delete "PCT/PE95/01128" and replace it with -- PCT/DE95/01128 --.

Column 62,
Line 66, please delete the word "attached" and replace it with the word -- attaches --.

Column 64,
Line 23, please delete the word "attached" and replace it with the word -- attaches --.
Line 49, please delete the word "attached" and replace it with the word -- attaches --.

Signed and Sealed this

Seventh Day of January, 2003

JAMES E. ROGAN
*Director of the United States Patent and Trademark Office*